US005297392A

United States Patent [19]

Takata et al.

[11] Patent Number: 5,297,392

[45] Date of Patent: Mar. 29, 1994

[54] AIR CONDITIONING APPARATUS

[75] Inventors: Shigeo Takata; Hidekazu Tani; Takashi Nakamura; Noriaki Hayashida; Tomohiko Kasai; Junichi Kameyama, all of Wakayama, Japan

[73] Assignee: Mitsubishi Denki Kabushiki Kaisha, Tokyo, Japan

[21] Appl. No.: 880,719

[22] Filed: May 8, 1992

[30] Foreign Application Priority Data

| | | | |
|---|---|---|---|
| May 9, 1991 | [JP] | Japan | 3-104407 |
| Jun. 4, 1991 | [JP] | Japan | 3-132671 |
| Jun. 4, 1991 | [JP] | Japan | 3-132758 |
| Jun. 6, 1991 | [JP] | Japan | 3-135024 |
| Jun. 12, 1991 | [JP] | Japan | 3-140004 |
| Jun. 13, 1991 | [JP] | Japan | 3-141980 |
| Jun. 20, 1991 | [JP] | Japan | 3-148360 |

[51] Int. Cl.[5] ..... F25B 13/00; F24F 7/00

[52] U.S. Cl. ..... 62/160; 62/197; 62/324.6; 236/49.3

[58] Field of Search ..... 62/160, 324.6, 231, 62/468, 197; 236/49.3

[56] References Cited

U.S. PATENT DOCUMENTS

| | | | |
|---|---|---|---|
| 4,862,705 | 9/1989 | Nakamura et al. | 62/324.1 |
| 4,987,747 | 1/1991 | Nakamura et al. | 62/160 |
| 5,063,752 | 11/1991 | Nakamura et al. | 62/225 |
| 5,156,014 | 10/1992 | Nakamura et al. | 62/160 |

FOREIGN PATENT DOCUMENTS

| | | |
|---|---|---|
| 0421459 | of 0000 | European Pat. Off. . |
| 62-56429 | 12/1980 | Japan . |
| 2-118372 | 5/1990 | Japan . |
| 2235993 | of 0000 | United Kingdom . |

*Primary Examiner*—William E. Wayner

*Attorney, Agent, or Firm*—Oblon, Spivak, McClelland, Maier & Neustadt

[57] ABSTRACT

An air conditioning apparatus which includes a single heat source device and plural indoor units including indoor heat exchangers. Some of the indoor units include a fan for introducing outdoor air, while others include a fan for circulating indoor air. In addition, a controller is provided for controlling operation of one or more of the indoor units to carry out heating, cooling or ventilation in response to a determination of the operation of one or more other indoor units.

13 Claims, 52 Drawing Sheets

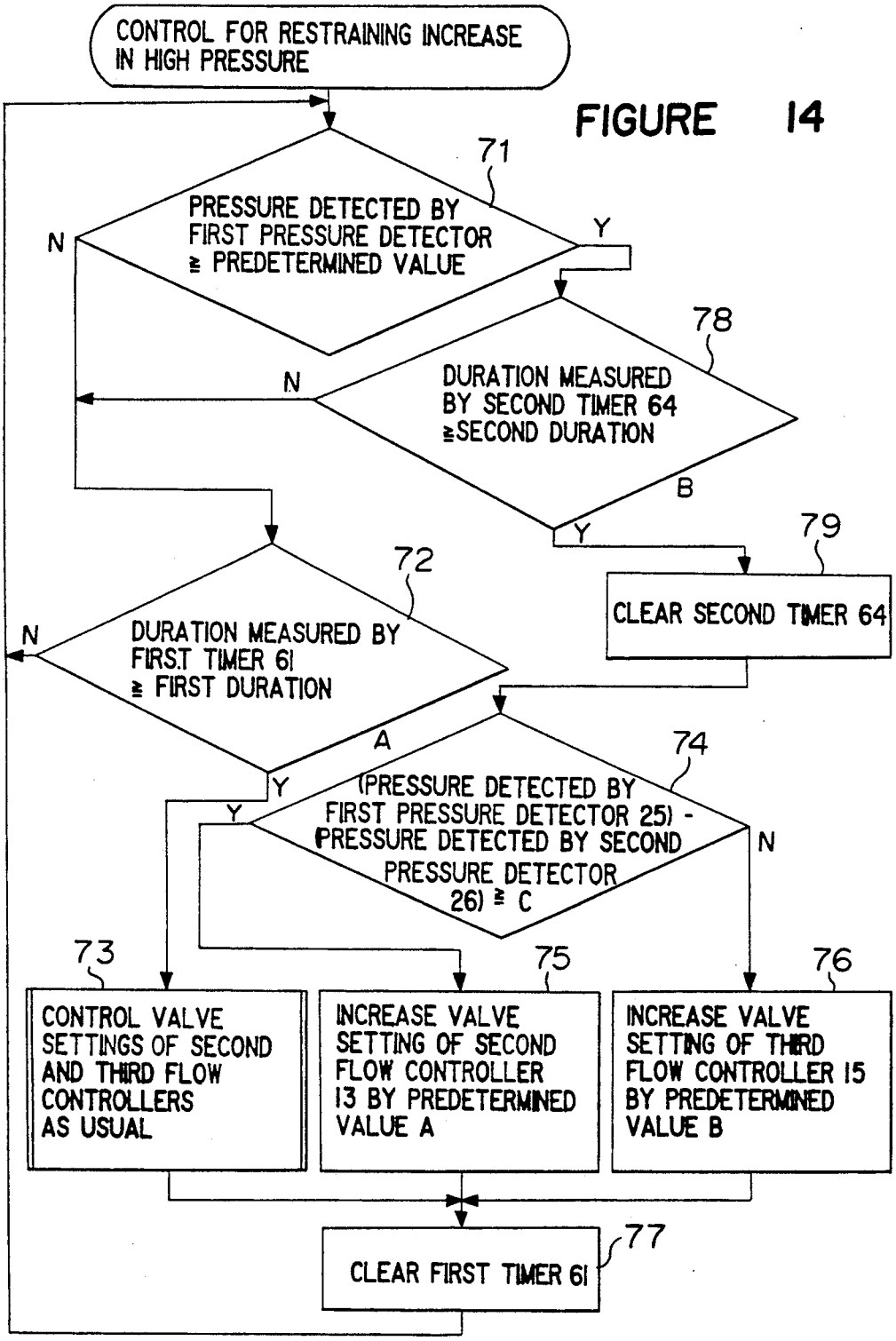
CONTROL FOR RESTRAINING INCREASE IN HIGH PRESSURE
FIGURE 14
71
PRESSURE DETECTED BY FIRST PRESSURE DETECTOR ≧ PREDETERMINED VALUE
N
Y
78
DURATION MEASURED BY SECOND TIMER 64 ≧SECOND DURATION
N
B
Y
79
CLEAR SECOND TIMER 64
72
DURATION MEASURED BY FIRST TIMER 61 ≧ FIRST DURATION
N
A
Y
74
(PRESSURE DETECTED BY FIRST PRESSURE DETECTOR 25) - (PRESSURE DETECTED BY SECOND PRESSURE DETECTOR 26) ≧ C
Y
N
73
CONTROL VALVE SETTINGS OF SECOND AND THIRD FLOW CONTROLLERS AS USUAL
75
INCREASE VALVE SETTING OF SECOND FLOW CONTROLLER 13 BY PREDETERMINED VALUE A
76
INCREASE VALVE SETTING OF THIRD FLOW CONTROLLER 15 BY PREDETERMINED VALUE B
77
CLEAR FIRST TIMER 61

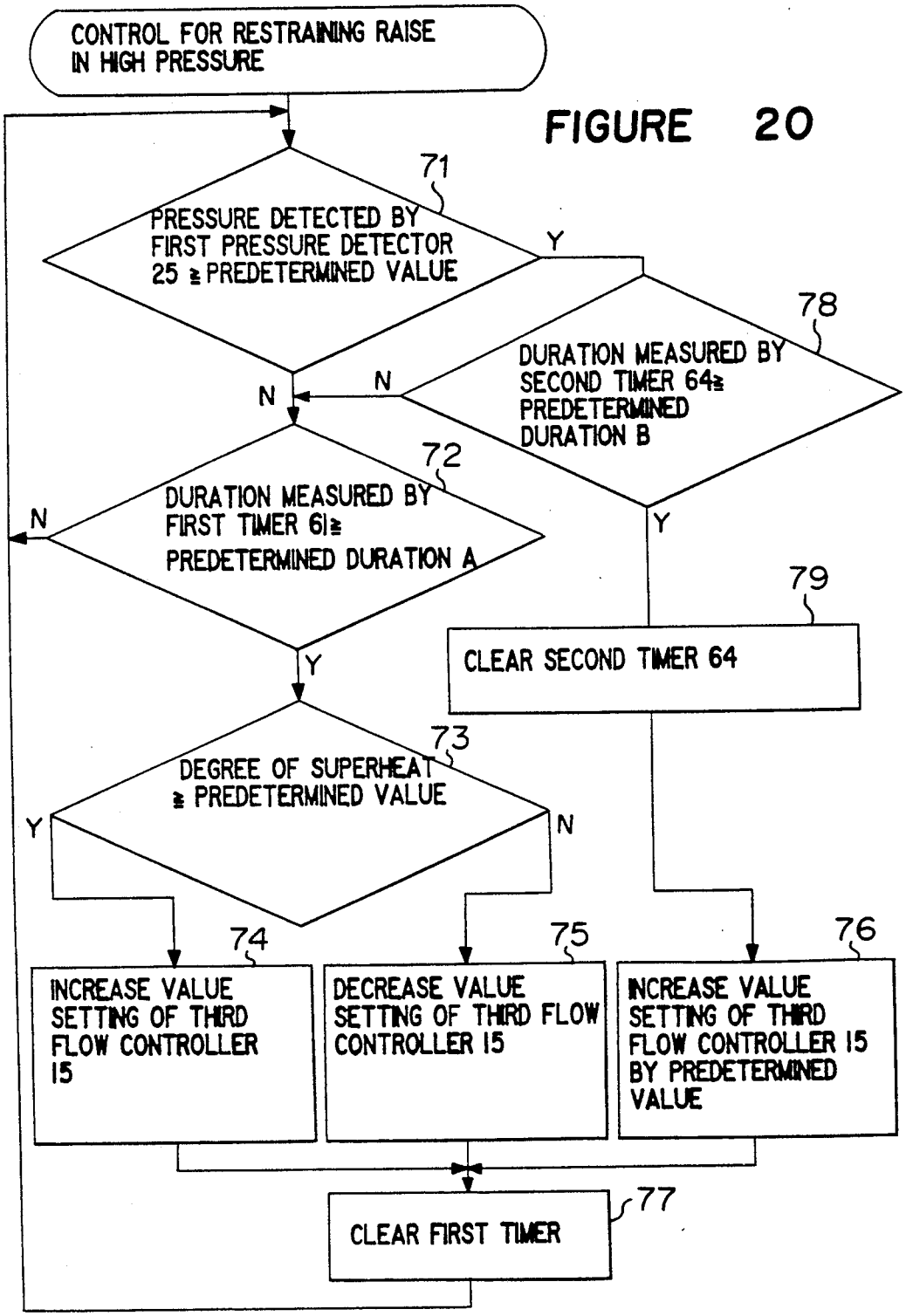
CONTROL FOR RESTRAINING RAISE IN HIGH PRESSURE
FIGURE 20
71
PRESSURE DETECTED BY FIRST PRESSURE DETECTOR 25 ≧ PREDETERMINED VALUE
Y
N
78
DURATION MEASURED BY SECOND TIMER 64≧ PREDETERMINED DURATION B
N
72
DURATION MEASURED BY FIRST TIMER 61≧ PREDETERMINED DURATION A
N
Y
79
CLEAR SECOND TIMER 64
Y
73
DEGREE OF SUPERHEAT ≧ PREDETERMINED VALUE
Y
N
74
INCREASE VALUE SETTING OF THIRD FLOW CONTROLLER 15
75
DECREASE VALUE SETTING OF THIRD FLOW CONTROLLER 15
76
INCREASE VALUE SETTING OF THIRD FLOW CONTROLLER 15 BY PREDETERMINED VALUE
77
CLEAR FIRST TIMER

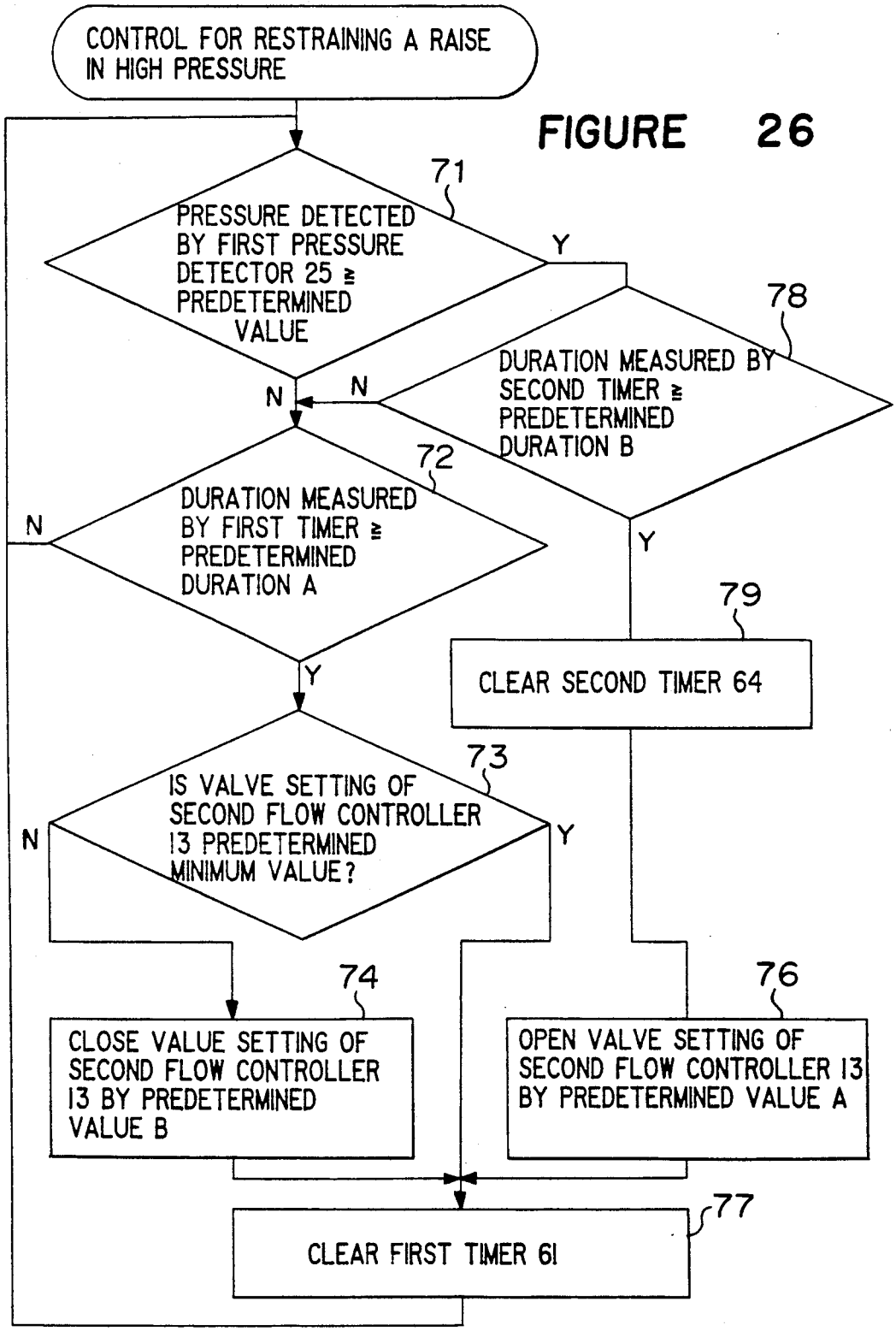
CONTROL FOR RESTRAINING A RAISE IN HIGH PRESSURE
FIGURE 26
71
PRESSURE DETECTED BY FIRST PRESSURE DETECTOR 25 ≧ PREDETERMINED VALUE
Y
N
78
DURATION MEASURED BY SECOND TIMER ≧ PREDETERMINED DURATION B
N
72
DURATION MEASURED BY FIRST TIMER ≧ PREDETERMINED DURATION A
N
Y
79
CLEAR SECOND TIMER 64
Y
73
IS VALVE SETTING OF SECOND FLOW CONTROLLER 13 PREDETERMINED MINIMUM VALUE?
N
Y
74
CLOSE VALUE SETTING OF SECOND FLOW CONTROLLER 13 BY PREDETERMINED VALUE B
76
OPEN VALVE SETTING OF SECOND FLOW CONTROLLER 13 BY PREDETERMINED VALUE A
77
CLEAR FIRST TIMER 61

AIR CONDITIONING APPARATUS

The present invention relates to a multi-room heat pump type of air conditioning apparatus wherein a single heat source device is connected to a plurality of indoor units. More particularly, the present invention relates to an air conditioning apparatus wherein cooling and heating can be selectively carried out for each indoor unit, or wherein cooling can be carried out in one or some indoor units, and simultaneously heating can be carried out in the other indoor unit(s).

Now, prior art references will be explained. Referring now to FIG. 47, there is shown a schematic diagram of the entire structure of a conventional air conditioning apparatus which is depicted on the basis of the refrigerant system of the apparatus, and which has been disclosed in Japanese Unexamined Patent Publication No. 118372/1990.

Referring to FIGS. 48–50, there are shown the operation states in cooling or heating in the conventional device shown in FIG. 47.

FIG. 48 is a schematic diagram showing the operation states of the conventional device wherein solo cooling or solo heating is performed; FIG. 49 and 50 are schematic diagrams showing the operation states of cooling and heating concurrent operation; FIG. 49 is a schematic diagram showing the operation state of the conventional device wherein heating is principally performed under cooling and heating concurrent operation (heating load is greater than cooling load); and FIG. 50 is a schematic diagram showing the operation state of the conventional device wherein cooling is principally performed under cooling and heating concurrent operation (cooling load is greater than heating load).

In these Figures, reference numeral A designates a heat source device. Reference numerals B, C and D designate indoor units which are connected in parallel as described later on, and which have the same structure. Reference numeral E designates a junction device which includes a first branch joint, a second flow controller, and a second branch joint.

Reference numeral 1 designates a compressor. Reference numeral 2 designates a four port reversing valve which can switch the flow direction of a refrigerant in the heat source device. Reference numeral 3 designates an outdoor heat exchanger. Reference numeral 4 designates an accumulator which is connected to the compressor 1, the reversing valve 2 and the outdoor heat exchanger 3 to constitute the heat source device A. Reference numeral 5 designates three indoor heat exchangers. Reference numeral 6 designates a first main pipe which connects the four way reversing valve 2 of the heat source device A and the junction device E. Reference numerals 6*b*, 6*c* and 6*d* designate first branch pipes which connect the junction device E and the indoor heat exchangers 5 of the respective indoor units B, C and D, and which correspond to the first main pipe 6. Reference numeral 7 designates a second main pipe which connects the junction device E and the outdoor heat exchanger 3 of the heat source device A. Reference numerals 7*b*, 7*c* and 7*d* designate second branch pipes which connect the junction device E and the indoor heat exchangers 5 of the respective indoor units B, C and D, and which correspond to the second main pipe 7. Reference numeral 8 designates three way switching valves which can selectively connect the first branch pipes 6*b*, 6*c* and 6*d* to either the first main pipe 6 or the second main pipe 7. Reference numeral 9 designates first flow controllers which are connected to the respective indoor heat exchangers 5 in close proximity to the same, which are controlled based on degree superheat in cooling and degree of subcooling amounts on heating at refrigerant outlet sides of the respective indoor heat exchangers, and which are connected to the second branch pipes 7*b*, 7*c* and 7*d*, respectively. Reference numeral 10 designates the first branch joint which includes the three way switching valves 8 which can selectively the first branch pipes 6*b*, 6*c* and 6*d* to either the first main pipe 6 or the second main pipe 7. Reference numeral 11 designates the second branch joint which includes the second branch pipes 7*b*, 7*c* and 7*d*, and the second main pipe 7. Reference numeral 13 designates the second flow controller which is connected between the second main pipe 7 and the second branch joint 11, and which can be selectively opened and closed.

The operation of the conventional device as constructed above will be explained.

Firstly, the case wherein only cooling is performed will be explained with reference to FIG. 48.

In this case, the flow of the refrigerant is indicated by arrows of solid line. The refrigerant gas which has discharged from the compressor 1 and been a gas having high temperature under high pressure passes through the four way reversing valve 2, and is heat exchanged in the outdoor heat exchanger 3 to be condensed and liquefied. Then, the liquefied refrigerant passes through the second main pipe 7 and the second flow controller 13 in that order. The refrigerant further passes through the second branch joint 11 and the second branch pipes 7*b*, 7*c* and 7*d*, and enters the indoor units B, C and D. The refrigerant which has entered the indoor units B, C and D is depressurized to low pressure by the first flow controllers 9. In the indoor heat exchangers 5, the refrigerant thus depressurized carries out heat exchanging with indoor air to be evaporated and gasified, thereby cooling the rooms. The refrigerant so gasified passes through the first branch pipes 6*b*, 6*c* and 6*d*, the three way switching valves 8, and the first branch joint 10. Then the refrigerant is inspired into the compressor through the first main pipe 6, the four way reversing valve 2 in the heat source device, and the accumulator 4. In this way, a circulation cycle is formed to carry out room cooling. At this mode, the three way switching valves 8 have first ports 8*a* closed, and second ports 8*b* and third ports 8*c* opened.

Secondly, the case wherein only heating is performed will be described with reference FIG. 48. In this case, the flow of the refrigerant is indicated by arrows of dotted line. The refrigerant which has been discharged from the compressor 1 and been a gas having high temperature under high pressure passes through the four way reversing valve 2 and the first main pipe 6. Then the refrigerant passes through the first branch joint 10, the three way switching valves 8, and the first branch pipes 6*b*, 6*c* and 6*d* in that order. After that, the refrigerant enters the respective indoor units B, C and D where the refrigerant carries out heat exchanging with indoor air. The refrigerant is condensed to be liquefied due to such heat exchanging, thereby heating rooms. The refrigerant thus liquefied passes through the first flow controllers 9. Then the refrigerant enters the second branch joint 11 through the second branch pipes 7*b*, 7*c* and 7*d*, and joins there. Then the joined refrigerant passes through the second flow controller 13. The refrigerant is depressurized by either the first flow controllers 9 or the second flow controller 13 to take a two phase state having low pressure. The refrigerant thus depressurized enters the outdoor heat exchanger 3 through the second main pipe 7 of the heat source device A, and carries out heat exchange to be evaporated and gasified. The refrigerant thus gasified is inspired into the compressor 1 through the four way reversing valve 2 of the heat source device, and the accumulator 4. In this way, a circulation cycle is formed to carry out room heating. In this mode, the switching valves 8 have the first to the third ports opened and closed like the solo cooling.

Thirdly, the case wherein heating is principally performed in cooling and heating concurrent operation will be explained with reference to FIG. 49. In FIG. 49, arrows of dotted line indicate the flow of the refrigerant. The refrigerant which has been discharged from the compressor 1 and been a gas having high temperature under high pressure is carried to the junction device E through the first main pipe 6. The refrigerant passes through the first branch joint 10, the three way switching valves 8, and the first branch pipes **6*b* and 6*c* in that order, and enters the indoor units B and C which are expected to carry out heating. In the indoor heat exchangers 5 of the respective indoor units B and C, the refrigerant carries out heat exchange with indoor air to be condensed and liquefied, thereby heating the rooms. The refrigerant thus condensed and liquefied passes through the first flow controllers 9 of the indoor units B and C, the first controllers 9 of the indoor units B and C being almost fully opened. The refrigerant is slightly depressurized by these first flow controllers 9, and flows into the second blanch joint 11. After that, a part of the refrigerant passes through the second branch pipe 7*d* of the indoor unit D which is expected to carry out cooling, and enters the indoor unit D. The refrigerant flows into the first flow controller 9 of the indoor unit D. After the refrigerant is depressurized by this first flow controller 9, it enters the indoor heat exchanger 5, and carries out heat exchange to be evaporated and gasified, thereby cooling the room. Then the refrigerant enters the second main pipe 7 through the three way switching valve 8** which is connected to the indoor unit D.

On the other hand, the other part of refrigerant enters in the second main pipe 7 through the second branch joint and the second flow controller 13. Then that part of the refrigerant joins with the part of the refrigerant which has passed the indoor unit D which is expected to carry out cooling. After that, the refrigerant thus joined enters the outdoor exchanger 3 where the refrigerant carries out heat exchange to be evaporated and gasified. The refrigerant thus gasified is inspired into the compressor 1 through the heat source device reversing valve 2 and the accumulator 4. In this way, a circulation cycle is formed to carry out the room cooling and room heating concurrent operation wherein room heating is principally performed. At that time, the three port switching valves 8 which are connected to the heating indoor units B and C have the first ports **8*a* closed, and the second and third ports 8*b* and 8*c* opened. The three port switching valve 8 which is connected to the cooling indoor unit D has the second port 8*b* closed, and the first port 8*a* and the third port 8*c*** opened.

Fourthly, the case wherein cooling is principally performed in cooling and heating concurrent operation will be described with reference to FIG. 50.

In FIG. 50, arrows of solid lines indicate the flow of the refrigerant. The refrigerant which has been discharged from the compressor 1 and been a gas having high temperature under high pressure carries out heat exchange at an arbitrary amount in the outdoor heat exchanger 3 to take a gas and liquid two phase state having high temperature under high pressure. Then the refrigerant is forwarded to the junction device E through the second main pipe 7. A part of the refrigerant flows through the first branch joint 10, and the three way switching valve 8 and the first branch pipe **6*d* which are connected to the indoor unit D, in that order, the indoor unit D being expected to heat the room with the indoor unit D installed in it. The refrigerant flows into the indoor unit D, and carries out heat exchange with the air in the room with the indoor heat exchanger 5 of the heating indoor unit D installed in it to be condensed and liquefied, thereby heating the room. In addition, the refrigerant passes through the first flow controller 9 connected to the heating indoor unit D, this first flow controller 9 being almost fully opened. The refrigerant flows into the second branch joint 11. On the other hand, the remaining part of the refrigerant enters the second branch joint 11 through the second flow controller 13. Then the refrigerant joins there with the part of the refrigerant which has passed through the heating indoor unit D. The refrigerant thus joined passes through the second branch joint 11, and then the second branch pipes 7*b* and 7*c*, respectively, and enters the respective indoor units B and C. The refrigerant which has flowed into the indoor units B and C is depressurized to low pressure by the first flow controllers 9 of the indoor units B and C. Then the refrigerant flows into the indoor heat exchangers 5, and carries out heat exchange with the air in the rooms having these indoor units B and C to be evaporated and gasified, thereby cooling these rooms. In addition, the refrigerant thus gasified passes through the first branch pipes 6*b* and 6*c*, the three way switching valves 8, and the first branch joint 10. Then the refrigerant is inspired into compressor 1 through the first main pipe 6, the four way reversing valve 2 in the heat source device A, and the accumulator 4. In this way, a circulation cycle is formed to carry out the room cooling and room heating concurrent operation wherein room cooling is principally performed. In this mode, the three way switching valves 8 which are connected to the indoor units B, C and D have the first to third ports 8*a*–8*c*** opened and closed like the room cooling and room heating concurrent operation wherein heating is principally performed.

Now, another prior art reference will be explained. Referring now to FIG. 51, there is shown a schematic diagram of the entire structure of the second conventional air conditioning apparatus, which is depicted on the basis of the refrigerant system of the apparatus.

Referring to FIGS. 52–54, there are shown the operation states in cooling or heating in the conventional device shown in FIG. 51.

FIG. 52 is a schematic diagram showing the operation states of the conventional device wherein solo cooling or solo heating is performed; FIGS. 53 and 54 are schematic diagrams showing the operation states of cooling and heating concurrent operation; FIG. 53 is a schematic diagram showing the operation state of the conventional device wherein heating is principally performed under cooling and heating concurrent operation (total heating load is greater than total cooling load); and FIG. 54 is a schematic diagram showing the operation state of the conventional device wherein cooling is principally performed under cooling and heating concurrent operation (total cooling load is greater than total heating load).

Explanation of the second prior art will be made for the case wherein a single heat source device is connected to three or two indoor units. The following explanation is also applicable to the case wherein a single source device is connected to more than three indoor units.

In FIG. 51, reference numeral A designates a heat source device. Reference numerals B, C and D designate the indoor units which are connected in parallel as described later on, and which have the same structure. Reference numeral E designates a junction device which includes a first branch joint, a second flow controller, a second branch joint, a gas-liquid separator, and first and second heat exchanging portions. Reference numeral 1 designates a compressor. Reference numeral 2 designates a four port reversing valve which can switch the flow direction of a refrigerant in the heat source device. Reference numeral 3 designates an outdoor heat exchanger which is installed on the side of the heat source device. Reference numeral 4 designates an accumulator which is connected to the compressor 1, the reversing valve 2 and the outdoor heat exchanger 3 to constitute the heat source device A. Reference numeral 5 designates three indoor heat exchangers in the indoor units B, C and D. Reference numeral 6 designates a first main pipe which has a large diameter and which connects the four way reversing valve 2 and the junction device E. Reference numerals 6*b*, 6*c* and 6*d* designate first branch pipes which connect the junction device E and the indoor heat exchangers 5 of the respective indoor units B, C and D, and which correspond to the-first main pipe 6. Reference numeral 7 designates a second main pipe which has a smaller diameter than the first main pipe 6, and which connects the junction device E and the outdoor heat exchanger 3 of the heat source device A. Reference numerals 7*b*, 7*c* and 7*d* designate second branch pipes which connect the junction device E and the indoor heat exchangers 5 of the respective indoor units B, C and D, and which correspond to the second main pipe 7. Reference numeral 8 designates three way switching valves which can selectively connect the first branch pipes 6*b*, 6*c* and 6*d* to either the first main pipe 6 or the second main pipe 7. Reference numeral 9 designates first flow controllers which are connected to the respective indoor heat exchangers 5 in close proximity to the same, which are controlled based on degree of superheat in cooling and degree of subcooling in heating at refrigerant outlet sides of the respective indoor heat exchangers, and which are connected to the second branch pipes 7*b*, 7*c* and 7*d*, respectively. Reference numeral 10 designates the first branch joint which includes the three way switching valves 8 which can selectively the first branch pipes 6*b*, 6*c* and 6*d* to either the first main pipe 6 or the second main pipe 7. Reference numeral 11 designates the second branch joint which includes the second branch pipes 7*b*, 7*c* and 7*d*, and a confluent portion thereof. Reference numeral 12 designates the gas-liquid separator which is arranged in the second main pipe 7, and which has a gaseous phase zone connected to first ports 8*a* of the respective switching valves 8 and a liquid phase zone connected to the second branch joint 11. Reference numeral 13 designates the second flow controller which is connected between the gas-liquid separator 12 and the second branch joint 11, and which can be selectively opened and closed. Reference numeral 14 designates a bypass pipe which connects the second branch joint 11 to the first main pipe 6. Reference numeral 15 designates a third flow controller which is arranged in the bypass pipe 14. Reference numerals 16*b*, 16*c* and 16*d* designate third heat exchanging portions which are arranged in the bypass pipe 14 downstream of the third flow controller 15, and which carry out heat exchange with the respective second branch pipes 7*b*, 7*c* and 7*d* in the second branch joint 11. Reference numeral 16*a* designates the second heat exchanging portion which is arranged in the bypass pipe 14 downstream of the third flow controller 15 and the third heat exchanging portions 16*b*, 16*c* and 16*d*, and which carries out heat exchanging with the confluent portion where the second branch pipes 7*b*, 7*c* and 7*d* join in the second branch joint. Reference numeral 19 designates the first heat exchanging portion which is arranged in the bypass pipe 14 downstream of the third flow controller 15 and the second heat exchanging portion 16*a*, and which carries out heat exchanging with the pipe which connects between the gas-liquid separator 12 and the second flow controller 13. Reference numeral 17 designates a fourth flow controller which is arranged in a pipe between the second branch joint 11 and the first main pipe 6, and which can be selectively opened and closed. Reference numeral 32 designates a third check valve which is arranged between the outdoor heat exchanger 3 and the second main pipe 7, and which allows the refrigerant only to flow from the outdoor heat exchanger 3 to the second main pipe 7. Reference numeral 33 designates a fourth check valve which is arranged between the four way reversing valve 2 of the heat source device A and the first main pipe 6, and which allows the refrigerant only to flow from the first main pipe 6 to the reversing valve 2. Reference numeral 34 designates a fifth check valve which is arranged between the reversing valve 2 and the second main pipe 7, and which allows the refrigerant only to flow from the reversing valve 2 to the second main pipe 7. Reference numeral 35 designates a sixth check valve which is arranged between the outdoor heat exchanger 3 and the first main pipe 6, and which allows the refrigerant only to flow from the first main pipe 6 to the outdoor heat exchanger 3. The third to sixth check valves 32–35 constitute a switching valve arrangement 40.

Reference numeral 41 designates a liquid purging pipe which has one end connected to the gas-liquid separator 12 and the other end connected to the first main pipe 6. Reference numeral 42 designates a fifth flow controller which is arranged in the liquid purging pipe 41 between the gas liquid separator 12 and the first main pipe 6. Reference numeral 43 designates a fourth heat exchanging portion which is arranged in the liquid purging pipe 41 downstream of the fifth flow controller 42, and which carries out heat exchange with the pipe connecting between the gas-liquid separator 12 and the first branch joint 10.

Reference numeral 23 designates a first temperature detector which is attached to the pipe connecting between the second flow controller 13 and the first heat exchanging portion 19. Reference numeral 25 designates a first pressure detector which is attached to the same pipe as the first temperature detector 23. Reference numeral 26 designates a second pressure detector which is attached to the second branch joint 11. Reference numeral 52 designates a third pressure detector which is attached to the pipe connecting between the first main pipe 6 and the first branch joint 10. Reference numeral 51 designates a second temperature detector which is attached to the liquid purging pipe 41 at a refrigerant outlet of the fourth heat exchanging portion 43. Reference numeral 53 designates a third temperature detector which is attached to the bypass pipe 14 at a refrigerant outlet of the first heat exchanging portion 19.

The operation of the second prior art as constructed above will be explained.

Firstly, the case wherein only room cooling is performed will be explained with reference to FIG. 52.

In this case, the flow of the refrigerant is indicated by arrows of solid line. The refrigerant gas which has discharged from the compressor 1 and been a gas having high temperature under high pressure passes through the four way reversing valve 2, and is heat exchanged and condensed in the outdoor heat exchanger 3. Then, the refrigerant passes through the third check valve 32, the second main pipe 7, the separator 12 and the second flow controller 13 in that order. The refrigerant further passes through the second branch joint 11 and the second branch pipes 7*b*, 7*c* and 7*d*, and enters the indoor units B, C and D. The refrigerant which has entered the indoor units B, C and D is depressurized to low pressure by the first flow controllers 9 which are controlled based on degree of superheat at the outlet refrigerants of the respective indoor heat exchanger 5. In the indoor heat exchangers 5, the refrigerant thus depressurized carries out heat exchanging with indoor air to be evaporated and gasified, thereby cooling the rooms. The refrigerant so gasified passes through the first branch pipes 6*b*, 6*c* and 6*d*, the three way switching valves 8, and the first branch joint 10. Then the refrigerant is inspired into the compressor 1 through the first main pipe 6, the fourth check valve 33, the four way reversing valve 2, and the accumulator 4. In this way, a circulation cycle is formed to carry out cooling. At this mode, the three way switching valves 8 have the first ports 8*a* closed, and second ports 8*b* and third ports 8*c* opened. At the time, the first main pipe 6 is at low pressure in it, and the second main pipe 7 is at high pressure in it, which necessarily make the third check valve 32 and the fourth check valve 33 to conduct for the refrigerant. In addition, in this mode, the refrigerant, which has passed through the second flow controller 13, partly enters the bypass pipe 14 where the entered part of the refrigerant is depressurized to low pressure by the third flow controller 15. The refrigerant thus depressurized carries out heat exchanging with the second branch pipes 7*b*, 7*c* and 7*d* at the third heat exchanging portions 16*b* 16*c* and 16*d* of the indoor units, with the confluent portion of the second branch pipes 7*b*, 7*c* and 7*d* at the second heat exchanging portion 16*a* in the second branch joint 11, and at the first heat exchanging portion 19 with the refrigerant which enters the second flow controller 13. The refrigerant is evaporated due to such heat exchanging, and enters the first main pipe 6. Then the refrigerant is inspired into the compressor 1 through the fourth check valve 33, the first four way reversing valve 2 and the accumulator 4. On the other hand, the refrigerant, which has heat exchanged at the first heat exchanging portion 19, at the second heat exchanging portion 16*a* and at the third heat exchanging portions 16*b*, 16*c* and 16*d*, and has been cooled so as to get sufficient degree of subcooling, enters the indoor units B, C and D which are expected to carry out room cooling.

When the amount of the refrigerant which is sealed in the air conditioning apparatus is not enough to fill the second main pipe in cooling with a liquid refrigerant having high pressure, the refrigerant which has been condensed in the outdoor heat exchanger 3 and has a two phase state under high pressure passes through the second main pipe 7 and the gas-liquid separator 12. Then the two phase refrigerant carries out heat exchange, at the first heat exchanging portion 19, at the second heat exchanging portion 16*a*, and at the third heat exchanging portions 16*b*, 16*c* and 16*d*, with the refrigerant which has been depressurized to low pressure by the third flow controller 15 and flows through the bypass pipe. The refrigerant which has liquefied and cooled due to such heat exchange to obtain sufficient degree of subcooling, and flows into the indoor units B, C and D which are expected to carry out cooling.

Secondly, the case wherein only heating is performed will be described with reference FIG. 52. In this case, the flow of the refrigerant is indicated by arrows of dotted line. The refrigerant which has been discharged from the compressor 1 and been a gas having high temperature under high pressure passes through the four way reversing valve 2, the fifth check valve 34, the second main pipe 7, and the gas liquid separator 12. Then the refrigerant passes through the first branch joint 10, the three way switching valves 8, and the first branch pipes 6*b*, 6*c* and 6*d*. After that, the refrigerant enters the respective indoor units B, C and D where the refrigerant carries out heat exchanging with indoor air. The refrigerant is condensed to be liquefied due to such heat exchanging, thereby heating the rooms. The refrigerant thus liquefied passes through the first flow controllers 9 which are controlled based on degree of subcooling at the refrigerant outlets of the respective indoor heat exchangers 5. Then the refrigerant enters the second branch joint 11 through the second branch pipes 7*b*, 7*c* and 7*d*, and joins there. Then the joined refrigerant passes through the fourth flow controller 17. The refrigerant is depressurized by either the first flow controllers 9 or the fourth flow controller 17 to take a two phase state having low pressure. The refrigerant thus depressurized enters the outdoor heat exchanger 3 through the first main pipe 6 and the sixth check valve 35 of the heat source device A, and carries out heat exchanging to be evaporated and gasified. The refrigerant thus gasified is inspired into the compressor 1 through the four way reversing valve 2, and the accumulator 4. In this way, a circulation cycle is formed to carry out room heating. In this mode, the switching valves 8 have the second ports 8*b* closed, and the first and the third ports 8*a* and 8*c* opened.

In this mode, the first main pipe 6 is at low pressure in it, and the second main pipe 7 is at high pressure in it, which necessarily causes the fifth check valve 34 and the sixth check valve 35 to conduct for the refrigerant.

Thirdly, the case wherein heating is principally performed in cooling and heating concurrent operation will be explained with reference to FIG. 53. Explanation will be made for the case wherein the indoor units B and C are expected to carry out heating, and the indoor unit D is expecting to carry out cooling. In FIG. 53, arrows of dotted line indicate the flow of the refrigerant.

The refrigerant which has been discharged from the compressor 1, and been a gas having high temperature under high pressure passes through the four way reversing valve 2, and then reaches the junction device E through the fifth check valve 34 and the second main pipe 7. The refrigerant flows through the gas-liquid separator 12. In addition, the refrigerant passes through the first branch joint 10, the three way switching valves 8 connected to the indoor units B and C, and the first branch pipes 6*b* and 6*c* in that order, and enters the indoor units B and C which are expected to carry out heating. In the indoor heat exchangers 5 of the respective indoor units B and C, the refrigerant carries out heat exchange with indoor air to be condensed and liquefied, thereby heating the rooms. The refrigerant thus liquefied passes through the first flow controllers 9 of the indoor units B and C, the first controllers 9 of the indoor units B and C being almost fully opened under the control based on degree of subcooling at the refrigerant outlets of the corresponding indoor heat exchangers 5. The refrigerant is slightly depressurized by these first flow controllers 9 to have a pressure (medium pressure) between the high pressure and the low pressure, and flows into the second branch joint 11 through the second branch pipes 7*b* and 7*c*. After that, a part of the refrigerant passes through the second branch pipe 7*d* of the indoor unit D which is expected to carry out cooling, and enters the indoor unit D. The refrigerant flows into the first flow controller 9 of the indoor unit D, the first flow controller 9 being controlled based on degree of superheat at the refrigerant outlet of the corresponding indoor heat exchanger 5. After the refrigerant is depressurized by this first flow controller 9, it enters the indoor heat exchanger 5, and carries out heat exchange to be evaporated and gasified, thereby cooling the room. Then the refrigerant enters the first main pipe 6 through the three way switching valve 8 which is connected to the indoor unit D.

On the other hand, another part of refrigerant passes through the fourth flow controller 17 which is selectively opened and closed, and which is controlled in such a way to make constant the difference between the high pressure in the second main pipe 7 and the medium pressure in the second branch joint 11. Then the refrigerant joins with the refrigerant which has passed the indoor unit D which is expected to carry out cooling. After that, the refrigerant thus joined passes through the first main pipe 6 having such a larger diameter, and the sixth check valve 35, and enters the outdoor exchanger 3 where the refrigerant carries out heat exchange to be evaporated and gasified. The refrigerant thus gasified is inspired into the compressor 1 through the reversing valve 2 and the accumulator 4. In this way, a circulation cycle is formed to carry out the cooling and heating concurrent operation wherein heating is principally performed. At this time, the difference between the evaporation pressure in the indoor heat exchanger 5 of the cooling indoor unit D and that of the outdoor heat exchanger 3 lessens because of switching to the first main pipe 6 having such a greater diameter. At that time, the three port switching valves 8 which are connected to the heating indoor units B and C have the second ports 8*b* closed, and the first and third ports 8*a* and 8*c* opened. The three port switching valve 8 which is connected to the cooling indoor unit D has the second port 8*a* closed, and the first port 8*b* and the third port 8*c* opened.

In this mode, the first main pipe 6 is at low pressure in it, and the second main pipe 7 is at high pressure in it, which necessarily causes the fifth check valve 34 and the sixth check valve 35 to conduct for the refrigerant. At this circulation cycle, the remaining part of the liquefied refrigerant goes into the bypass pipe 14 from the confluent portion where the second branch pipes 7*b*, 7*c* and 7*d* join together. The refrigerant which has gone into the bypass pipe 14 is depressurized to low pressure by the third flow controller 15. The refrigerant thus depressurized carries out heat exchange with the refrigerant in the confluent portion of the second branch pipes 7*b*, 7*c* and 7*d* in the second branch joint 11 at the second heat exchanging portion 16*a*, and at the first heat exchanging portion 19 with the refrigerant which flows into the second flow controller 13. The refrigerant is evaporated by such heat exchange, and enters the first main pipe 6. After that, the refrigerant flows into the sixth check valve 35 and then into the outdoor heat exchanger 3 where it performs heat exchange to be evaporated and gasified. The refrigerant is inspired into the compressor 1 through the four way reversing valve 2 and the accumulator 4. On the other hand, the refrigerant in the second branch joint 11 which has carried out heat exchange and cooled at the first heat exchanging portion 19, at the second heat exchanging portion 16*a*, and at the third heat exchanging portions 16*b*, 16*c* and 16*d* to obtain sufficient degree of subcooling flows into the indoor unit D which is expected to cool the room.

Fourthly, the case wherein cooling is principally performed in cooling and heating concurrent operation will be described with reference to FIG. 54.

Explanation will be made for the case wherein the indoor units B and C are expected to carry out cooling, and the indoor unit D is expected to carry out heating.

In FIG. 54, arrows of solid lines indicate the flow of the refrigerant. The refrigerant which has been discharged from the compressor 1 and been a gas having high temperature under high pressure carries out heat exchange at an arbitrary amount in the outdoor heat exchanger 3 to take a two phase state having high temperature under high pressure. Then the refrigerant passes through the third check valve 32 and the second main pipe 7, and is forwarded to the gas-liquid separator 12 in the junction device E. The refrigerant is separated into a gaseous refrigerant and a liquid refrigerant there, and the gaseous refrigerant thus separated flows through the first branch joint 10, and the three way switching valve 8 and the first branch pipe 6*d* which are connected to the indoor unit D, in that order, the indoor unit D being expected to heat the room. The refrigerant flows into the indoor unit D, and carries out heat exchange with indoor air to be condensed and liquefied, thereby heating the room. In addition, the refrigerant passes through the first flow controller 9 connected to the heating indoor unit D, this first flow controller 9 being almost fully opened under control based on degree of subcooling at the refrigerant outlet of the indoor heat exchanger 5 of the heating indoor unit D. The refrigerant is slightly depressurized by this first flow controller 9 to have a pressure (medium pressure) between the high pressure and the low pressure, and flows into the second branch joint 11. On the other hand, the remaining liquid refrigerant enters the second branch joint 11 through the second flow controller 13 which is controlled in such a way to make constant the difference between the high pressure and the medium pressure. Then the refrigerant joins there with the refrigerant which has passed through the heating indoor unit D. The refrigerant thus joined passes through the second branch joint 11, and then the second branch pipes 7b and 7c, respectively, and enters the respective indoor units B and C. The refrigerant which has flowed into the indoor units B and C is depressurized to low pressure by the first flow controllers 9 of the indoor units B and C, these first flow controllers 9 being controlled based on degree of superheat at the refrigerant outlets of the corresponding indoor heat exchangers 5. Then the refrigerant flows into the indoor heat exchangers 5, and carries out heat exchange with indoor air to be evaporated and gasified, thereby cooling these rooms. In addition, the refrigerant thus gasified passes through the first branch pipes 6b and 6c, the three way switching valves 8 connected to the indoor units B and C, and the first branch joint 10. Then the refrigerant is inspired into compressor 1 through the first main pipe 6, the fourth check valve 33, the four way reversing valve 2, and the accumulator 4. In this way, a circulation cycle is formed to carry out the cooling and heating concurrent operation wherein cooling is principally performed. In this mode, the three way switching valves 8 which are connected to the indoor units B and C have the first ports 8a closed, and the second and third ports 8b and 8c opened. The three way switching valve 8 which is connected to the indoor unit D has the second port 8b closed, and the first and third ports 8a and 8c opened.

At that time, the first main pipe 6 is at low pressure in it, and the second main pipe 7 is a high pressure in it, which necessarily causes the third check valve 32 and the fourth check valve 33 to conduct for the refrigerant.

In this circulation cycle, the liquid refrigerant partly enters the bypass pipe 14 from the confluent portion where the second branch pipes 7b, 7c and 7d join together. The liquid refrigerant which has entered into the bypass pipe 14 is depressurized to low pressure by the third flow controller 15. The refrigerant thus depressurized carries out heat exchange at the second heat exchanging portion 16a with the refrigerant in the confluent portion of the second branch pipes 7b, 7c and 7d in the second branch joint 11, and at the first heat exchanging portion 19 with the refrigerant which flows into the second flow controller 13. The refrigerant is evaporated by such heat exchange, and enters the first main pipe 6. The refrigerant which has entered the first main pipe 6 is inspired into the compressor 1 through the fourth check valve 33, the four way reversing valve 2, and the accumulator 4.

On the other hand, the refrigerant in the second branch joint 11 which has carried out heat exchange and cooled at the first heat exchanging portion 19, at the second heat exchanging portion 16a, and at the third heat exchanging portions 16b, 16c and 16d to obtain sufficient degree of subcooling flows into the indoor units B and C which are expected to carry out room cooling.

When the liquid level at which the gaseous refrigerant and the liquid refrigerant separated in the gas liquid separator 12 are divided is below the liquid purging pipe 41 of the gas-liquid separator 12, the gaseous refrigerant enters the liquid purging pipe 41, and is depressurized to low pressure by the fifth flow controller 42. The amount of the refrigerant which is flowing through the fifth flow controller 42 is small because the refrigerant at the inlet of the fifth flow controller 42 is in the form of gas. As a result, the refrigerant which is flowing through the liquid purging pipe 41 carries out heat exchange, at the fourth heat exchanging portion 43, with the gaseous refrigerant which goes from the gas-liquid separator 12 to the first branch joint 10 and has high pressure. The refrigerant in the liquid purging pipe 41 becomes a superheated gas having low pressure due to such heat exchange, and enters the first main pipe 6.

Conversely, when the liquid level at which the gaseous refrigerant and the liquid refrigerant separated in the gas liquid separator 12 are divided is above the liquid purging pipe 41 of the gas liquid separator 12, the liquid refrigerant enters the liquid purging pipe 41, and is depressurized to low pressure by the fifth flow controller 42. Because the refrigerant at the inlet of the fifth flow controller 42 is in the form of liquid, the amount of the refrigerant which is flowing through the fifth flow controller 42 is greater in comparison with the case wherein the refrigerant at the fifth flow controller 42 is in the form of gas. As a result, even when the refrigerant which is flowing through the liquid purging pipe 41 carries out heat exchanger, at the fourth heat exchanging portion 43, with the gaseous refrigerant which goes from the gas liquid separator 12 into the first branch joint 10 and has high pressure, the refrigerant in the liquid purging pipe 41 enters the first main pipe 6 in the form of two phase state without becoming a superheated gas having low pressure. The conventional air conditioning apparatuses involve the following problems:

The compressor could be seized by a lubricating oil which has been discharged with the refrigerant from the compressor and stayed in the junction device.

Because the conventional two pipe type air conditioning apparatuses capable of carrying out cooling and heating concurrent operation are constructed as stated earlier, switching the reversing valve reverses the flow of the refrigerant in the first and second main pipe and the junction device. As a result, whenever the reversing valve is switched, the operating states are rapidly changed, requiring some time to stabilize the system.

In addition, the second main pipe has much pressure loss in the cooling and heating concurrent operation wherein heating is principally performed, creating a problem in that a cooling indoor unit is short of capacity.

Because the conventional apparatuses do not have a ventilating function as one of air conditioning functions, a ventilating device is required. In addition, the conventional apparatuses involve a problem in that it can not cope with load which is occurred by introducing outdoor air.

In the case of the conventional air conditioning apparatuses, when the number of cooling indoor units increases in cooling, the suction pressure of the compressor is raised to transitionally increase the discharge pressure of the compressor, creating a problem in that the compressor deteriorates its reliability due to an increase in the discharge pressure.

In addition, when the number of heating indoor units decreases in heating, the discharge pressure of the compressor 1 is transitionally raised to create a problem in that the compressor deteriorates its reliability due to an increase in the discharge pressure.

Further, when the number of cooling indoor units increases in cooling, the suction pressure of the compressor is raised to transitionally increase the discharge pressure of the compressor, and a discharge temperature is caused to rise, creating a problem in that the compressor deteriorates its reliability due to an excessive increase in the discharge temperature.

Furthermore, when the number of heating indoor units decreases in heating, the discharge pressure of the compressor is transitionally raised to increase the discharge temperature, creating a problem in that the compressor deteriorates its reliability due to an excessive raise in the discharge temperature.

It is an object of the present invention to provide an air conditioning apparatus capable of returning to a compressor a lubricating oil (hereinbelow, referred to as oil recovery) which has been discharged with a refrigerant from the compressor and stayed in a junction device.

It is another object of the present invention to provide an air conditioning apparatus capable of cooling and heating concurrent operation in such a manner that even when a four port reversing valve is switched, a refrigerant can flow one way in a first and second main pipes and a junction device, improving stability in the system.

It is still another object of the present invention to provide an air conditioning apparatus capable of constantly using on a lower pressure side a first main pipe greater than a second main pipe to decrease pressure loss in low pressure, preventing the capacity of a cooling indoor unit from lowering.

It is a further object of the present invention to provide an air conditioning apparatus capable of operating without stopping, by expanding a bypass conduit in a junction device when a high pressure is transitionally raised due to a change in the number of operating indoor units during the operation of a compressor.

It is a still further object of the present invention to provide an air conditioning apparatus capable of operating without stopping, by expanding a bypass conduit in a junction device when a high pressure is transitionally raised due to a change in the number of operating indoor units in only cooling.

It is another object of the present invention to provide an air conditioning apparatus capable of operating without stopping, by expanding a bypass conduit in a junction device when a high pressure is transitionally raised due to a change in the number of operating indoor units in only heating or in cooling and heating concurrent operation wherein heating is principally performed.

A further object of the present invention is to provide an air conditioning apparatus wherein cooling and heating can be selectively carried out for each indoor unit, or wherein cooling can be carried out in one or some indoor units, and simultaneously heating can be carried out in the other indoor unit(s), and which can have a ventilating function, and cope with load caused by ventilation in accordance with the operation states of driving indoor units.

A still further object of the present invention is to provide an air conditioning apparatus capable of preventing the discharge pressure of a compressor from raising to realize a stable operation even when the number of cooling or heating indoor units changes.

A still further object of the present invention is to provide an air conditioning apparatus capable of preventing the discharge temperature of a compressor from excessively raising to realize a stable operation even when the number of cooling or heating indoor units changes.

The present invention provides an air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which is connected to the other end of the indoor heat exchanger of each indoor unit through the first flow controllers, and which connects the other end to the second main pipe through a second flow controller;

the first branch joint and the second branch joint connected together through the second flow controller;

the second branch joint connected to the first main pipe through a third flow controller;

a junction device which includes the first branch joint, the second flow controller, the third flow controller and the second branch joint, and which is interposed between the heat source device and the indoor units;

the first main pipe having a greater diameter than the second main pipe;

a switching arrangement which can be arranged between the first main pipe and the second main pipe in the heat source device to switch the first main pipe and the second main pipe to a low pressure side and to a high pressure side, respectively, when the outdoor heat exchanger works as a condenser or as an evaporator;

a first timer for changing the setting of the second flow controller at a first cycle during operation of the compressor;

a second timer for returning the setting of the second flow controller to its initial setting at a second cycle longer than the first cycle; and determination means for changing the setting of the second flow controller by a predetermined value at a time based on outputs from the first timer, and for returning the setting of the second flow controller to the initial setting based on an output from the second timer.

The present invention also provides an air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which is connected to the other end of the indoor heat exchanger of each indoor unit through the first flow controllers, and which connects the other end to the second main pipe through a second flow controller;

the first branch joint and the second branch joint connected together through the second flow controller;

the second branch joint connected to the first main pipe through a third flow controller;

a junction device which includes the first branch joint, the second flow controller, the third flow controller and the second branch joint, and which is interposed between the heat source device and the indoor units;

the first main pipe having a greater diameter than the second main pipe; and a switching arrangement which can be arranged between the first main pipe and the second main pipe in the heat source device to switch the first main pipe and the second main pipe to a low pressure side and to a high pressure side, respectively, when the outdoor heat exchanger works as a condenser or as an evaporator;

wherein a predetermined minimum value is set with respect to the setting of the second flow controller during operation of the compressor.

The present invention also provides an air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which is connected to the other end of the indoor heat exchanger of each indoor unit through the first flow controllers, and which connects the other end to the second main pipe through a second flow controller;

the first branch joint and the second branch joint connected together through the second flow controller;

the second branch joint connected to the first main pipe through a third flow controller;

a junction device which includes the first branch joint, the second flow controller, the third flow controller and the second branch joint, and which is interposed between the heat source device and the indoor units;

the first main pipe having a greater diameter than the second main pipe; and a switching arrangement which can be arranged between the first main pipe and the second main pipe in the heat source device to switch the first main pipe and the second main pipe to a low pressure side and to a high pressure side, respectively, when the outdoor heat exchanger works as a condenser or as an evaporator;

wherein a capillary is arranged in parallel with the second flow controller.

The present invention also provides an air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which is connected to the other end of the indoor heat exchanger of each indoor unit through the first flow controllers, and which connects the other end to the second main pipe through a second flow controller;

the first branch joint and the second branch joint connected together through the second flow controller;

the second branch joint connected to the first main pipe through a third flow controller;

a junction device which includes the first branch joint, the second flow controller, the third flow controller and the second branch joint, and which is interposed between the heat source device and the indoor units;

the first main pipe having a greater diameter than the second main pipe; and a switching arrangement which can be arranged between the first main pipe and the second main pipe in the heat source device to switch the first main pipe and the second main pipe to a low pressure side and to a high pressure side, respectively;

a first pressure detector and a second pressure detector arranged at a refrigerant inlet side and a refrigerant outlet side of the second flow controller, respectively; and determination means for selectively increasing the setting of one of the second flow controller and the third flow controller, depending on a differential pressure applied to the second flow controller, in such a manner that the value detected by the first and second pressure detectors are used as inputs when a high pressure is transitionally raised during operation of the compressor.

The present invention also provides an air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which is connected to the other end of the indoor heat exchanger of each indoor unit through the first flow controllers, and which connects the other end to the second main pipe through a second flow controller;

the first branch joint and the second branch joint connected together through the second flow controller;

the second branch joint connected to the first main pipe through a third flow controller;

a junction device which includes the first branch joint, the second flow controller, the third flow controller and the second branch joint, and which is interposed between the heat source device and the indoor units;

the first main pipe having a greater diameter than the second main pipe; and a switching arrangement which can be arranged between the first main pipe and the second main pipe in the heat source device to switch the first main pipe and the second main pipe to a low pressure side and to a high pressure side, respectively; and determination means for increasing the setting of the third flow controller when high pressure is transitionally raised in only cooling.

The present invention also provides an air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively contact one end of the indoor heat exchanger of each indoor unit to either one of the first main pipe and the second main pipe;

a second branch joint which is connected to the other end of the indoor heat exchanger of each indoor unit through the first flow controllers, and which connects the other end to the second main pipe through a second flow controller;

the first branch joint and the second branch joint connected together through the second flow controller;

the second branch joint connected to the first main pipe through a third flow controller;

a junction device which includes the first branch joint, the second flow controller, the third flow controller and the second branch joint, and which is interposed between the heat source device and the indoor units;

the first main pipe having a greater diameter than the second main pipe; and a switching arrangement which can be arranged between the first main pipe and the second main pipe in the heat source device to switch the first main pipe and the second main pipe to a low pressure side and to a high pressure side, respectively; and determination means for increasing the setting of the second flow controller when high pressure is transitionally raised in only heating or cooling and heating concurrent operation with heating principally performed.

The present invention also provides an air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which connects the other end of the indoor heat exchanger of each indoor unit to the second main pipe through the first flow controllers;

the first branch joint and the second branch joint connected together through a second flow controller; and the indoor units constituted by a first indoor unit and second indoor units, the first indoor units having a fan for introducing outdoor air, and carrying out heat exchange with outdoor air introduced by the fan, the second indoor units having fans for circulating indoor air, and carrying out heat exchange with the air circulated by the fans;

wherein when at least one of the second indoor units carries out heating, the first indoor unit carries out heating.

The present invention also provides an air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which includes a switching arrangement for selectively connect one end of the indoor heat exchanger of each indoor unit to either one of the first main pipe and the second main pipe;

a second branch joint which connects the other end of the indoor heat exchanger of each indoor unit to the second main pipe through the first flow controllers;

the first branch joint and the second branch joint connected together through a second flow controller; and the indoor units constituted by a first indoor unit and second indoor units, the first indoor units having a fan for introducing outdoor air, and carrying out heat exchange with outdoor air introduced by the fan, the second indoor units having fans for circulating indoor air, and carrying out heat exchange with the air circulated by the fans;

wherein when none of the second indoor units carry out heating, and at least one of the second indoor units carries out cooling, the first indoor unit carries out cooling.

The present invention also provides an air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which connects the other end of the indoor heat exchanger of each indoor unit to the second main pipe through the first flow controllers;

the first branch joint and the second branch joint connected together through a second flow controller; and the indoor units constituted by a first indoor unit and second indoor units, the first indoor units having a fan for introducing outdoor air, and carrying out heat exchange with outdoor air introduced by the fan, the second indoor units having fans for circulating indoor air, and carrying out heat exchange with the air circulating by the fans;

wherein when none of the second indoor units carry out heating or cooling, and at least one of the second indoor units carries out ventilation, the first indoor unit carries out ventilation.

The present invention also provides an air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which connects the other end of the indoor heat exchanger of each indoor unit to the second main pipe through the first flow controllers;

the first branch joint and the second branch joint connected together through a second flow controller;

the second branch joint connected to the first main pipe through a fourth flow controller;

a bypass pipe which has one end connected to the second branch joint and the other end connected to the first main pipe through a third flow controller;

a first heat exchanging portion which carries out heat exchange between the bypass pipe connecting the third flow controller to the first main pipe, and the pipe connecting the second main pipe to the second flow controller;

a junction device which includes the first branch joint, the second branch joint, the second flow controller, the third flow controller the fourth flow controller, the first heat exchanging portion and the bypass pipe, and which is interposed between the heat source device and the indoor units;

the first main pipe having a greater diameter than the second main pipe;

a switching valve arrangement which can be arranged between the first main pipe and the second main pipe in the heat source device to switch the first main pipe and the second main pipe to a low pressure side and to a high pressure side, respectively;

a heat source device bypass pipe which extends from the second main pipe on a high pressure refrigerant outlet side of the switching arrangement to the first main pipe on a low pressure refrigerant inlet side of the switching arrangement;

a sixth on off valve which is arranged in the heat source device bypass pipe to make an on off control of the heat source device bypass pipe; and control means for opening the sixth on off valve when discharge pressure of the compressor is beyond a preset first value.

The present invention also provides an air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which is connected to the other end of the indoor heat exchanger of each indoor unit through the first flow controllers;

the first branch joint and the second branch joint connected together through a second flow controller;

the second branch joint connected to the first main pipe through a fourth flow controller;

a bypass pipe which has one end connected to the second branch joint and the other end connected to the first main pipe through a third flow controller;

a first heat exchanging portion which carries out heat exchange between the bypass pipe connecting the third flow controller to the first main pipe, and the pipe connecting the second main pipe to the second flow controller;

a junction device which includes the first branch joint, the second branch joint, the second flow controller, the third flow controller the fourth flow controller, the first heat exchanging portion and the bypass pipe, and which is interposed between the heat source device and the indoor units;

the first main pipe having a greater diameter than the second main pipe;

a switching valve arrangement which can be arranged between the first main pipe and the second main pipe in the heat source device to switch the first main pipe and the second main pipe to a low pressure side and to a high pressure side, respectively;

a heat source device bypass pipe which extends from the second main pipe on a high pressure refrigerant outlet side of the switching arrangement to the first main pipe on a low pressure refrigerant inlet side of the switching arrangement;

a sixth on off valve which is arranged in the heat source device bypass pipe to make an on off control of the heat source device bypass pipe;

a fourth temperature detector for detecting a discharge gaseous refrigerant temperature of the compressor; and control means for opening the sixth on off valve when the discharge temperature of the compressor is beyond a present first value.

In drawings:

FIG. 14 is a flowchart showing the control according the third embodiment;

FIG. 20 is a flowchart showing the control according to the fourth embodiment;

FIG. 26 is a flowchart showing the control according to the fifth embodiment;

Now, the present invention will be described in detail with reference to preferred embodiments illustrated in the accompanying drawings.

EMBODIMENT 1

A first embodiment of the present invention will be described.

Figure 1:
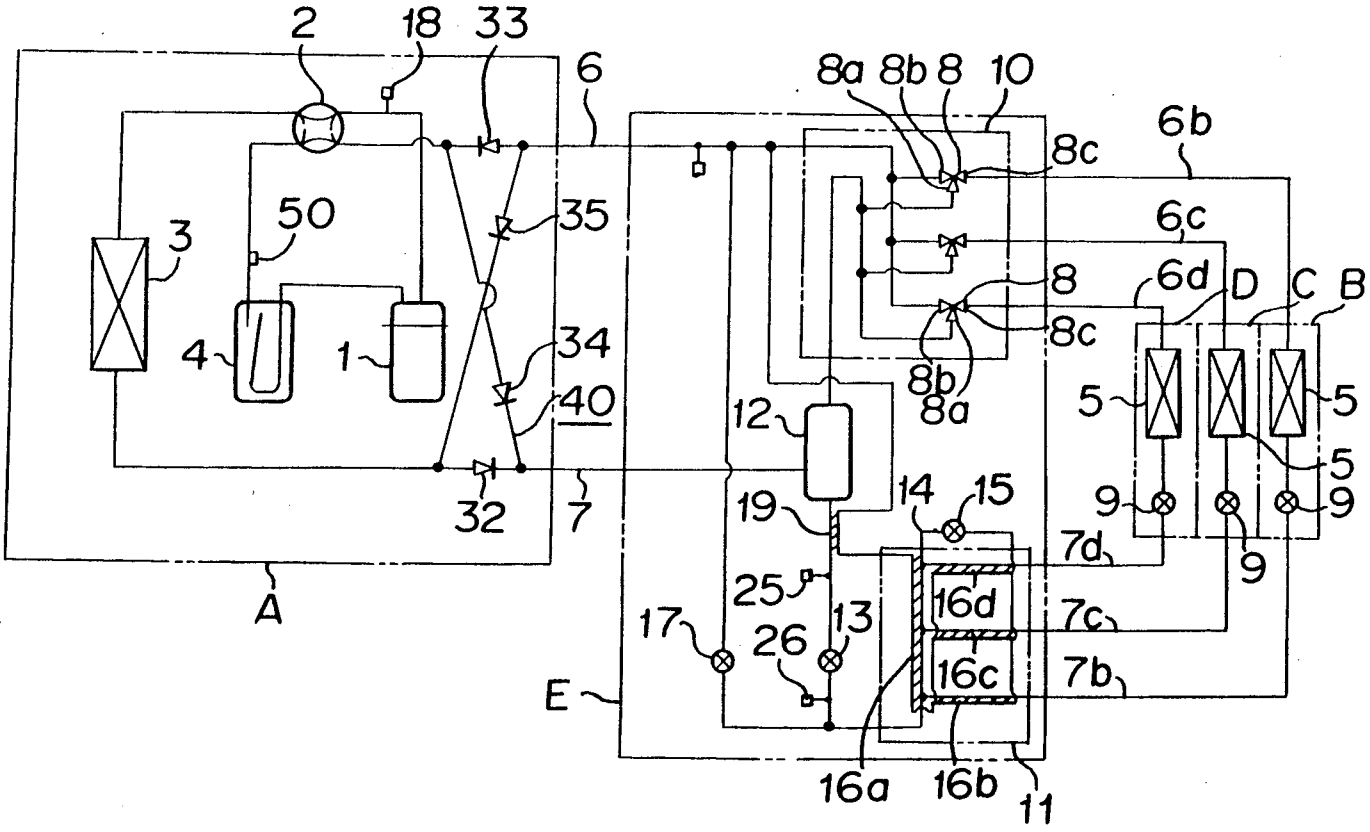
FIG. 1 is a schematic diagram of the entire structure of a first embodiment of the air conditioning apparatus according to the present invention, which is depicted on the basis of the refrigerant system of the apparatus.
Figure 2:
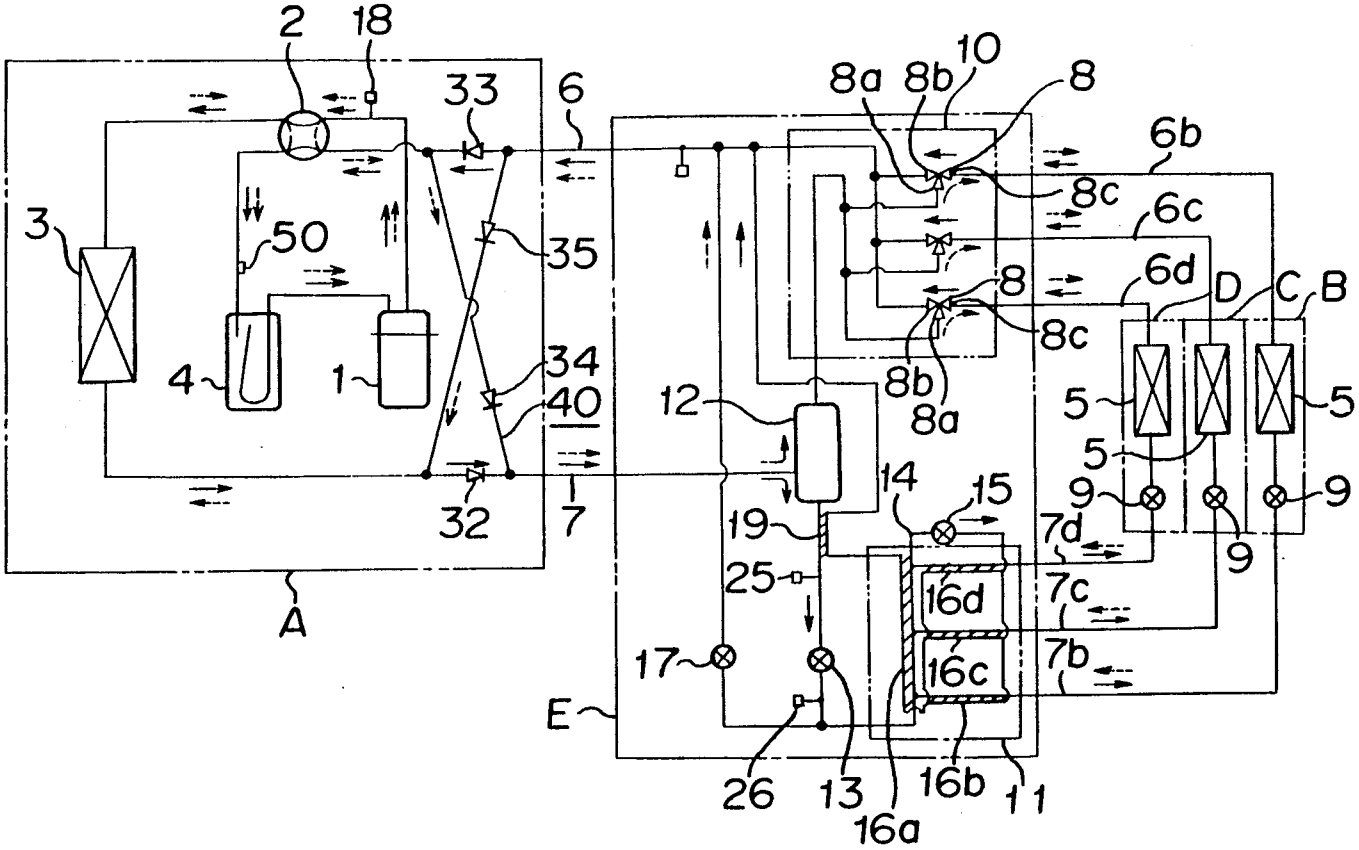
FIG. 2 is a schematic diagram showing a refrigerant circuit to help explain the operation states of the first embodiment of FIG. 1 wherein solo cooling or solo heating is performed.
Figure 3:
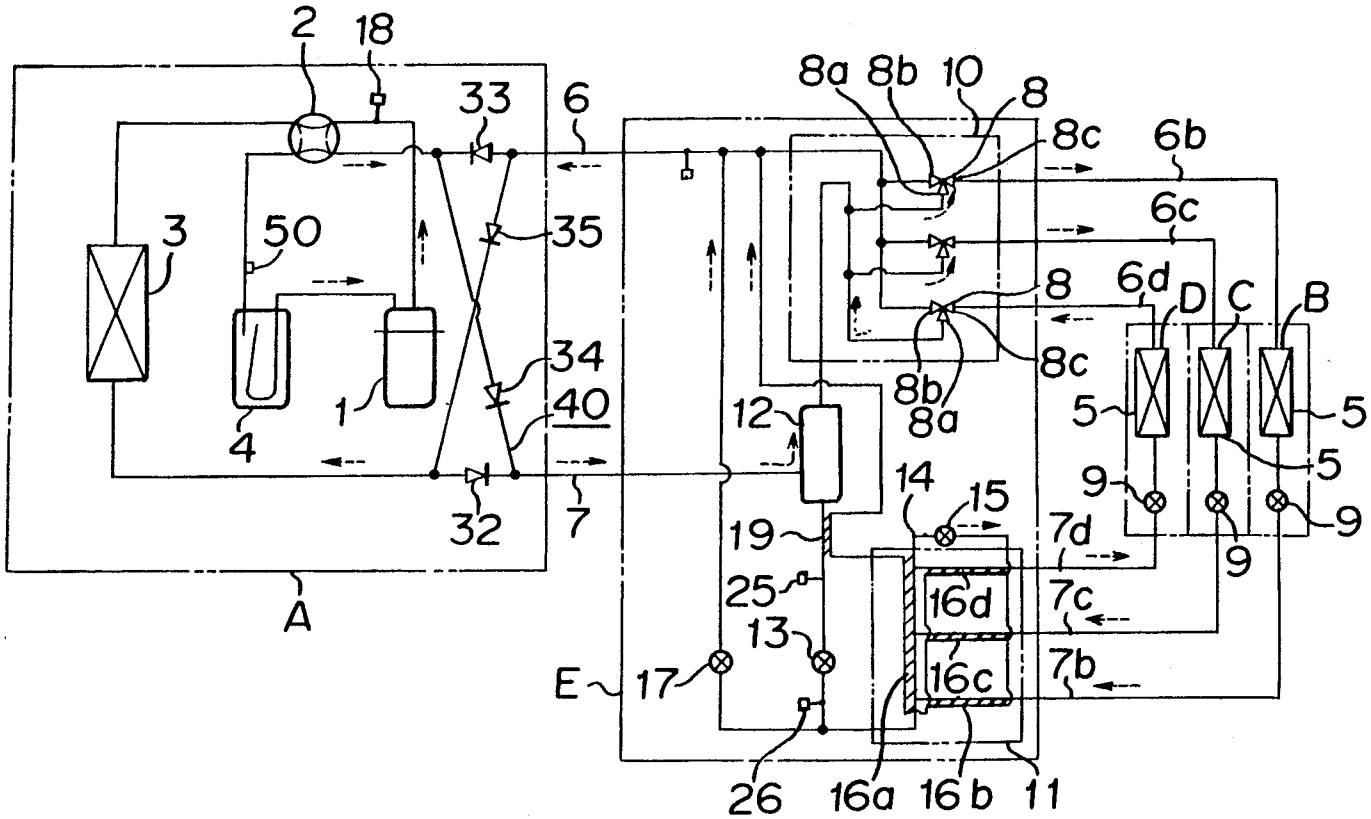
FIG. 3 is a schematic diagram showing a refrigerant circuit to help explain the operation state of the first embodiment of FIG. 1 wherein heating is principally performed under cooling and heating concurrent operation.
Figure 4:
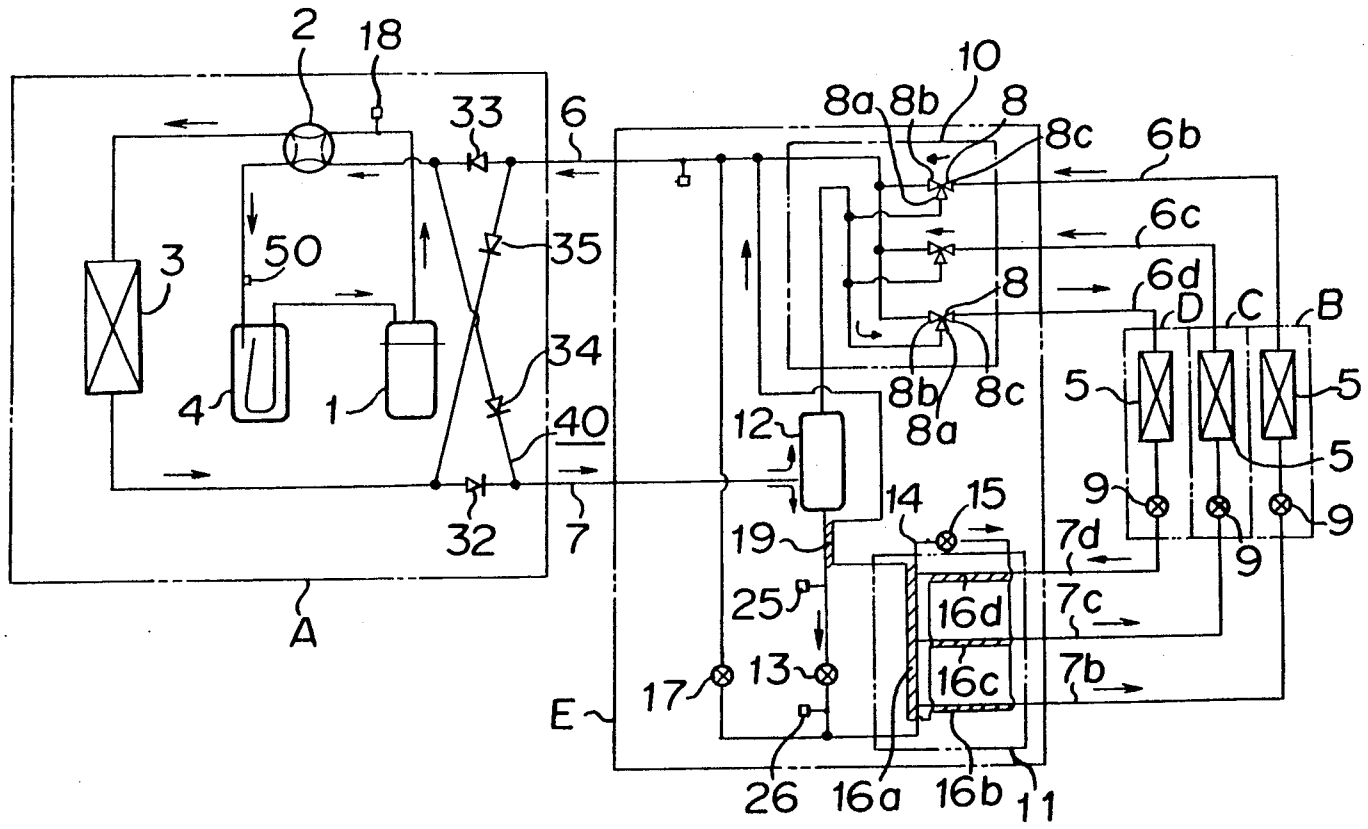
FIG. 4 is a schematic diagram showing a refrigerant circuit to help explain the operation state of the first embodiment of the FIG. 1 wherein cooling is principally performed under cooling and heating concurrent operation.

FIG. 1 is a schematic diagram of the entire structure of the first embodiment of the air conditioning apparatus according to the present invention, which is depicted on the basis of the refrigerant system of the apparatus. FIGS. 2 to 4 are schematic diagrams showing the operation states in cooling or heating in the first embodiment of FIG. 1; FIG. 2 being a schematic diagram showing the operation states wherein solo cooling or solo heating is performed; and FIG. 3 and 4 being schematic diagrams showing the operation states in cooling and heating concurrent operation, FIG. 3 being a schematic diagram showing the operation state wherein heating is principally performed under cooling and heating concurrent operation, and FIG. 4 being a schematic diagram showing the operation state wherein cooling is principally performed under cooling and heating concurrent operation.

Although explanation on the embodiment will be made in reference to the case wherein a single outdoor unit as a heat source device is connected to three indoor units, the explanation is also applicable to the case wherein the outdoor unit is connected to two or more indoor units.

Figure 11:
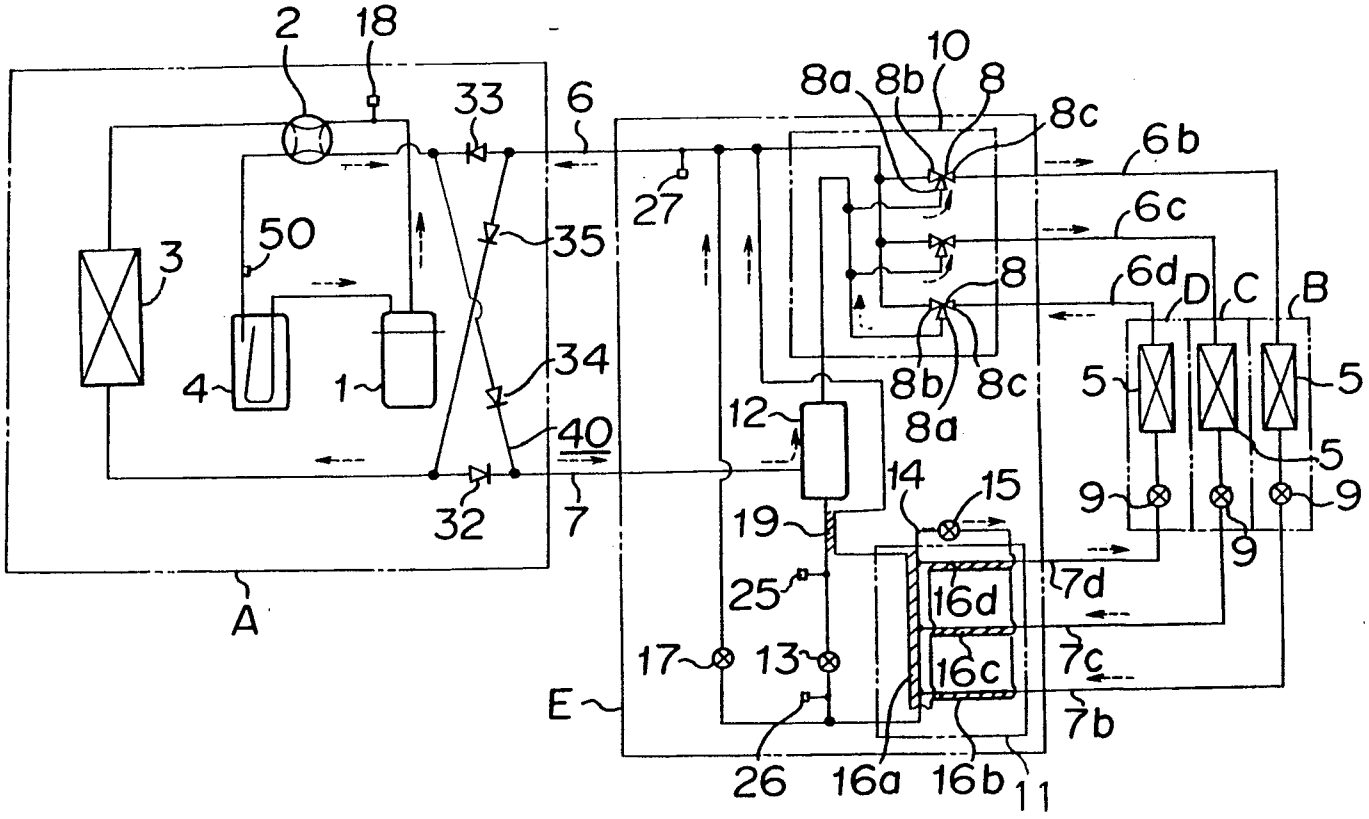
FIG. 11 is a schematic diagram showing a refrigerant circuit to help explain the operation state of the third embodiment wherein heating is principally performed under cooling and heating concurrent operation.

In FIG. 11, reference A designates an outdoor unit as a heat source device. Reference B, C and D designate indoor units which are connected in parallel as described later and have the same structure as each other. Reference E designates a junction device which includes a first branch joint 10, a second flow controller 13, a second branch joint 11, a gas-liquid separator 12, heat exchanging portions 16*a*, 16*b*, 16*c*, 16*d* and 19, a third flow controller 15, and a fourth flow controller 17, as described later.

Reference numeral 1 designates a compressor. Reference numeral 2 designates a four port reversing valve which can switch the flow direction of a refrigerant in the heat source device. Reference numeral 3 designates an outdoor heat exchanger which is installed on the side of the heat source device. Reference numeral 4 designates an accumulator which is connected to the compressor 1 through the reversing valve 2. These members constitute the heat source device A. Reference numeral 5 designates three indoor heat exchangers in the indoor units B, C and D. Reference numeral 6 designates a first main pipe which has a large diameter and which connects the four way reversing valve 2 of the heat source device A and the junction device E through a fourth check valve 33 as stated later. Reference numerals 6*b*, 6*c* and 6*d* designate first branch pipes which connect the junction device E and the indoor heat exchangers 5 of the respective indoor units B, C and D, and which correspond to the first main pipe 6. Reference numeral 7 designates a second main pipe which has a smaller diameter than the first main pipe 6, and which connects the junction device E and the outdoor heat exchanger 3 of the heat source device A through a third check valve 32 as stated later. Reference numerals 7*b*, 7*c* and 7*d* designate second branch pipes which connect the junction device E and the indoor heat exchangers 5 of the respective indoor units B, C and D through first flow controllers 9, and which correspond to the second main pipe 7. Reference numeral 8 designates three way switching valves which can selectively connect the first branch pipes 6*b*, 6*c* and 6*d* to either the first main pipe 6 or the second main pipe 7. Reference numeral 9 designates the first flow controllers which are connected to the respective indoor heat exchangers 5 in close proximity to the same, which are controlled based on degree of superheat at refrigerant outlet sides of the respective indoor heat exchangers in cooling and on degree of subcooling in heating, and which are connected to the second branch pipes 7*b*, 7*c* and 7*d*, respectively. Reference numeral 10 designates the first branch joint which includes the three way switching valves 8 which can selectively the first branch pipes 6*b*, 6*c* and 6*d* to either the first main pipe 6 or the second main pipe 7. Reference numeral 11 designates the second branch joint which includes the second branch pipes 7*b*, 7*c* and 7*d*, and the second main pipe 7. Reference numeral 12 designates the gas-liquid separator which is arranged in the second main pipe 7, and which has a gas phase zone connected to first ports 8*a* of the respective switching valves 8 and a liquid phase zone connected to the second branch joint 11. Reference numeral 13 designates the second flow controller which is connected between the gas-liquid separator 12 and the second branch joint 11, and which can be selectively opened and closed. Reference numeral 14 designates a bypass pipe which connects the second branch joint 11 to the first main pipe 6. Reference numeral 15 designates the third flow controller (shown as an electric expansion valve) which is arranged in the bypass pipe 14. Reference numeral 16*a* designates the second heat exchanging portion which is arranged in the bypass pipe 14 downstream of the third flow controller 15, and which carries out heat exchanging with a confluent portion where the second branch pipes 7*b*, 7*c* and 7*d* join in the second branch joint. Reference numerals 16*b*, 16*c* and 16*d* designate the third heat exchanging portions which are arranged in the bypass pipe 14 downstream of the third flow controller 15, and which carry out heat exchange with the respective second branch pipes 7*b*, 7*c* and 7*d* in the second branch joint 11. Reference numeral 19 designates the first heat exchanging portion which is arranged in the bypass pipe 14 downstream of the third flow controller 15 and the second heat exchanging portion 16*a*, and which carries out heat exchanging with a pipe which connects between the gas-liquid separator 12 and the second flow controller 13. Reference numeral 17 designates the fourth flow controller (shown as an electric expansion valve) which is arranged in a pipe between the second branch joint 11 and the first main pipe 6, and which can be selectively opened and closed. Reference numeral 32 designates the third check valve which is arranged between the outdoor heat exchanger 3 and the second main pipe 7, and which allows a refrigerant only to flow from the outdoor heat exchanger 3 to the second main pipe 7. Reference numeral 33 designates the fourth check valve which is arranged between the four way reversing valve 2 of the heat source device A and the first main pipe 6, and which allows the refrigerant only to flow from the first main pipe 6 to the reversing valve 2. Reference numeral 34 designates a fifth check valve which is arranged between the reversing valve 2 and the second main pipe 7, and which allows the refrigerant only to flow from the reversing valve 2 to the second main pipe 7. Reference numeral 35 designates a sixth check valve which is arranged between the outdoor heat exchanger 3 and the first main pipe 6, and which allows the refrigerant only to flow from the first main pipe 6 to the outdoor heat exchanger 3. These check valves 32–35 constitute a switching valve arrangement 40.

Reference numeral 25 designates a first pressure detector which is arranged between the first branch joint 10 and the second flow controller 13. Reference numeral 26 designates a second pressure detector which is arranged between the second flow controller 13 and the fourth flow controller 17.

Reference numeral 50 designates a low pressure saturation temperature detector which is arranged in a pipe connecting between the reversing valve 2 and the accumulator 4. Reference numeral 18 designates a fourth pressure detector which is arranged in a pipe connecting between the compressor 1 and the reversing valve 2.

The operation of the first embodiment as constructed above will be explained.

Firstly, the case wherein only cooling is performed will be explained with reference to FIG. 2.

In this case, the flow of the refrigerant is indicated by arrows of solid line. The compressor 1 has capacity controlled so that a temperature detected by the low pressure saturation temperature detector 50 achieves a predetermined value. The refrigerant gas which has discharged from the compressor 1 and had high temperature under high pressure passes through the four way reversing valve 2, and is heat exchanged and condensed in the outdoor heat exchanger 3. Then, the refrigerant passes through the third check valve 32, the second main pipe 7, the separator 12 and the second flow controller 13 in that order. The refrigerant further passes through the second branch joint 11 and the second branch pipes 7*b*, 7*c* and 7*d*, and enters the indoor units B, C and D. The refrigerant which has entered the indoor units B, C and D is depressurized to low pressure by the first flow controllers 9 which are controlled based on degree of superheat at the outlets of the respective indoor heat exchanger 5. In the indoor heat exchangers 5, the refrigerant thus depressurized carries out heat exchanging with indoor air to be evaporated and gasified, thereby cooling the rooms. The refrigerant so gasified passes through the first branch pipes 6*b*, 6*c* and 6*d*, the three way switching valves 8, and the first branch joint 10. Then the refrigerant is inspired into the compressor 1 through the first main pipe 6, the fourth check valve 33, the four way reversing valve 2 in the heat source device A, and the accumulator 4. In this way, a circulation cycle is formed to carry out room cooling. At this mode, the three way switching valves 8 have the first ports 8*a* closed, and second ports 8*b* and third ports 8*c* opened. At the time, the first main pipe 6 is at low pressure in it, and the second main pipe 7 is at high pressure in it, which necessarily make the third check valve 32 and the fourth check valve 33 to conduct for the refrigerant. In addition, in this mode, the refrigerant, which has passed through the second flow controller 13, partly enters the bypass pipe 14 where the entered part of the refrigerant is depressurized to low pressure by the third flow controller 15. The refrigerant thus depressurized carries out heat exchanging with the second branch pipes 7*b*, 7*c* and 7*d* at the third heat exchanging portions 16*b* 16*c* and 16*d*, with the confluent portion of the second branch pipes 7*b*, 7*c* and 7*d* at the second heat exchanging portion 16*a* in the second branch joint 11, and at the first heat exchanging portion 19 with the refrigerant which flows into the second flow controller 13. The refrigerant is evaporated due to such heat exchanging, and enters the first main pipe 6 and the fourth check valve 33. Then the refrigerant is inspired into the compressor 1 through the first four way reversing valve 2 and the accumulator 4.

On the other hand, the refrigerant, which has heat exchanged at the first heat exchanging portion 19, the second heat exchanging portion 16*a*, and the third heat exchanging portions 16*b*, 16*c* and 16*d*, and has been cooled so as to get sufficient subcooling, enters the indoor units B, C and D which are expected to carry out cooling.

Secondly, the case wherein only heating is performed will be described with reference FIG. 2. In this case, the flow of the refrigerant is indicated by arrows of dotted line. The compression 1 has capacity controlled so that a pressure detected by the fourth pressure detector 18 achieves a predetermined value.

The refrigerant which has been discharged from the compressor 1 and been a gas having high temperature under high pressure passes through the four way reversing valve 2, the fifth check valve 34, the second main pipe 7, and the gas-liquid separator 12. Then the refrigerant passes through the first branch joint 10, the three way switching valves 8, and the first branch pipes 6*b*, 6*c* and 6*d* in that order. After that, the refrigerant enters the respective indoor units B, C and D where the refrigerant carries out heat exchanging with indoor air. The refrigerant is condensed to be liquefied due to such heat exchanging, thereby heating the rooms. The refrigerant thus liquefied passes through the first flow controllers 9 which are almost fully opened, being controlled based on degree of subcooling at the refrigerant outlets of the respective indoor heat exchangers 5. Then the refrigerant enters the second branch joint 11 through the second branch pipes 7*b*, 7*c* and 7*d*, and joins there. Then the joined refrigerant passes through the fourth flow controller 17. The refrigerant is depressurized by either the first flow controllers 9 or the third and fourth flow controllers 15 and 17 to take a gas liquid two phase state having low pressure. The refrigerant thus depressurized enters the outdoor heat exchanger 3 through the first main pipe 6 and the sixth check valve 35 of the heat source device A, and carries out heat exchanging to be evaporated and gasified. The refrigerant thus gasified is inspired into the compressor 1 through the four way reversing valve 2 of the heat source device A, and the accumulator 4. In this way, a circulation cycle is formed to carry out heating. In this mode, the switching valves 8 have the second ports 8*b* closed, and the first and the third ports 8*a* and 8*c* opened.

In this mode, the first main pipe 6 is at low pressure in it, and the second main pipe 7 is at high pressure in it, which necessarily causes the fifth check valve 34 and the sixth check valve 35 to conduct for the refrigerant.

At that time, the second flow controller 13 is fully closed in a normal state.

Thirdly, the case wherein heating is principally performed in cooling and heating concurrent operation will be explained with reference to FIG. 3. In FIG. 3, arrows of dotted line indicate the flow of the refrigerant. The compression 1 has capacity controlled so that a pressure detected by the fourth pressure detector 18 achieves a predetermined value. The refrigerant which has been discharged from the compressor 1, and been a gas having high temperature under high pressure passes through the four way reversing valve 2, and then reaches the junction device E through the fifth check valve 34 and the second main pipe 7. The refrigerant flows through the gas liquid separator 12. In addition, the refrigerant passes through the first branch joint 10, the three way switching valves 8, and the first branch pipes **6*b* and 6*c* in that order, and enters the indoor units B and C which are expected to carry out heating. In the indoor heat exchangers 5 of the respective indoor units B and C, the refrigerant carries out heat exchange with indoor air to be condensed and liquefied, thereby heating the rooms. The refrigerant thus condensed and liquefied passes through the first flow controllers 9 of the indoor units B and C, the first controllers 9 of the indoor units B and C being almost fully opened under control based on degree of subcooling at the refrigerant outlets of the corresponding indoor heat exchangers 5. The refrigerant is slightly depressurized by these first flow controllers 9, and flows into the second blanch joint 11. After that, a part of the refrigerant passes through the second branch pipe 7*d* of the indoor unit D which is expected to carry out cooling, and enters the indoor unit D. The refrigerant flows into the first flow controller 9 of the indoor unit D, the first flow controller 9 being controlled based on degree of superheat at the refrigerant outlet of the corresponding indoor heat exchanger 5. After the refrigerant is depressurized by this first flow controller 9, it enters the indoor heat exchanger 5, and carries out heat exchange to be evaporated and gasified, thereby cooling the room. Then the refrigerant enters the first main pipe 6 through the first branch pipe 6*d* and the three way switching valve 8** which is connected to the indoor unit D.

On the other hand, another part of refrigerant passes through the fourth flow controller 17 which is controlled so that a difference between a pressure detected by the first pressure detector 25 and a pressure detected by the second pressure detector 26 falls into a predetermined range. Then the refrigerant joins with the refrigerant which has passed the indoor unit D which is expected to carry out cooling. After that, the refrigerant thus joined passes through the first main pipe 6 having such a larger diameter, and the sixth check valve 35 of the heat source device A, and enters the outdoor exchanger 3 where the refrigerant carries out heat exchange to be evaporated and gasified. The refrigerant thus gasified is inspired into the compressor 1 through the heat source device reversing valve 2 and the accumulator 4. In this way, a circulation cycle is formed to carry out the cooling and heating concurrent operation wherein heating is principally performed. At this time, the difference between the evaporation pressure in the indoor heat exchanger 5 of the cooling indoor unit D and that of the outdoor heat exchanger 3 lessens because of switching to the first main pipe 6 having such a greater diameter. At that time, the three port switching valves 8 which are connected to the heating indoor units B and C have the second ports **8*b* closed, and the first and third ports 8*a* and 8*c* opened. The three port switching valve 8 which is connected to the cooling indoor unit D has the first port 8*a* closed, and the second port 8*b* and the third port 8*c*** opened.

In this mode, the first main pipe 6 is at low pressure in it, and the second main pipe 7 is at high pressure in it, which necessarily causes the fifth check valve 34 and the sixth check valve 35 to conduct for the refrigerant. At this circulation cycle, the remaining part of the liquefied refrigerant goes into the bypass pipe 14 from the confluent portion of the second branch joint 11 where the second branch pipes **7*b*, 7*c* and 7*d* join together. The refrigerant which has gone into the bypass pipe 14 is depressurized to low pressure by the third flow controller 15. The refrigerant thus depressurized carries out heat exchange with the refrigerant in the second branch pipes 7*b*, 7*c* and 7*d* at the third heat exchanging portions 16*b*, 16*c* and 16*d*, with the refrigerant in the confluent portion of the second branch pipes 7*b*, 7*c* and 7*d* in the second branch joint 11 at the second heat exchanging portion 16*a*, and at the first heat exchanging portion 19 with the pipe on the refrigerant inlet side of the second flow controller 13. The refrigerant is evaporated by such heat exchange, and enters the first main pipe 6. After that, the refrigerant flows into the sixth check valve 35 and then into the outdoor heat exchanger 3 where it performs heat exchange to be evaporated and gasified. The refrigerant thus gasified is inspired into the compressor 1 through the first four way reversing valve 2 and the accumulator 4**.

On the other hand, the refrigerant in the second branch joint 11 which has carried out heat exchange and cooled at the first heat exchanging portion 19, the second heat exchanging portion **16*a*, and the third heat exchanging portions 16*b*, 16*c* and 16*d*** to obtain sufficient subcooling flows into the indoor unit D which is expected to cool the room.

At that time, the second flow controller 13 is fully closed in a normal state.

Fourthly, the case wherein cooling is principally performed in cooling and heating concurrent operation will be described with reference to FIG. 4.

In FIG. 4, arrows of solid lines indicate the flow of the refrigerant. The compressor 1 has capacity controlled so that a temperature detected by the low pressure saturation temperature detector 50 achieves a predetermined value. The refrigerant which has been discharged from the compressor 1 and been a gas having high temperature under high pressure flows into the outdoor heat exchanger 3 through the reversing valve 2, and carries out heat exchange with outdoor air in the outdoor heat exchanger 3 to take a gas-liquid two phase state having high temperature under high pressure. Then the refrigerant passes through the third check valve 32 and the second main pipe 7, and is forwarded to the gas-liquid separator 12 in the junction device E. The refrigerant is separated into a gaseous refrigerant and a liquid refrigerant there, and the gaseous refrigerant thus separated flows through the first branch joint 10, and the three way switching valve 8 and the first branch pipe **6*d* which are connected to the indoor unit D, in that order, the indoor unit D being expected to heat the room with the indoor unit D installed in it. The refrigerant flows into the indoor unit D, and carries out heat exchange with indoor air to be condensed and liquefied, thereby heating the room. In addition, the refrigerant passes through the first flow controller 9** connected to the heating indoor unit D, this first flow controller 9 being almost fully opened under control based on degree of subcooling at the refrigerant outlet of the indoor heat exchanger 5 of the heating indoor unit D. The refrigerant is slightly depressurized by this first flow controller 9, and flows into the second branch joint 11. On the other hand, the remaining liquid refrigerant enters the second branch joint 11 through the second flow controller 13 which is controlled based on pressures detected by the first pressure detector 25 and the second pressure detector 26. Then the refrigerant joins there with the refrigerant which has passed through the heating indoor unit D. The refrigerant thus joined passes through the second branch joint 11, and then the second branch pipes 7*b* and 7*c*, respectively, and enters the respective indoor units B and C. The refrigerant which has flowed into the indoor units B and C is depressurized to low pressure by the first flow controllers 9 of the indoor units B and C, these first flow controllers 9 being controlled based on degree of superheat at the refrigerant outlets of the corresponding indoor heat exchangers 5. Then the refrigerant flows into the indoor heat exchangers 5, and carries out heat exchange with indoor air to be evaporated and gasified, thereby cooling the rooms. In addition, the refrigerant thus gasified passes through the first branch pipes 6*b* and 6*c*, the three way switching valves 8, and the first branch joint 10. Then the refrigerant is inspired into compressor 1 through the first main pipe 6, the fourth check valve 33, the four way reversing valve 2 in the heat source device A, and the accumulator 4. In this way, a circulation cycle is formed to carry out the cooling and heating concurrent operation wherein cooling is principally performed. In this mode, the three way switching valves 8 which are connected to the indoor units B and C have the first ports 8*a* closed, and the second and third ports 8*b* and 8*c* opened. The three way switching valve 8 which is connected to the indoor unit D has the second port 8*b* closed, and the first and third ports 8*a* and 8*c* opened.

At that time, the first main pipe 6 is at low pressure in it, and the second main pipe 7 is a high pressure in it, which necessarily causes the third check valve 32 and the fourth check valve 33 to conduct for the refrigerant.

In this circulation cycle, the liquid refrigerant partly enters the bypass pipe 14 from the confluent portion of the second branch joint 11 where the second branch pipes 7*b*, 7*c* and 7*d* join together. The liquid refrigerant which has entered into the bypass pipe 14 is depressurized to low pressure by the third flow controller 15. The refrigerant thus depressurized carried out heat exchange with the refrigerant in the second branch pipes 7*b*, 7*c* and 7*d* at the third heat exchanging portions 16*b*, 16*c* and 16*d*, and at the second heat exchanging portion 16*a* with the refrigerant in the confluent portion of the second branch pipes 7*b*, 7*c* and 7*d* in the second branch joint 11, and at the first heat exchanging portion 19 with the refrigerant which flows into the second flow controller 13. The refrigerant is evaporated by such heat exchange, and enters the first main pipe 6. The refrigerant which has entered the first main pipe 6 is inspired into the compressor 1 through the fourth check valve 33, the four way reversing valve 2 in the heat source device A, and the accumulator 4.

On the other hand, the refrigerant in the second branch joint 11 which has carried out heat exchange and cooled at the first heat exchanging portion 19, the second heat exchanging portion 16*a*, and the third heat exchanging portions 16*b*, 16*c* and 16*d* to obtain sufficient subcool flows into the indoor units B and C which are expected to carry out cooling.

Figure 5:
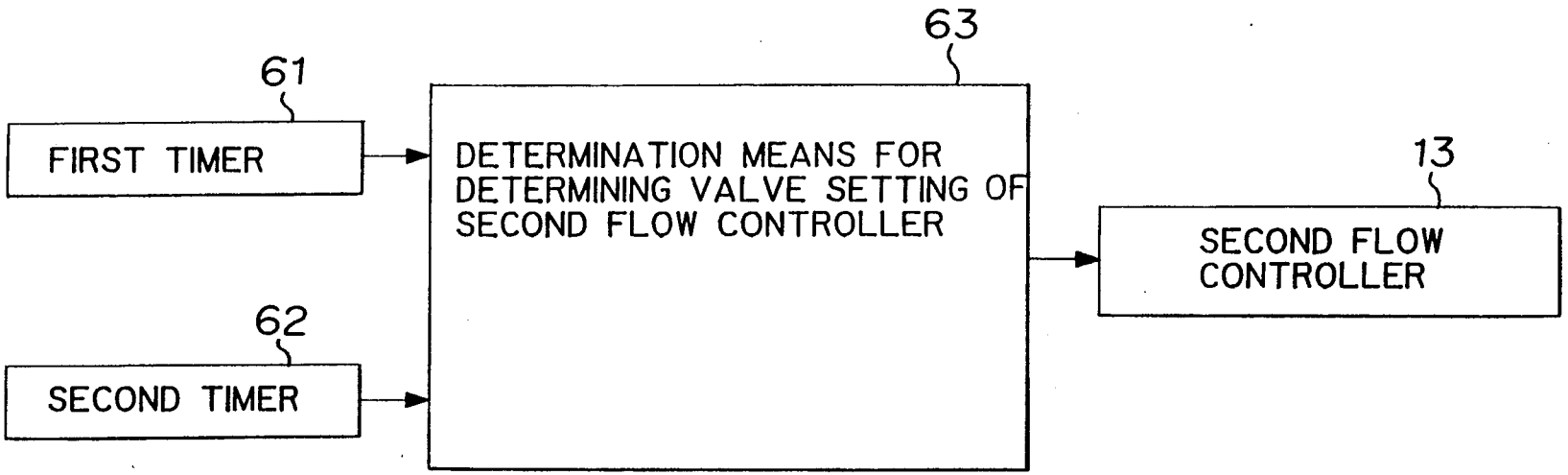
FIG. 5 is a block diagram showing oil recovery in the apparatus according to the first embodiment.
Figure 6:
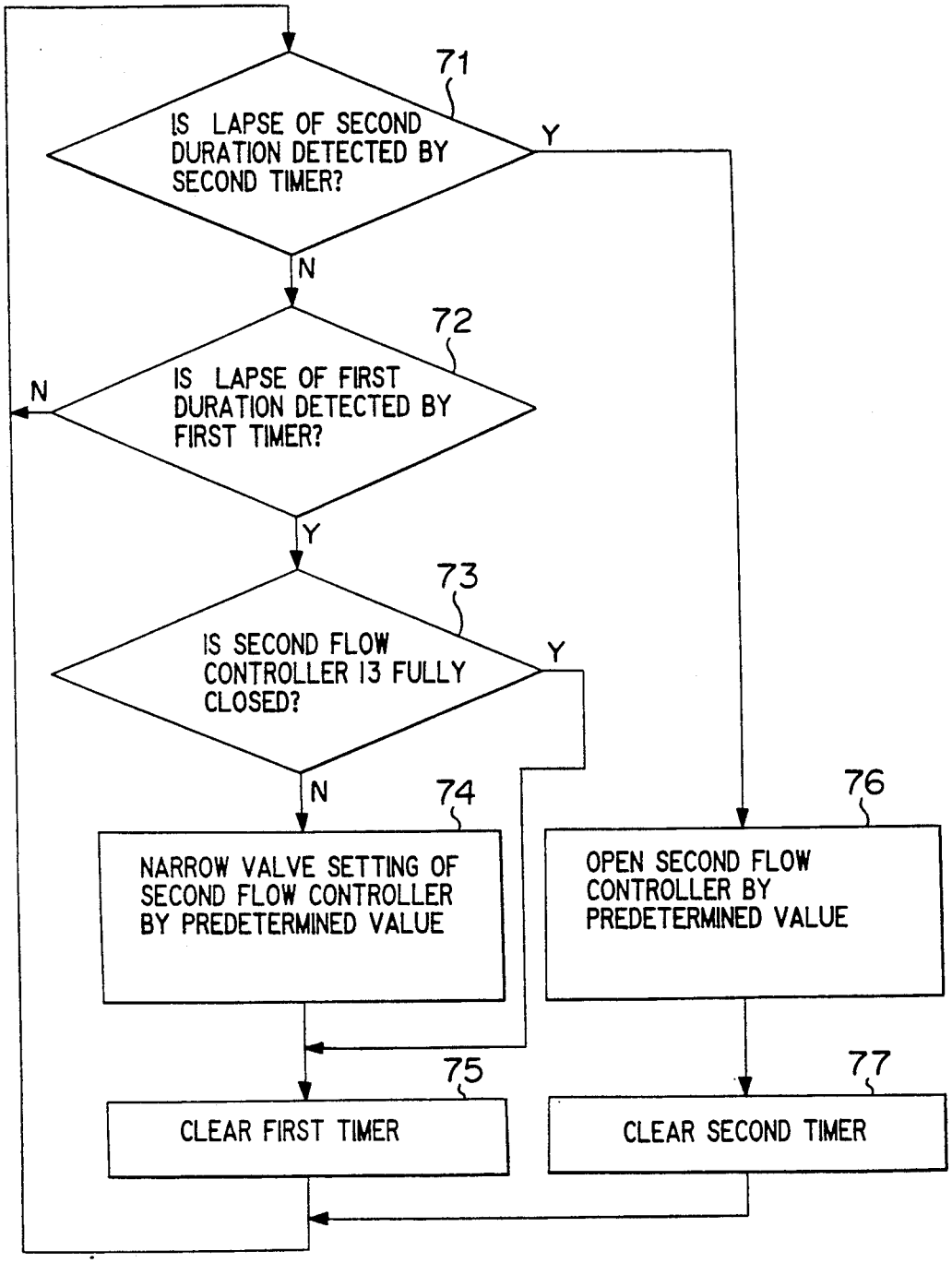
FIG. 6 is a flowchart showing the oil recovery.
Figure 7:
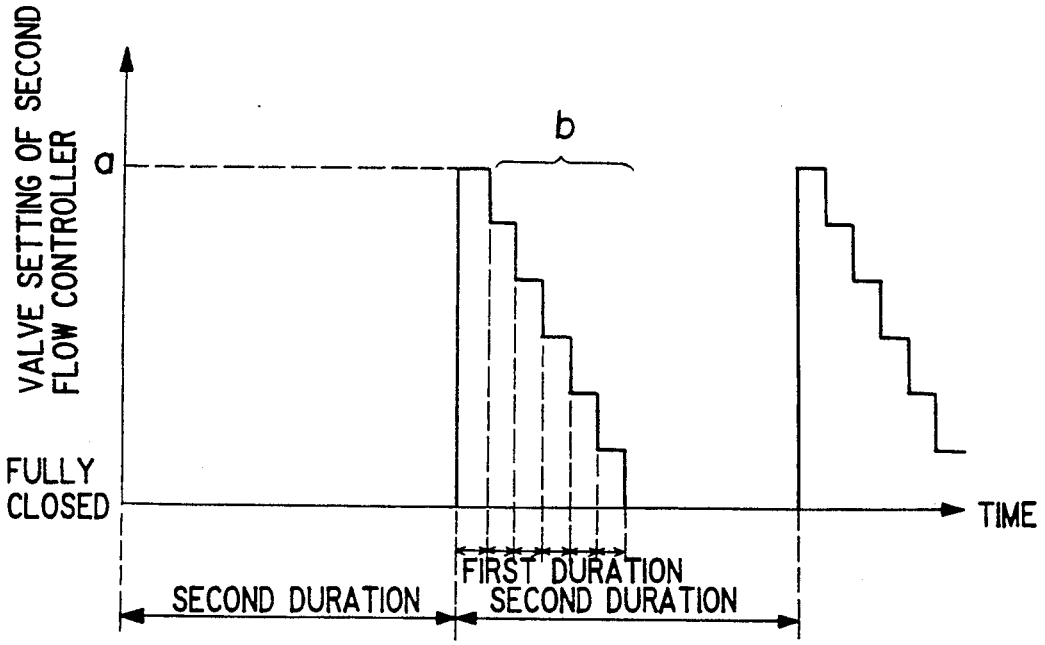
FIG. 7 is a graph showing a change in the valve setting of a second flow controller for oil recovery in the first embodiment.

Now, the oil recovery according to the first embodiment wherein the second flow controller 13 is normally fully closed in only heating, or in cooling and heating concurrent operation with heating principally performed will be explained, referring to FIGS. 5–7. FIG. 5 is a block diagram showing the oil recovery according to the first embodiment, FIG. 6 is a flowchart showing the oil recovery according to the first embodiment, and the FIG. 7 is a graph showing a change in the valve setting of the second flow controller 13.

In FIG. 5, reference numeral 61 designates a first timer which measures a duration that has lapsed since the previous control was made, thereby periodically carrying out the valve setting control of the second flow controller 13 at a first cycle. The first timer is cleared whenever the compressor 1 starts working or the valve setting control of the second flow controller 13 is made. Reference numeral 62 designates a second timer which measures an operating duration of the compressor 1, and which is cleared whenever the compressor 1 starts working or a second cycle which is longer than the first cycle has lapsed. Reference numeral 63 designates determination means for gradually narrowing the valve setting of the second flow controller by a predetermined value at a time based on outputs from the first timer 1, and for returning the valve setting of the second flow controller to its initial setting based on an output from the second timer.

A control flow for the oil recovery will be explained, referring to FIGS. 6 and 7.

At Step 71, the second timer 62 determines whether a predetermined second duration as the second cycle, or longer has lapsed or not. If affirmative, the program proceeds to Step 76. If negative, the program proceeds to Step 72.

At Step 76, the valve setting of the second flow controller 13 is opened by a predetermined value to be returned to its initial value as indicated by a point a in FIG. 7. At the next Step 77, the time data in the second timer 62 is cleared, and the program returns to Step 71.

At Step 72, the first timer 61 determines whether a predetermined first duration as the first cycle, or longer, has lapsed or not. The first duration is shorter than the second duration. If affirmative, the program proceeds to Step 73. If negative, the program returns to Step 71.

At Step 73, it is determined whether the second flow controller 13 is fully closed or not. If affirmative, the program proceeds to Step 75. If negative, the program proceeds to Step 74.

At Step 74, the valve setting of the second flow controller 13 is gradually narrowed by the predetermined value which is shorter than the predetermined value at Step 76, as indicated by a part b in FIG. 7. Then, the program proceeds to Step 75.

At Step 75, the time data in the first timer 61 is cleared, and the program returns to Step 71.

In accordance with the first embodiment, the lubricating oil which has flowed from the second main pipe during operation of the compressor, and stayed at the inlet side of the second flow controller because of small valve setting of the second flow controller can be returned from the third flow controller or the cooling indoor unit through the first main pipe by regularly enlarging the valve setting of the second flow controller.

In the case of only heating, or cooling and heating concurrent operation with heating principally performed, a control wherein the minimum valve setting is determined and the second flow controller 13 is always slightly opened to be prevent from being fully closed can be adopted to prevent the lubricating oil of the compressor from staying at the inlet side of the second flow controller 13. Such a control is also effective. In accordance with this control, the lubricating oil of the compressor can be returned from the third flow controller or the cooling indoor unit to the compressor through the first main pipe. Although this control involves a minor problem in that heating capacity slightly deteriorates in a steady manner because the refrigerant always flows through the second flow controller, the lubricating oil can be prevented from staying in the junction device, thereby avoiding seizure of the compressor.

EMBODIMENT 2

Figure 8:
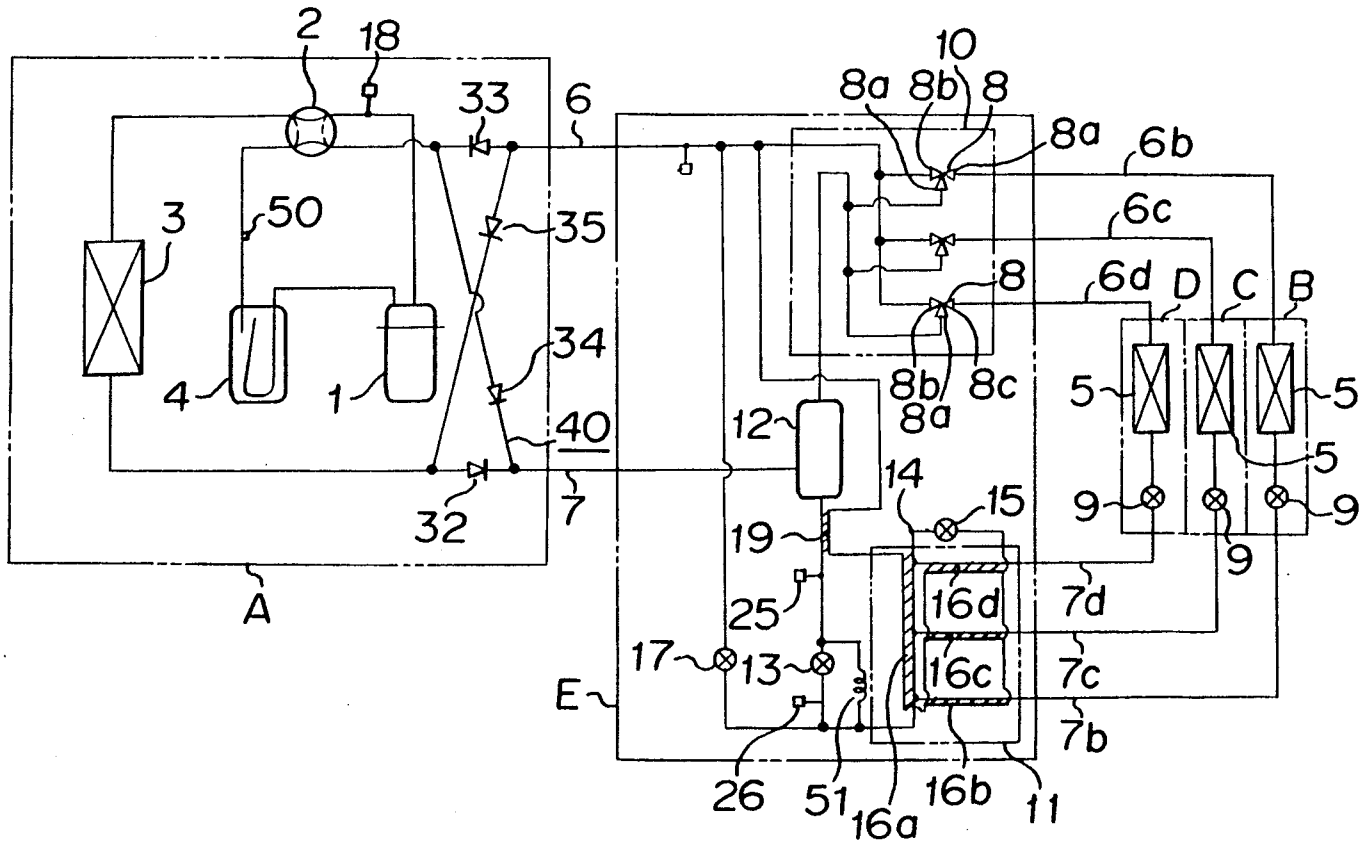
FIG. 8 is a schematic diagram showing the entire structure of a second embodiment which is depicted on the basis of the refrigerant system of the apparatus.

As shown in FIG. 8, a capillary tube 51 can be provided in parallel with the second flow controller 13 to obtain an advantage similar to the provision of the minimum valve setting in the second flow controller 13.

The provision of the capillary tube in parallel with the second flow controller can ensure the passage of the lubricating oil for the compressor during operation of the compressor even if the second flow controller is fully closed. As a result, the lubricating oil can be prevented from staying at the inlet side of the second flow controller, and the lubricating oil can be returned from the third flow controller or the cooling indoor unit through the first main pipe.

EMBODIMENT 3

A third embodiment of the present invention will be described.

Figure 9:
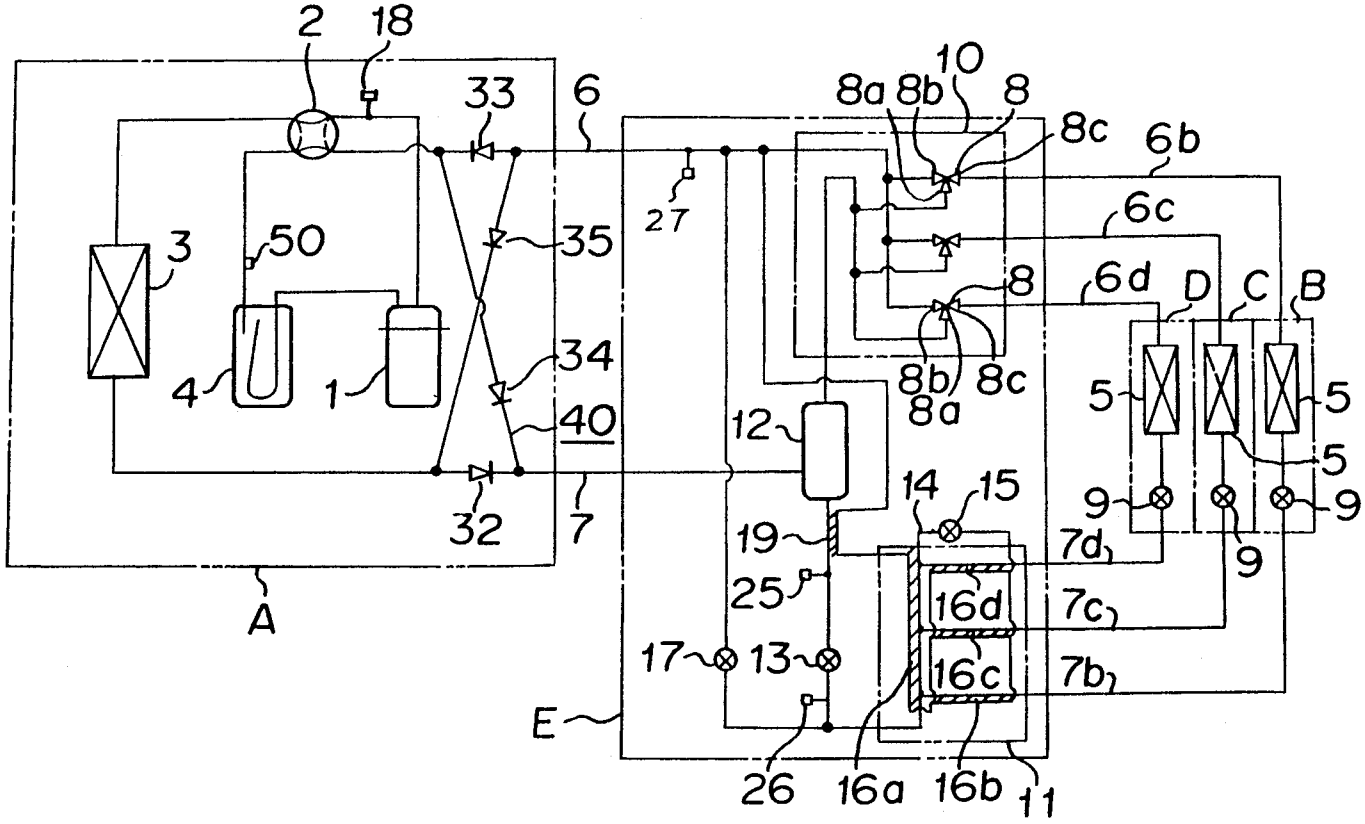
FIG. 9 is a schematic diagram of the entire structure of a third embodiment of the air conditioning apparatus according to the present invention, which is depicted on the basis of the refrigerant system of the apparatus.
Figure 10:
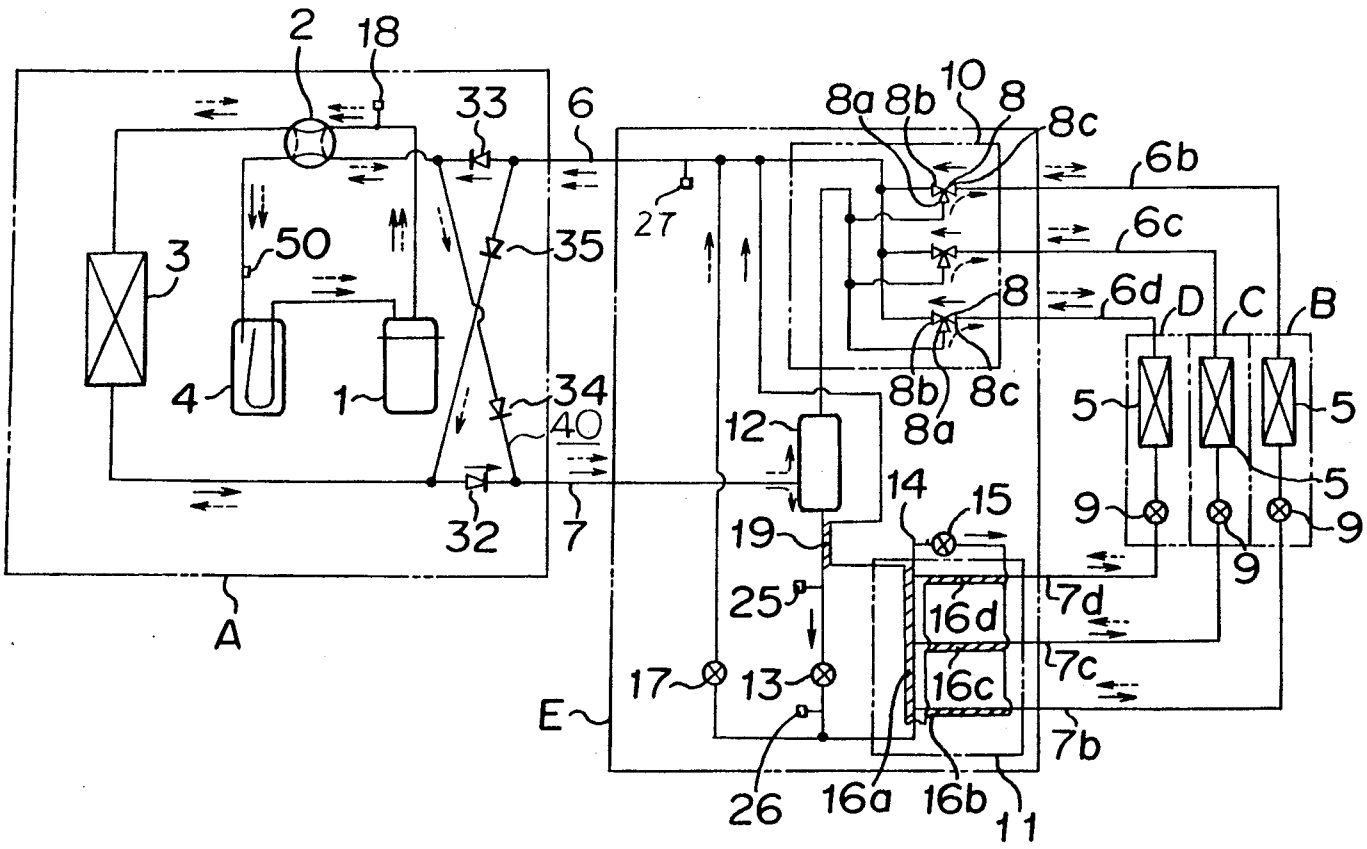
FIG. 10 is a schematic diagram showing a refrigerant circuit to help explain the operation states of the third embodiment wherein solo cooling or solo heating is performed.
Figure 12:
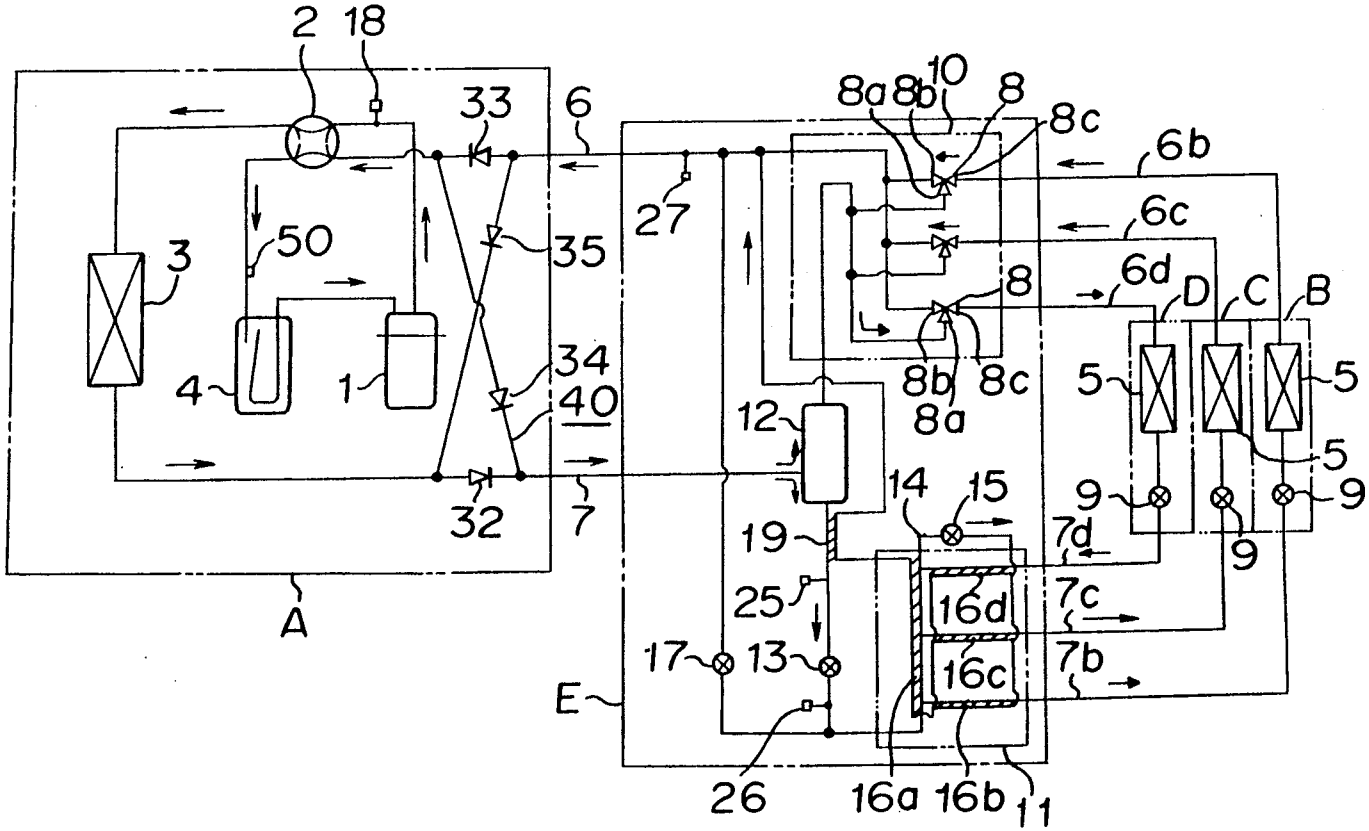
FIG. 12 is a schematic diagram showing a refrigerant circuit to help explain the operation state of the third embodiment wherein cooling is principally performed under cooling and heating concurrent operation.

FIG. 9 is a schematic diagram of the entire structure of the third embodiment of the air conditioning apparatus according to the present invention, which is depicted on the basis of the refrigerant system of the apparatus. FIGS. 10 to 12 are schematic diagrams showing the operation states in cooling or heating in the third embodiment of FIG. 9; FIG. 10 being a schematic diagram showing the operation states wherein solo cooling or solo heating are performed; and FIGS. 11 and 12 being schematic diagrams showing the operation states in cooling and heating concurrent operation, FIG. 11 being a schematic diagram showing the operation state wherein heating is principally performed under cooling and heating concurrent operation (heating load is greater than cooling load), and FIG. 12 being a schematic diagram showing the operation state wherein cooling is principally performed under cooling and heating concurrent operation (cooling load is greater than heating load).

Although explanation on the embodiment will be made in reference to the case wherein a single outdoor unit as a heat source device is connected to three indoor units, the explanation is also applicable to the case wherein the outdoor unit is connected to two or more indoor units.

In FIG. 9, reference A designates an outdoor unit as a heat source device. Reference B, C and D designate indoor units which are connected in parallel as described later and have the same structure as each other. Reference E designates a junction device which includes a first branch joint 10, a second flow controller 13, a second branch joint 11, a gas-liquid separator 12, heat exchanging portions 16*a*, 16*b*, 16*c*, 16*d* and 19, a third flow controller 15, and a fourth flow controller 17, as described later.

Reference numeral 1 designates a compressor. Reference numeral 2 designates a four port reversing valve which can switch the flow direction of a refrigerant in the heat source device. Reference numeral 3 designates an outdoor heat exchanger which is installed on the side of the heat source device. Reference numeral 4 designates an accumulator which is connected to the compressor 1 through the reversing valve 2. These devices constitute the heat source device A. Reference numeral 5 designates three indoor heat exchangers in the indoor units B, C and D. Reference numeral 6 designates a first main pipe which has a large diameter and which connects the four way reversing valve 2 of the heat source device A and the junction device E through a fourth check valve 33 as stated later. Reference numerals 6*b*, 6*c* and 6*d* designate first branch pipes which connect the junction device E and the indoor heat exchangers 5 of the respective indoor units B, C and D, and which correspond to the first main pipe 6. Reference numeral 7 designates a second main pipe which has a smaller diameter than the first main pipe 6, and which connects the junction device E and the outdoor heat exchanger 3 of the heat source device A through a third check valve 32 as stated later. Reference numerals 7*b*, 7*c* and 7*d* designate second branch pipes which connect the junction device E and the indoor heat exchangers 5 of the respective indoor units B, C and D through first flow controllers 9, and which correspond to the second main pipe 7. Reference numeral 8 designates three way switching valves which can selectively connect the first branch pipes 6*b*, 6*c* and 6*d* to either the first main pipe 6 or the second main pipe 7. Reference numeral 9 designates the first flow controllers which are connected to the respective indoor heat exchangers 5 in close proximity to the same, which are controlled based on degree of superheat at refrigerant outlet sides of the respective indoor heat exchangers in cooling and on degree of subcooling in heating, and which are connected to the second branch pipes 7*b*, 7*c* and 7*d*, respectively. Reference numeral 10 designates the first branch joint which includes the three way switching valves 8 which can selectively the first branch pipes 6*b*, 6*c* and 6*d* to either the first main pipe 6 or the second main pipe 7. Reference numeral 11 designates the second branch joint which includes the second branch pipes 7*b*, 7*c* and 7*d*, and the second main pipe 7. Reference numeral 12 designates the gas-liquid separator which is arranged in the second main pipe 7, and which has a gas phase zone connected to first ports 8*a* of the respective switching valves 8 and a liquid phase zone connected to the second branch joint 11. Reference numeral 13 designates the second flow controller which is connected between the gas-liquid separator 12 and the second branch joint 11, and which can be selectively opened and closed. Reference numeral 14 designates a bypass pipe which connects the second branch joint 11 to the first main pipe 6. Reference numeral 15 designates the third flow controller (shown as an electric expansion valve) which is arranged in the bypass pipe 14. Reference numeral 16*a* designates the second heat exchanging portion which is arranged in the bypass pipe 14 downstream of the third flow controller 15, and which carries out heat exchanging with a confluent portion where the second branch pipes 7*b*, 7*c* and 7*d* join in the second branch joint. Reference numerals 16*b*, 16*c* and 16*d* designate the third heat exchanging portions which are arranged in the bypass pipe 14 downstream of the third flow controller 15, and which carry out heat exchange with the respective second branch pipes 7*b*, 7*c* and 7*d* in the second branch joint 11. Reference numeral 19 designates the first heat exchanging portion which is arranged in the bypass pipe 14 downstream of the third flow controller 15 and the second heat exchanging portion 16*a*, and which carries out heat exchanging with a pipe which connects between the gas-liquid separator 12 and the second flow controller 13. Reference numeral 17 designates the fourth flow controller (shown as an electric expansion valve) which is arranged in a pipe between the second branch joint 11 and the first main pipe 6, and which can be selectively opened and closed. Reference numeral 32 designates the third check valve which is arranged between the outdoor heat exchanger 3 and the second main pipe 7, and which allows a refrigerant only to flow from the outdoor heat exchanger 3 to the second main pipe 7. Reference numeral 33 designates the fourth check valve which is arranged between the four way reversing valve 2 of the heat source device A and the first main pipe 6, and which allows the refrigerant only to flow from the first main pipe 6 to the reversing valve 2. Reference numeral 34 designates a fifth check valve which is arranged between the reversing valve 2 and the second main pipe 7, and which allows the refrigerant only to flow from the reversing valve 2 to the second main pipe 7. Reference numeral 35 designates a sixth check valve which is arranged between the outdoor heat exchanger 3 and the first main pipe 6, and which allows the refrigerant only to flow from the first main pipe 6 to the outdoor heat exchanger 3. These check valves 32–35 constitute a switching valve arrangement 40.

Reference numeral 25 designates a first pressure detector which is arranged between the first branch joint 10 and the second flow controller 13. Reference numeral 26 designates a second pressure detector which is arranged between the second flow controller 13 and the fourth flow controller 17. Reference numeral 27 designates a third pressure-detector which is arranged in the first main pipe 6.

Reference numeral 50 designates a low pressure saturation temperature detector which is arranged in a pipe connecting between the reversing valve 2 and the accumulator 4. Reference numeral 18 designates a fourth pressure detector which is arranged in a pipe connecting between the compressor 1 and the reversing valve 2.

The operation of the third embodiment as constructed above will be explained.

Firstly, the case wherein only cooling is performed will be explained with reference to FIG. 10.

In this case, the flow of the refrigerant is indicated by arrows of solid line. The compressor 1 has capacity controlled so that a temperature detected by the low pressure saturation temperature detector 50 achieves a predetermined value. The refrigerant gas which has discharged from the compressor 1 and had high temperature under high pressure passes through the four way reversing valve 2, and is heat exchanged and condensed in the outdoor heat exchanger 3. Then, the refrigerant passes, through the third check valve 32, the second main pipe 7, the separator 12 and the second flow controller 13 in that order. The refrigerant further passes through the second branch joint 11 and the second branch pipes 7*b*, 7*c* and 7*d*, and enters the indoor units B, C and D. The refrigerant which has entered the indoor units B, C and D is depressurized to low pressure by the first flow controllers 9 which are controlled based on degree of superheat at the outlets of the respective indoor heat exchanger 5. In the indoor heat exchangers 5, the refrigerant thus depressurized carries out heat exchanging with indoor air to be evaporated and gasified, thereby cooling the rooms. The refrigerant so gasified passes through the first branch pipes 6*b*, 6*c* and 6*d*, the three way switching valves 8, and the first branch joint 10. Then the refrigerant is inspired into the compressor 1 through the first main pipe 6, the fourth check valve 33, the four way reversing valve 2 in the heat source device A, and the accumulator 4. In this way, a circulation cycle is formed to carry out cooling. At this mode, the three way switching valves 8 have the first ports 8*a* closed, and second ports 8*b* and third ports 8*c* opened. At the time, the first main pipe 6 is at low pressure in it, and the second main pipe 7 is at high pressure in it, which necessarily make the third check valve 32 and the fourth check valve 33 to conduct for the refrigerant. In addition, in this mode, the refrigerant, which has passed through the second flow controller 13, partly enters the bypass pipe 14 where the entered part of the refrigerant is depressurized to low pressure by the third flow controller 15. The refrigerant thus depressurized carries out heat exchanging with the second branch pipes 7*b*, 7*c* and 7*d* at the third heat exchanging portions 16*b* 16*c* and 16*d*, with the confluent portion of the second branch pipes 7*b*, 7*c* and 7*d* at the second heat exchanging portion 16*a* in the second branch joint 11, and at the first heat exchanging portion 19 with the refrigerant which enters the second flow controller 13. The refrigerant is evaporated due to such heat exchanging, and enters the first main pipe 6 and the fourth check valve 33. Then the refrigerant is inspired into the compressor 1 through the first four way reversing valve 2 and the accumulator 4.

On the other hand, the refrigerant, which has heat exchanged at the first heat exchanging portion 19, the second heat exchanging portion 16*a*, and the third heat exchanging portions 16*b*, 16*c* and 16*d*, and has been cooled so as to get sufficient subcooling, enters the indoor units B, C and D which are expected to carry out cooling.

Secondly, the case wherein only heating is performed will be described with reference FIG. 10. In this case, the flow of the refrigerant is indicated by arrows of dotted line. The compressor 1 has capacity controlled so that a pressure detected by the fourth pressure detector 18 achieves a predetermined value.

The refrigerant which has been discharged from the compressor 1 and been a gas having high temperature under high pressure passes through the four way reversing valve 2, the fifth check valve 34, the second main pipe 7, and the gas-liquid separator 12. Then the refrigerant passes through the first branch joint 10, the three way switching valves 8, and the first branch pipes 6*b*, 6*c* and 6*d* in that order. After that, the refrigerant enters the respective indoor units B, C and D where the refrigerant carries out heat exchanging with indoor air. The refrigerant is condensed to be liquefied due to such heat exchanging, thereby heating the rooms. The refrigerant thus liquefied passes through the first flow controllers 9 which are almost fully opened, being controlled based on degree of subcooling at the refrigerant outlets of the respective indoor heat exchangers 5. Then the refrigerant enters the second branch joint 11 through the second branch pipes 7*b*, 7*c* and 7*d*, and joins there. Then the joined refrigerant passes through the fourth flow controller 17. The refrigerant is depressurized there, and enters the outdoor heat exchanger 3 through the first main pipe 6 and the sixth check valve 35 of the heat source device A, and carries out heat exchanging to be evaporated and gasified. The refrigerant thus gasified is inspired into the compressor 1 through the four way reversing valve 2 of the heat source device A, and the accumulator 4. In this way, a circulation cycle is formed to carry out room heating. In this mode, the switching valves 8 have the second ports 8*b* closed, and the first and the third ports 8*a* and 8*c* opened.

In this mode, the first main pipe 6 is at low pressure in it, and the second main pipe 7 is at high pressure in it, which necessarily causes the fifth check valve 34 and the sixth check valve 35 to conduct for the refrigerant.

Thirdly, the case wherein room heating is principally performed in room cooling and room heating concurrent operation will be explained with reference to FIG. 11. In FIG. 11, arrows of dotted line indicate the flow of the refrigerant. The compressor 1 has capacity controlled so that a pressure detected by the fourth pressure detector 18 achieves a predetermined value. The refrigerant which has been discharged from the compressor 1, and been a gas having high temperature under high pressure passes through the four way reversing valve 2, and then reaches the junction device E through the fifth check valve 34 and the second main pipe 7. The refrigerant flows through the gas-liquid separator 12. In addition, the refrigerant passes through the first branch joint 10, the three way switching valves 8, and the first branch pipes 6*b* and 6*c* in that order, and enters the indoor units B and C which are expected to carry out heating. In the indoor heat exchangers 5 of the respective indoor units B and C, the refrigerant carries out heat exchange with indoor air to be condensed and liquefied, thereby heating the rooms. The refrigerant thus condensed and liquefied passes through the first flow controllers 9 of the indoor units B and C, the first controllers 9 of the indoor units B and C being almost fully opened under control based on degree of subcooling at the refrigerant outlets of the corresponding indoor heat exchangers 5. The refrigerant is slightly depressurized by these first flow controllers 9, and flows into the second blanch joint 11. After that, a part of the refrigerant passes through the second branch pipe 7*d* of the indoor unit D which is expected to carry out cooling, and enters the indoor unit D. The refrigerant flows into the first flow controller 9 of the indoor unit D, the first flow controller 9 being controlled based on degree of superheat at the refrigerant outlet of the corresponding indoor heat exchanger 5. After the refrigerant is depressurized by this first flow controller 9, it enters the indoor heat exchanger 5, and carries out heat exchange to be evaporated and gasified, thereby cooling the room. Then the refrigerant enters the first main pipe 6 through the first branch pipe 6*d* and the three way switching valve 8 which is connected to the indoor unit D.

On the other hand, another part of refrigerant passes through the fourth flow controller 17 which is controlled so that a difference between a pressure detected by the first pressure detector 25 and a pressure detected by the second pressure detector 26 falls into a predetermined range. Then the refrigerant joins with the refrigerant which has passed the indoor unit D which is expected to carry out cooling. After that, the refrigerant thus joined passes through the first main pipe 6 having such a larger diameter, and the sixth check valve 35 of the heat source device A, and enters the outdoor exchanger 3 where the refrigerant carries out heat exchange to be evaporated and gasified. The refrigerant thus gasified is inspired into the compressor 1 through the heat source device reversing valve 2 and the accumulator 4. In this way, a circulation cycle is formed to carry out the cooling and heating concurrent operation wherein room heating is principally performed. At this time, the difference between the evaporation pressure in the indoor heat exchanger 5 of the cooling indoor unit D and that of the outdoor heat exchanger 3 lessens because of switching to the first main pipe 6 having such a greater diameter. At that time, the three port switching valves 8 which are connected to the heating indoor units B and C have the second ports 8*b* closed, and the first and third ports 8*a* and 8*c* opened. The three port switching valve 8 which is connected to the cooling indoor unit D has the first port 8*a* closed, and the second port 8*b* and the third port 8*c* opened.

In this mode, the first main pipe 6 is at low pressure in it, and the second main pipe 7 is at high pressure in it, which necessarily causes the fifth check valve 34 and the sixth check valve 35 to conduct for the refrigerant. At this circulation cycle, the remaining part of the liquefied refrigerant goes into the bypass pipe 14 from the confluent portion of the second branch joint 11 where the second branch pipes 7*b*, 7*c* and 7*d* join together. The refrigerant which has gone into the bypass pipe 14 is depressurized to low pressure by the third flow controller 15. The refrigerant thus depressurized carries out heat exchange with the refrigerant in the second branch pipes 7*b*, 7*c* and 7*d* at the third heat exchanging portions 16*b*, 16*c* and 16*d*, with the refrigerant in the confluent portion of the second branch pipes 7*b*, 7*c* and 7*d* in the second branch joint 11 at the second heat exchanging portion 16*a*, and at the first heat exchanging portion 19 with the refrigerant which flows from the second flow controller 13. The refrigerant is evaporated by such heat exchange, and enters the first main pipe 6. After that, the refrigerant flows into the sixth check valve 35 and then into the outdoor heat exchanger 3 where it performs heat exchange to be evaporated and gasified. The refrigerant thus gasified is inspired into the compressor 1 through the first four way reversing valve 2 and the accumulator 4.

On the other hand, the refrigerant in the second branch joint 11 which has carried out heat exchange and cooled at the first heat exchanging portion 19, the second heat exchanging portion 16*a*, and the third heat exchanging portions 16*b*, 16*c* and 16*d* to obtain sufficient subcooling flows into the indoor unit D which is expected to cool the room.

Fourthly, the case wherein cooling is principally performed in cooling and heating concurrent operation will be described with reference to FIG. 12.

In FIG. 12, arrows of solid lines indicate the flow of the refrigerant. The compressor 1 has capacity controlled so that a temperature detected by the low pressure saturation temperature detector 50 achieves a predetermined value The refrigerant which has been discharged from the compressor 1 and been a gas having high temperature under high pressure flows into the outdoor heat exchanger 3 through the reversing valve 2, and carries out heat exchange with outdoor air in the outdoor heat exchanger 3 to take a gas-liquid two phase state having high temperature under high pressure.

Then the refrigerant passes through the third check valve 32 and the second main pipe 7, and is forwarded to the gas-liquid separator 12 in the junction device E. The refrigerant is separated into a gaseous refrigerant and a liquid refrigerant there, and the gaseous refrigerant thus separated flows through the first branch joint 10, and the three way switching valve 8 and the first branch pipe 6*d* which are connected to the indoor unit D, in that order, the indoor unit D being expected to heat the room with the indoor unit D installed in it. The refrigerant flows into the indoor unit D, and carries out heat exchange with in door air to be condensed and liquefied, thereby heating the room. In addition, the refrigerant passes through the first flow controller 9 connected to the heating indoor unit D, this first flow controller 9 being almost fully opened under the control based on degree of subcooling at the refrigerant outlet of the indoor heat exchanger 5 of the heating indoor unit D. The refrigerant is slightly depressurized by this first flow controller 9, and flows into the second branch joint 11. On the other hand, the remaining liquid refrigerant enters the second branch joint 11 through the second flow controller 13 which is controlled based on pressures detected by the first pressure detector 25 and the second pressure detector 26. Then the refrigerant joins there with the refrigerant which has passed through the heating indoor unit D. The refrigerant thus joined passes through the second branch joint 11, and then the second branch pipes 7*b* and 7*c*, respectively, and enters the respective indoor units B and C. The refrigerant which has flowed into the indoor units B and C is depressurized to low pressure by the first flow controllers 9 of the indoor units B and C, these first flow controllers 9 being controlled based on degree of superheat at the refrigerant outlets of the corresponding indoor heat exchangers 5. Then the refrigerant flows into the indoor heat exchangers 5, and carries out heat exchange with indoor air to be evaporated and gasified, thereby cooling these rooms. In addition, the refrigerant thus gasified passes through the first branch pipes 6*b* and 6*c*, the three way switching valves 8, and the first branch joint 10. Then the refrigerant is inspired into compressor 1 through the first main pipe 6, the fourth check valve 33, the four way reversing valve 2 in the heat source device A, and the accumulator 4. In this way, a circulation cycle is formed to carry out the cooling and room heating concurrent operation wherein cooling is principally performed. In this mode, the three way switching valves 8 which are connected to the indoor units B and C have the first ports 8*a* closed, and the second and third ports 8*b* and 8*c* opened. The three way switching valve 8 which is connected to the indoor unit D has the second port 8*b* closed, and the first and third ports 8*a* and 8*c* opened.

At that time, the first main pipe 6 is at low pressure in it, and the second main pipe 7 is a high pressure in it, which necessarily causes the third check valve 32 and the fourth check valve 33 to conduct for the refrigerant.

In this circulation cycle, the liquid refrigerant partly enters the bypass pipe 14 from the confluent portion of the second branch joint 11 where the second branch pipes 7*b*, 7*c* and 7*d* join together. The liquid refrigerant which has entered into the bypass pipe 14 is depressurized to low pressure by the third flow controller 15. The refrigerant thus depressurized carried out heat exchange with the refrigerant in the second branch pipes 7*b*, 7*c* and 7*d* at the third heat exchanging portions 16*b*, 16*c* and 16*d*, and at the second heat exchanging portion 16*a* with the refrigerant in the confluent portion of the second branch pipes 7*b*, 7*c* and 7*d* in the second branch joint 11, and at the first heat exchanging portion 19 with the refrigerant which flows into the second flow controller 13. The refrigerant is evaporated by such heat exchange, and enters the fourth check valve 33 from the first main pipe 6. The refrigerant is inspired into the compressor 1 through the four way reversing valve 2 in the heat source device A, and the accumulator 4.

On the other hand, the refrigerant in the second branch joint 11 which has carried out heat exchange and cooled at the first heat exchanging portion 19, the second heat exchanging portion 16*a*, and the third heat exchanging portions 16*b*, 16*c* and 16*d* to obtain sufficient subcool flows into the indoor units B and C which are expected to carry out cooling.

Figure 13:
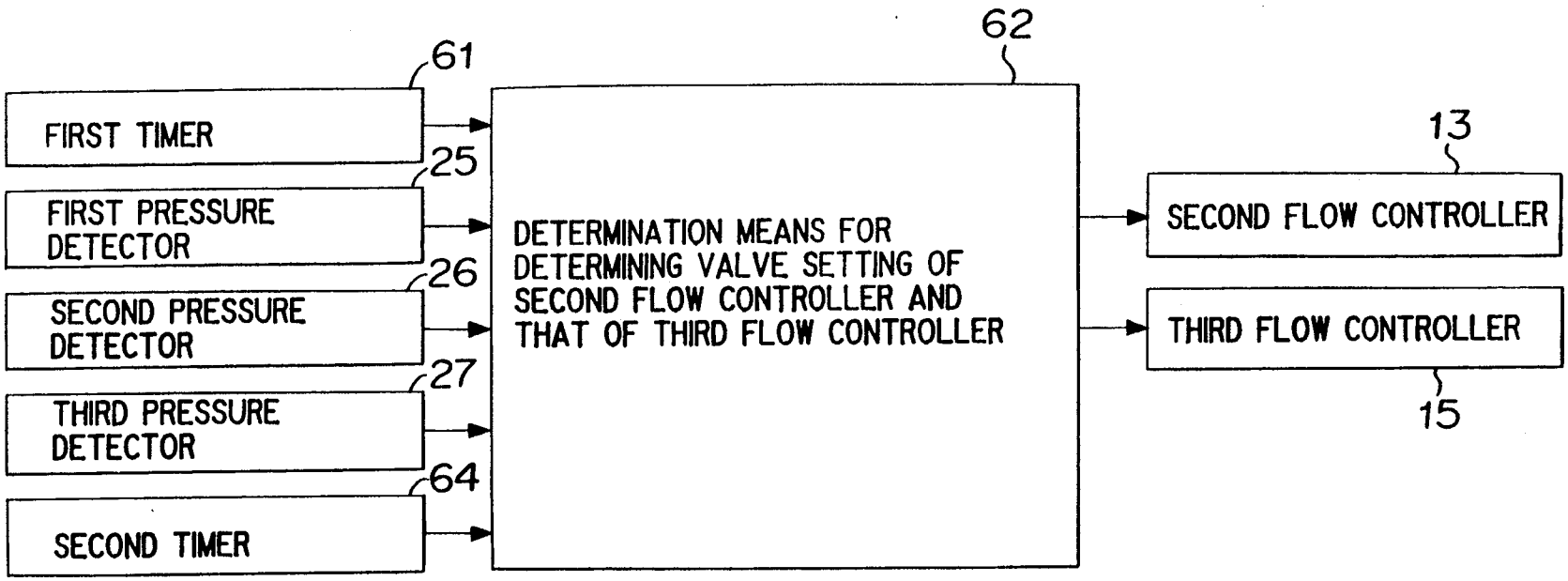
FIG. 13 is a block diagram showing a control for restraining an increase in high pressure according to the third embodiment.

Now, the control according to the third embodiment wherein a transitional increase in high pressure can be restrained will be explained, referring to FIGS. 13 and 14. FIG. 13 is a block diagram showing the control for restraining the increase in high pressure according to the third embodiment, and FIG. 14 is a flowchart showing the control for restraining the increase in high pressure in accordance with the third embodiment.

In FIG. 13, reference numeral 61 designates a first timer which measures a duration that has lapsed since the previous control was made, thereby periodically carrying out the valve setting controls of the second flow controller 13 and the third flow controller 15. The first timer is cleared whenever the compressor 1 starts working or the valve setting controls of the second flow controller 13 and the third flow controller 15 are made.

Reference numeral 62 designates determination means for determining the valve settings of the second flow controller 13 and the third flow controller 15 based on pressures detected by the first pressure detector 25, the second pressure detector 26 and the third pressure detector 27 and a signal from the first timer.

Reference numeral 64 designates a second timer which measures a duration that has lapsed since the previous control for restraining an increase in high pressure was made. The second timer is cleared whenever the compressor 1 starts working or the control is made.

A control flow for restraining an increase in high pressure will be explained, referring to FIG. 14.

At Step 71, the first pressure detector 25 determines whether the pressure detected by it is a predetermined value or higher. If affirmative, the program proceeds to Step 78. If negative, the program proceeds to Step 72.

At Step 78, the second timer 64 determines whether a predetermined duration B or more has lapsed. If negative, the program proceeds to Step 72. If affirmative, the program proceeds to Step 79.

At Step 79, the time data in the second timer 64 is cleared, and the program proceeds to Step 74. At Step 74, it is determined whether a difference between the pressure detected by the first pressure detector 25 and that detected by the second pressure detector 26 is a predetermined value C or higher. If affirmative, the program proceeds to Step 75. If negative, the program proceeds to Step 76.

At Step 75, the valve setting of the second flow controller 13 is increased by a predetermined value a, and at Step 76, the valve setting of the third flow controller 15 is increased by a predetermined value b. The program leads from Steps 75 and 76 to Step 77.

At Step 72, the first timer 61 determines whether a predetermined duration A or longer has lapsed or not. If affirmative, the program proceeds to Step 73. If negative, the program returns to Step 71. At Step 73, the valve setting of the second flow controller 13 and that of the third flow controller 15 are controlled as usual (explanation of the usual control will be omitted for the sake of simplicity). Then the program proceeds to Step 77.

At Step 77, the time data in the first timer 61 is cleared, and the program returns to Step 71.

As explained, in accordance with the third embodiment, when the high pressure is transitionally raised due to a change in the number of operating indoor units during operation of the compressor, the bypass conduit which extends from the second main pipe to the first main pipe through the second and third flow controllers in the junction device can be enlarged while keeping a differential pressure applied to the second flow controller at almost a target value by increasing the valve setting of the second and third flow controllers depending on a differential pressure applied to the second flow controller in such a manner that, based on the values detected by the first and second pressure detectors, when the differential pressure is great, the valve setting of the second flow controller is increased, and when the differential pressure is small, the valve setting of the third flow controller is increased. As a result, a pressure loss in passage can be decreased to facilitate the flow of the refrigerant, and the high pressure can be lowered to continue operation without stoppage.

EMBODIMENT 4

A fourth embodiment of the present invention will be described.

Figure 15:
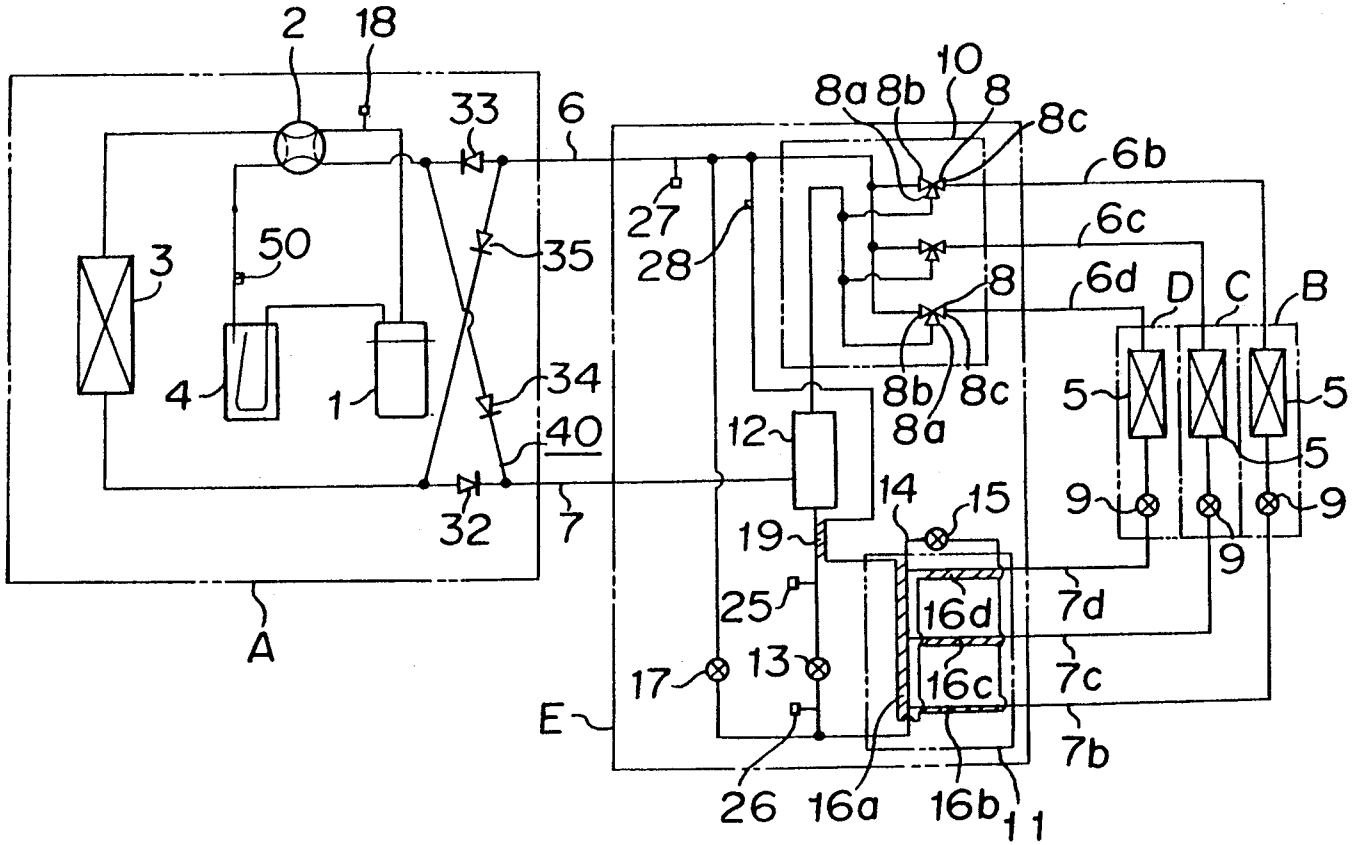
FIG. 15 is a schematic diagram of the entire structure of a fourth embodiment of the air conditioning apparatus according to the present invention, which is depicted on the basis of the refrigerant system of the apparatus.
Figure 16:
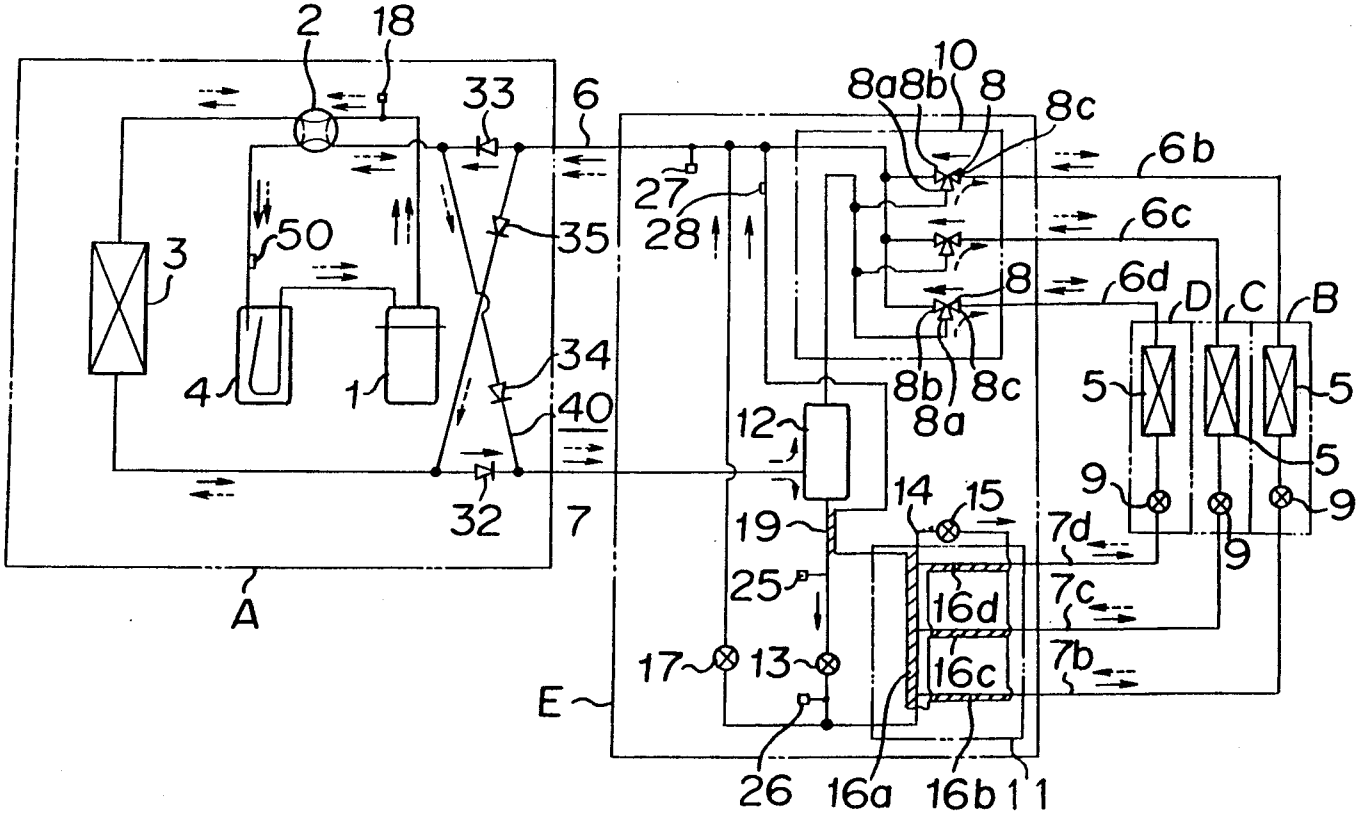
FIG. 16 is a schematic diagram showing a refrigerant circuit to help explain the operation states of the fourth embodiment wherein solo cooling or solo heating is performed.
Figure 17:
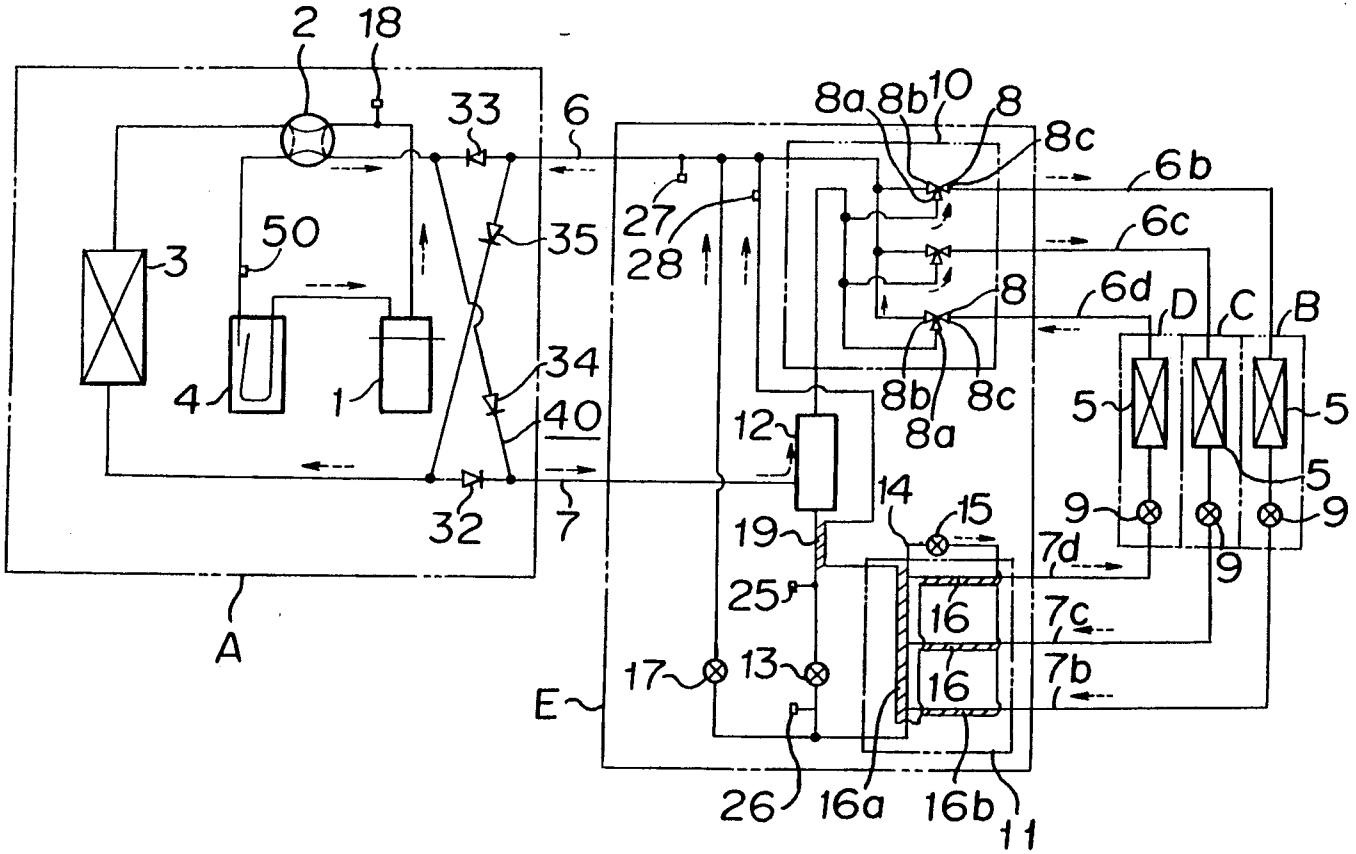
FIG. 17 is a schematic diagram showing a refrigerant circuit to help explain the operation state of the fourth embodiment wherein heating is principally performed under cooling and heating concurrent operation.
Figure 18:
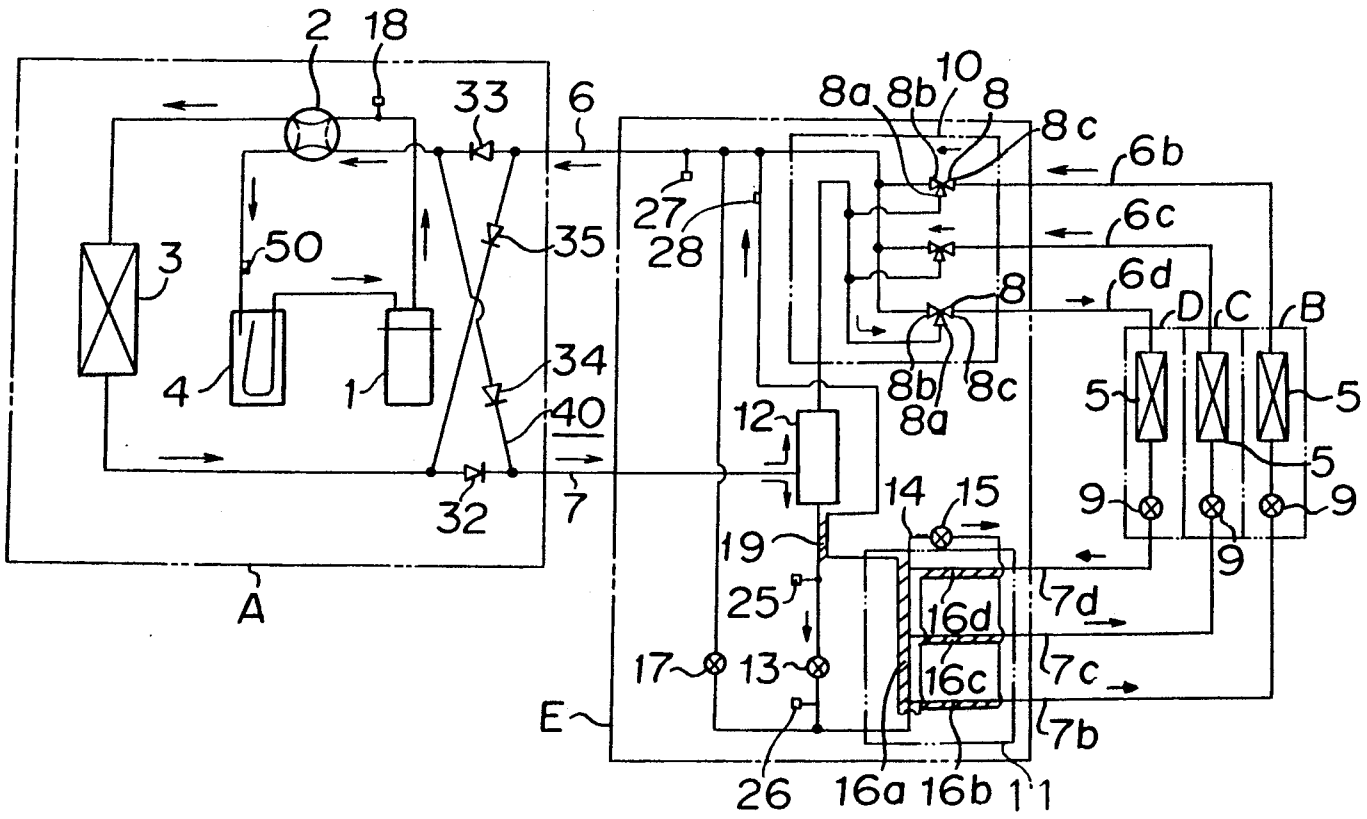
FIG. 18 is a schematic diagram showing a refrigerant circuit to help explain the operation state of the fourth embodiment wherein cooling is principally performed under cooling and heating concurrent operation.

FIG. 15 is a schematic diagram of the entire structure of the fourth embodiment of the air conditioning apparatus according to the present invention, which is depicted on the basis of the refrigerant system of the apparatus. FIGS. 16 to 18 are schematic diagrams showing the operation states in cooling or heating in the fourth embodiment of FIG. 15; FIG. 16 being a schematic diagram showing the operation states wherein solo cooling or solo heating is performed; and FIGS. 17 and 18 being schematic diagrams showing the operation states in cooling and heating concurrent operation, FIG. 17 being a schematic diagram showing the operation state wherein heating is principally performed under cooling and heating concurrent operation (heating load is greater than cooling load), and FIG. 18 being a schematic diagram showing the operation state wherein cooling is principally performed under cooling and heating concurrent operation (cooling load is greater than heating load).

Although explanation on the embodiment will be made in reference to the case wherein a single outdoor unit as a heat source device is connected to three indoor units, the explanation is also applicable to the case wherein the outdoor unit is connected to two or more indoor units.

In FIG. 15, reference A designates an outdoor unit as a heat source device. References B, C and D designate indoor units which are connected in parallel as described later and have the same structure as each other. Reference E designates a junction device which includes a first branch joint 10, a second flow controller 13, a second branch join 11, a gas-liquid separator 12, heat exchanging portions 16*a*, 16*b*, 16*c*, 16*d* and 19, a third flow controller 15, and a fourth flow controller 17, as described later.

Reference numeral 1 designates a compressor. Reference numeral 2 designates a four port reversing valve which can switch the flow direction of a refrigerant in the heat source device. Reference numeral 3 designates an outdoor heat exchanger which is installed on the side of the heat source device. Reference numeral 4 designates an accumulator which is connected to the compressor 1 through the reversing valve 2. These members constitute the heat source device A. Reference numeral 5 designates three indoor heat exchangers in the indoor units B, C and D. Reference numeral 6 designates a first main pipe which has a large diameter and which connects the four way reversing valve 2 of the heat source device A and the junction device E through a fourth check valve 33 as stated later. Reference numerals 6*b*, 6*c* and 6*d* designate first branch pipes which connect the junction device E and the indoor heat exchangers 5 of the respective indoor units B, C and D, and which correspond to the first main pipe 6. Reference numeral 7 designates a second main pipe which has a smaller diameter than the first main pipe 6, and which connects the junction device E and the outdoor heat exchanger 3 of the heat source device A through a third check valve 32 as stated later. Reference numerals 7*b*, 7*c* and 7*d* designate second branch pipes which connect the junction device E and the indoor heat exchangers 5 of the respective indoor units B, C and D through first flow controllers 9, and which correspond to the second main pipe 7. Reference numeral 8 designates three way switching valves which can selectively connect the first branch pipes 6*b*, 6*c* and 6*d* to either the first main pipe 6 or the second main pipe 7. Reference numeral 9 designates the first flow controllers which are connected to the respective indoor heat exchangers 5 in close proximity to the same, which are controlled based on degree of superheat at refrigerant outlet sides of the respective indoor heat exchangers in cooling and on degree of subcooling in heating, and which are connected to the second branch pipes 7*b*, 7*c* and 7*d*, respectively. Reference numeral 10 designates the first branch joint which includes the three way switching valves 8 which can selectively the first branch pipes 6*b*, 6*c* and 6*d* to either the first main pipe 6 or the second main pipe 7. Reference numeral 11 designates the second branch joint which includes the second branch pipes 7*b*, 7*c* and 7*d*, and the second main pipe 7. Reference numeral 12 designates the gas-liquid separator which is arranged in the second main pipe 7, and which has a gas phase zone connected to first ports 8*a* of the respective switching valves 8 and a liquid phase zone connected to the second branch joint 11. Reference numeral 13 designates the second flow controller which is connected between the gas-liquid separator 12 and the second branch joint 11, and which can be selectively opened and closed. Reference numeral 14 designates a bypass pipe which connects the second branch joint 11 to the first main pipe 6. Reference numeral 15 designates the third flow controller (shown as an electric expansion valve) which is arranged in the bypass pipe 14. Reference numeral 16*a* designates the second heat exchanging portion which is arranged in the bypass pipe 14 downstream of the third flow controller 15, and which carries out heat exchanging with a confluent portion where the second branch pipes 7*b*, 7*c* and 7*d* join in the second branch joint. Reference numerals 16*b*, 16*c* and 16*d* designate the third heat exchanging portions which are arranged in the bypass pipe 14 downstream of the third flow controller 15, and which carry out heat exchange with the respective second branch pipes 7*b*, 7*c* and 7*d* in the second branch joint 11. Reference numeral 19 designates the first heat exchanging portion which is arranged in the bypass pipe 14 downstream of the third flow controller 15 and the second heat exchanging portion 16*a*, and which carries out heat exchanging with a pipe which connects between the gas-liquid separator 12 and the second flow controller 13. Reference numeral 17 designates the fourth flow controller (shown as an electric expansion valve) which is arranged in a pipe between the second branch joint 11 and the first main pipe 6, and which can be selectively opened and closed. Reference numeral 32 designates the third check valve which is arranged between the outdoor heat exchanger 3 and the second main pipe 7, and which allows a refrigerant only to flow from the outdoor heat exchanger 3 to the second main pipe 7. Reference numeral 33 designates the fourth check valve which is arranged between the four way reversing valve 2 of the heat source device A and the first main pipe 6, and which allows the refrigerant only to flow from the first main pipe 6 to the reversing valve 2. Reference numeral 34 designates a fifth check valve which is arranged between the reversing valve 2 and the second main pipe 7, and which allows the refrigerant only to flow from the reversing valve 2 to the second main pipe 7. Reference numeral 35 designates a sixth check valve which is arranged between the outdoor heat exchanger 3 and the first main pipe 6, and which allows the refrigerant only to flow from the first main pipe 6 to the outdoor heat exchanger 3. These check valves 32–35 constitute a switching valve arrangement 40.

Reference numeral 25 designates a first pressure detector which is arranged between the first branch joint 10 and the second flow controller 13. Reference numeral 26 designates a second pressure detector which is arranged between the second flow controller 13 and the fourth flow controller 17. Reference numeral 27 designates a third pressure detector which is arranged in the first main pipe 6. The-reference numeral 28 designates a bypass pipe outlet temperature detector which is arranged in the bypass pipe 14 downstream of the first heat exchanging portion 19.

Reference numeral 50 designates a low pressure saturation temperature detector which is arranged in a pipe connecting between the reversing valve 2 and the accumulator 4. Reference numeral 18 designates a fourth pressure detector which is arranged in a pipe connecting between the compressor 1 and the reversing valve 2.

The operation of the fourth embodiment as constructed above will be explained.

Firstly, the case wherein only room cooling is performed will be explained with reference to FIG. 16.

In this case, the flow of the refrigerant is indicated by arrows of solid line. The compressor 1 has capacity controlled so that a temperature detected by the low pressure saturation temperature detector 50 achieves a predetermined value. The refrigerant gas which has discharged from the compressor 1 and had high temperature under high pressure passes through the four way reversing valve 2, and is heat exchanged and condensed in the outdoor heat exchanger 3. .Then, the refrigerant passes through the third check valve 32, the second main pipe 7, the separator 12 and the second flow controller 13 in that order. The refrigerant further passes through the second branch joint 11 and the second branch pipes 7*b*, 7*c* and 7*d*, and enters the indoor units B, C and D. The refrigerant which has entered the indoor units B, C and D is depressurized to low pressure by the first flow controllers 9 which are controlled based on degree of superheat at the outlets of the respective indoor heat exchanger 5. In the indoor heat exchangers 5, the refrigerant thus depressurized carries out heat exchanging with indoor air to be evaporated and gasified, thereby cooling the rooms. The refrigerant so gasified passes through the first branch pipes 6*b*, 6*c* and 6*d*, the three way switching valves 8, and the first branch joint 10. Then the refrigerant is inspired into the compressor 1 through the first main pipe 6, the fourth check valve 33, the four way reversing valve 2 in the heat source device A, and the accumulator 4. In this way, a circulation cycle is formed to carry out cooling. At this mode, the three way switching valves 8 have the first ports 8*a* closed, and second ports 8*b* and third ports 8*c* opened. At the time, the first main pipe 6 is at low pressure in it, and the second main pipe 7 is at high pressure in it, which necessarily make the third check valve 32 and the fourth check valve 33 to conduct for the refrigerant. In addition, in this mode, the refrigerant, which has passed through the second flow controller 13, partly enters the bypass pipe 14 where the entered part of the refrigerant is depressurized to low pressure by the third flow controller 15. The third flow controller is controlled in-accordance with degree of superheat at the bypass pipe outlet, which is calculated based on the saturation temperature of a pressure detected by the third pressure detector 27 and a temperature detected by the bypass pipe outlet temperature detector 28. The refrigerant thus depressurized carries out heat exchanging with the second branch pipes 7*b*, 7*c* and 7*d* at the third heat exchanging portions 16*b*, 16*c* and 16*d*, with the confluent portion of the second branch pipes 7*b*, 7*c* and 7*d* at the second heat exchanging portion 16*a* in the second branch joint 11, and at the first heat exchanging portion 19 with the refrigerant which flows into the second flow controller 13. The refrigerant is evaporated due to such heat exchanging, and enters the first main pipe 6 and the fourth check valve 33. Then the refrigerant is inspired into the compressor 1 through the first four way reversing valve 2 and the accumulator 4.

On the other hand, the refrigerant, which has heat exchanged at the first heat exchanging portion 19, the second heat exchanging portion 16*a*, and the third heat exchanging portions 16*b*, 16*c* and 16*d*, and has been cooled so as to get sufficient subcooling, enters the indoor units B, C and D which are expected to carry out cooling.

Secondly, the case wherein only heating is performed will be described with reference FIG. 16. In this case, the flow of the refrigerant is indicated by arrows of dotted line. The compressor 1 has capacity controlled so that a pressure detected by the fourth pressure detector 18 achieves a predetermined value.

The refrigerant which has been discharged from the compressor 1 and been a gas having high temperature under high pressure passes through the four way reversing valve 2, the fifth check valve 34, the second main pipe 7, and the gas-liquid separator 12. Then the refrigerant passes through the first branch joint 10, the three way switching valves 8, and the first branch pipes 6*b*, 6*c* and 6*d* in that order. After that, the refrigerant enters the respective indoor units B, C and D where the refrigerant carries out heat exchanging with indoor air. The refrigerant is condensed to be liquefied due to such heat exchanging, thereby heating the rooms. The refrigerant thus liquefied passes through the first flow controllers which are almost fully opened, being controlled based on degree of subcooling at the refrigerant outlets of the respective indoor heat exchangers 5. Then the refrigerant enters the second branch joint 11 through the second branch pipes 7*b*, 7*c* and 7*d*, and joins there. Then the joined refrigerant passes through the fourth flow controller 17 and is depressurized there to take a gas-liquid two phase state having low pressure. The refrigerant thus depressurized enters the outdoor heat exchanger 3 through the first main pipe 6 and the sixth check valve 35 of the heat source device A, and carries out heat exchanging to be evaporated and gasified. The refrigerant thus gasified is inspired into the compressor 1 through the four way reversing valve 2 of the heat source device A, and the accumulator 4. In this way, a circulation cycle is formed to carry out room heating. In this mode, the switching valves 8 have the second ports 8*b* closed, and the first and the third ports 8*a* and 8*c* opened.

In this mode, the first main pipe 6 is at low pressure in it, and the second main pipe 7 is at high pressure in it, which necessarily causes the fifth check valve 34 and the sixth check valve 35 to conduct for the refrigerant.

Thirdly, the case wherein room heating is principally performed in room cooling and room heating concurrent operation will be explained with reference to FIG. 17. In FIG. 17, arrows of dotted line indicate the flow of the refrigerant. The compressor 1 has capacity controlled so that a pressure detected by the fourth pressure detector 18 achieves a predetermined value. The refrigerant which has been discharged from the compressor 1, and been a gas having high temperature under high pressure passes through the four way reversing valve 2, and then reaches the junction device E through the fifth check valve 34 and the second main pipe 7. The refrigerant flows through the gas-liquid separator 12. In addition, the refrigerant passes through the first branch joint 10, the three way switching valves 8, and the first branch pipes 6*b* and 6*c* in that order, and enters the indoor units B and C which are expected to carry out heating. In the indoor heat exchangers 5 of the respective indoor units B and C, the refrigerant carries out heat exchange with indoor air to be condensed and liquefied, thereby heating the rooms. The refrigerant thus condensed and liquefied passes through the first flow controllers 9 of the indoor units B and C, the first controllers 9 of the indoor units B and C being almost fully opened under control based on degree of subcooling at the refrigerant outlets of the corresponding indoor heat exchangers 5. The refrigerant is slightly depressurized by these first flow controllers 9, and flows into the second blanch joint 11. After that, a part of the refrigerant passes through the second branch pipe 7*d* of the indoor unit D which is expected to carry out cooling, and enters the indoor unit D. The refrigerant flows into the first flow controller 9 of the indoor unit D, the first flow controller 9 being controlled based on degree of superheat at the refrigerant outlet of the corresponding indoor heat exchanger 5. After the refrigerant is depressurized by this first flow controller 9, it enters the indoor heat exchanger 5, and carries out heat exchange to be evaporated and gasified, thereby cooling the room. Then the refrigerant enters the first main pipe 6 through the first branch pipe 6*d* and the three way switching valve 8 which is connected to the indoor unit D.

On the other hand, another part of refrigerant passes through the fourth flow controller 17 which is controlled so that a difference between a pressure detected by the first pressure detector 25 and a pressure detected by the second pressure detector 26 falls into a predetermined range. Then the refrigerant joins with the refrigerant which has passed the indoor unit D which is expected to carry out cooling. After that, the refrigerant thus joined passes through the first main pipe 6 having such a larger diameter, and the sixth check valve 35 of the heat source device A, and enters the outdoor exchanger 3 where the refrigerant carries out heat exchange to be evaporated and gasified. The refrigerant thus gasified is inspired into the compressor 1 through the heat source device reversing valve 2 and the accumulator 4. In this way, a circulation cycle is formed to carry out the cooling and heating concurrent operation wherein heating is principally performed. At this time, the difference between the evaporation pressure in the indoor heat exchanger 5 of the cooling indoor unit D and that of the outdoor heat exchanger 3 lessens because of switching to the first main pipe 6 having such a greater diameter. At that time, the three port switching valves 8 which are connected to the heating indoor units B and C have the second ports 8*b* closed, and the first and third ports 8*a* and 8*c* opened. The three port switching valve 8 which is connected to the cooling indoor unit D has the first port 8*a* closed, and the second port 8*b* and the third port 8*c* opened.

In this mode, the first main pipe 6 is at low pressure in it, and the second main pipe 7 is at high pressure in it, which necessarily causes the fifth check valve 34 and the sixth check valve 35 to conduct for the refrigerant. At this circulation cycle, the remaining part of the liquefied refrigerant goes into the bypass pipe 14 from the confluent portion of the second branch joint 11 where the second branch pipes 7*b*, 7*c* and 7*d* join together. The refrigerant which has gone into the bypass pipe 14 is depressurized to low pressure by the third flow controller 15. The refrigerant thus depressurized carries out heat exchange with the refrigerant in the second branch pipes 7*b*, 7*c* and 7*d* at the third heat exchanging portions 16*b*, 16*c* and 16*d*, with the refrigerant in the confluent portion of the second branch pipes 7*b*, 7*c* and 7*d* in the second branch joint 11 at the second heat exchanging portion 16*a*, and at the first heat exchanging portion 19 with the refrigerant which flows from the second flow controller 13. The refrigerant is evaporated by such heat exchange, and enters the first main pipe 6. After that, the refrigerant flows into the sixth check valve 35 and then into the outdoor heat exchanger 3 where it performs heat exchange to be evaporated and gasified. The refrigerant thus gasified is inspired into the compressor 1 through the first four way reversing valve 2 and the accumulator 4.

On the other hand, the refrigerant in the second branch joint 11 which has carried out heat exchange and cooled at the first heat exchanging portion 19, the second heat exchanging portion 16*a*, and the third heat exchanging portions 16*b*, 16*c* and 16*d* to obtain sufficient subcooling flows into the indoor unit D which is expected to cool the room.

Fourthly, the case wherein room cooling is principally performed in room cooling and room heating concurrent operation will be described with reference to FIG. 18.

In FIG. 18, arrows of solid lines indicate the flow of the refrigerant. The compressor 1 has capacity controlled so that a temperature detected by the low pressure saturation temperature detector 50 achieves a predetermined value. The refrigerant which has been discharged from the compressor 1 and been a gas having high temperature under high pressure flows into the outdoor heat exchanger 3 through the reversing valve 2, and carries out heat exchange with outdoor air in the outdoor heat exchanger 3 to take a gas-liquid two phase state having high temperature under high pressure. Then the refrigerant passes through the third check valve 32 and the second main pipe 7, and is forwarded to the gas-liquid separator 12 in the junction device E. The refrigerant is separated into a gaseous refrigerant and a liquid refrigerant there, and the gaseous refrigerant thus separated flows through the first branch joint 10, and the three way switching valve 8 and the first branch pipe 6*d* which are connected to the indoor unit D, in that order, the indoor unit D being expected to heat the room with the indoor unit D installed in it. The refrigerant flows into the indoor unit D, and carries out heat exchange with indoor air to be condensed and liquefied, thereby heating the room. In addition, the refrigerant passes through the first flow controller 9 connected to the heating indoor unit D, this first flow controller 9 being almost fully opened under control based on degree of subcooling at the refrigerant outlet of the indoor heat exchanger 5 of the heating indoor unit D. The refrigerant is slightly depressurized by this first flow controller 9, and flows into the second branch joint 11. On the other hand, the remaining liquid refrigerant enters the second branch joint 11 through the second flow controller 13 which is controlled based on pressures detected by the first pressure detector 25 and the second pressure detector 26. Then the refrigerant joins there with the refrigerant which has passed through the heating indoor unit D. The refrigerant thus joined passes through the second branch joint 11, and then the second branch pipes 7*b* and 7*c*, respectively, and enters the respective indoor units B and C. The refrigerant which has flowed into the indoor units B and C is depressurized to low pressure by the first flow controllers 9 of the indoor units B and C, these first flow controllers 9 being controlled based on degree of superheat at the refrigerant outlets of the corresponding indoor heat exchangers 5. Then the refrigerant flows into the indoor heat exchangers 5, and carries out heat exchange with indoor air to be evaporated and gasified, thereby cooling the rooms. In addition, the refrigerant thus gasified passes through the first branch pipes 6*b* and 6*c*, the three way switching valves 8, and the first branch joint 10. Then the refrigerant is inspired into compressor 1 through the first main pipe 6, the fourth check valve 33, the four way reversing valve 2 in the heat source device A, and the accumulator 4. In this way, a circulation cycle is formed to carry out the cooling and heating concurrent operation wherein cooling is principally performed. In this mode, the three way switching valves 8 which are connected to the indoor units B and C have the first ports 8*a* closed, and the second and third ports 8*b* and 8*c* opened. The three way switching valve 8 which is connected to the indoor unit D has the second port 8*b* closed, and the first and third ports 8*a* and 8*c* opened.

At that time, the first main pipe 6 is at low pressure in it, and the second main pipe 7 is a high pressure in it, which necessarily causes the third check valve 32 and the fourth check valve 33 to conduct for the refrigerant.

In this circulation cycle, the liquid refrigerant partly enters the bypass pipe 14 from the confluent portion of the second branch joint 11 where the second branch pipes 7*b*, 7*c* and 7*d* join together. The liquid refrigerant which has entered into the bypass pipe 14 is depressurized to low pressure by the third flow controller 15. The refrigerant thus depressurized carried out heat exchange with the refrigerant in the second branch pipes 7*b*, 7*c* and 7*d* at the third heat exchanging portions 16*b*, 16*c* and 16*d*, and at the second heat exchanging portion 16*a* with the refrigerant in the confluent portion of the second branch pipes 7*b*, 7*c* and 7*d* in the second branch joint 11, and at the first heat exchanging portion 19 with the refrigerant which flows into the second flow controller 13. The refrigerant is evaporated by such heat exchange, and enters the first main pipe 6. The refrigerant which has entered the first main pipe 6 is inspired into the compressor 1 through the fourth check valve 33, the four way reversing valve 2 in the heat source device A, and the accumulator 4.

On the other hand, the refrigerant in the second branch joint 11 which has carried out heat exchange and cooled at the first heat exchanging portion 19, the second heat exchanging portion 16*a*, and the third heat exchanging portions 16*b*, 16*c* and 16*d* to obtain sufficient subcool flows into the indoor units B and C which are expected to carry out cooling.

Figure 19:
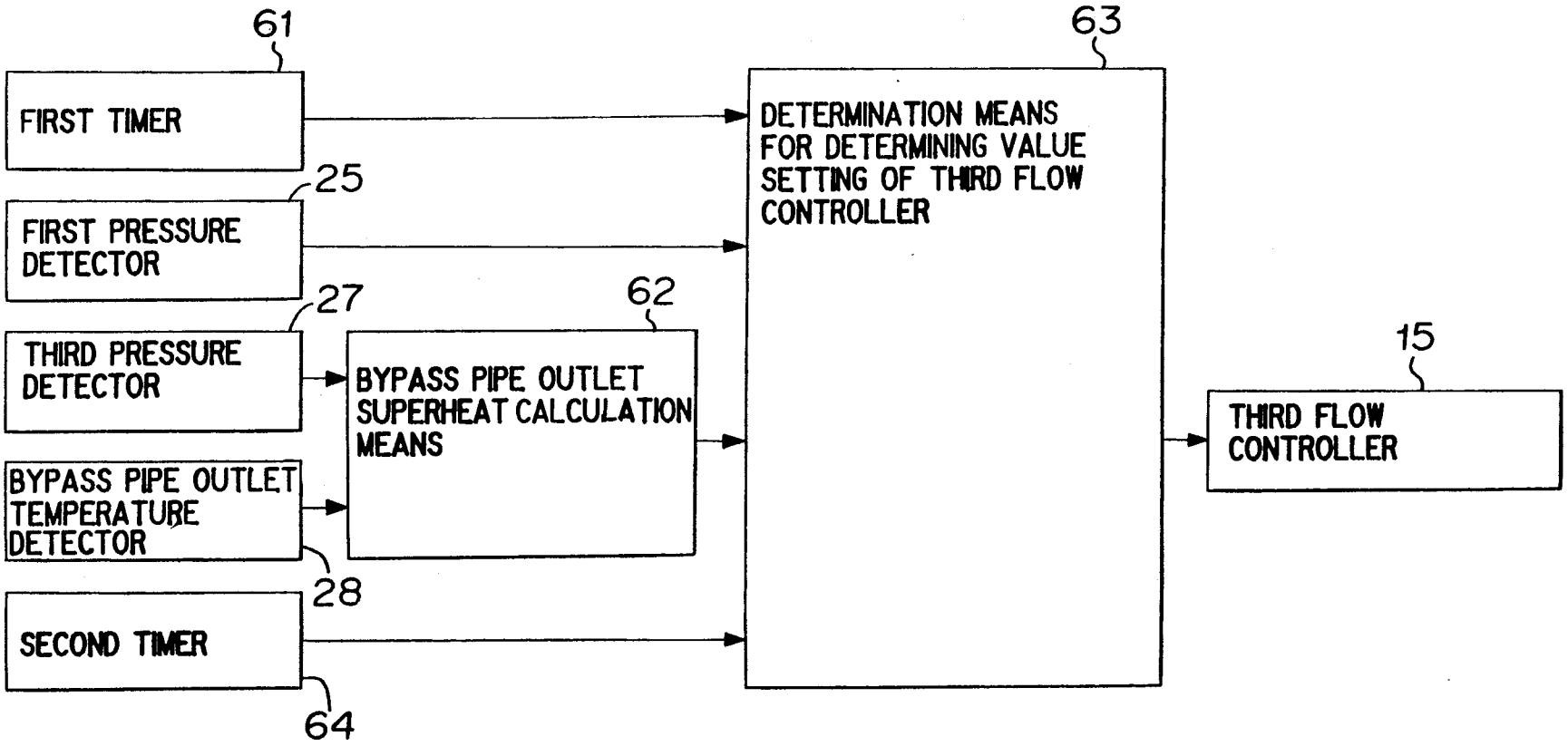
FIG. 19 is a block diagram showing a control for restraining an increase in high pressure according to the fourth embodiment.

Next, a control for restraining a transitional raise in high pressure in only cooling will be explained, referring to FIGS. 19 and 20. FIG. 19 is a block diagram showing the control according to the fourth embodiment. FIG. 20 is a flowchart showing the control according to the fourth embodiment.

In FIG. 19, reference numeral 61 designates a first timer which measures a duration that has lapsed since the previous control was made, thereby periodically carrying out the valve setting control of the third flow controller 15 at a first cycle. The first timer is cleared whenever the compressor 1 starts working or the valve setting control of the third flow controller 15 is made. Reference numeral 62 designates a bypass pipe outlet superheat calculation means which calculates degree of superheat at the outlet of the bypass pipe based on a pressure detected by the third pressure detector 27 and a temperature detected by the bypass pipe outlet temperature detector 28. Reference numeral 63 designates determination means for determining the valve setting of the third flow controller 15 based on an output from the bypass pipe outlet superheat calculation means 62 and a pressure detected by the first pressure detector 25. Reference numeral 64 designates a second timer which measures an operating duration since the previous control for restraining a raise in high pressure was made. The second timer is cleared whenever the compressor 1 starts working or the control for restraining a raise in high pressure is made.

A control flow for restraining a raise in high pressure will be explained, referring to FIG. 20.

At Step 71, it is determined whether a pressure detected by the first pressure detector 25 is a predetermined value or higher. If affirmative, the program proceeds to Step 78. If negative, the program proceeds to Step 72.

At Step 78, it is determined whether the second timer 64 has measured a predetermined duration B or longer. If negative, the program proceeds to Step 72. If affirmative, the program proceeds to Step 79. At Step 79, the time data in the second timer 64 is cleared, and the program proceeds to Step 76.

At Step 76, the valve setting of the third flow controller 15 is increased by a predetermined value, and then the program proceeds to Step 77.

At Step 72, it is determined whether the first timer 61 has measured a predetermined duration A or longer. If affirmative, the program proceeds to Step 73. If negative, the program returns to Step 71.

At Step 73, it is determined whether degree of superheat at the outlet of the bypass pipe is a predetermined value or higher. If affirmative, the program proceeds to Step 74. If negative, the program proceeds to Step 75.

At Step 74, the valve setting of the third flow controller 15 is increased, depending on a duration with respect to a predetermined value of degree of superheat. Then program proceeds to Step 77.

At Step 75, the valve setting of the third flow controller 15 is decreased, depending on the deviation with respect to the predetermined value of degree of superheat. Then the program proceeds to Step 77.

At Step 77, the time data in the first timer 61 is cleared, and the program returns to Step 71.

In accordance with the fourth embodiment, when the high pressure is transitional raised in only cooling, the bypass passage which extends from the second main pipe to the first main pipe through the second and third flow controllers in the junction device is expanded by increasing the valve setting of the third flow controller. As a result, pressure loss in passage can be decreased to facilitate the flow of the refrigerant, thereby lowering the high pressure.

EMBODIMENT 5

Figure 21:
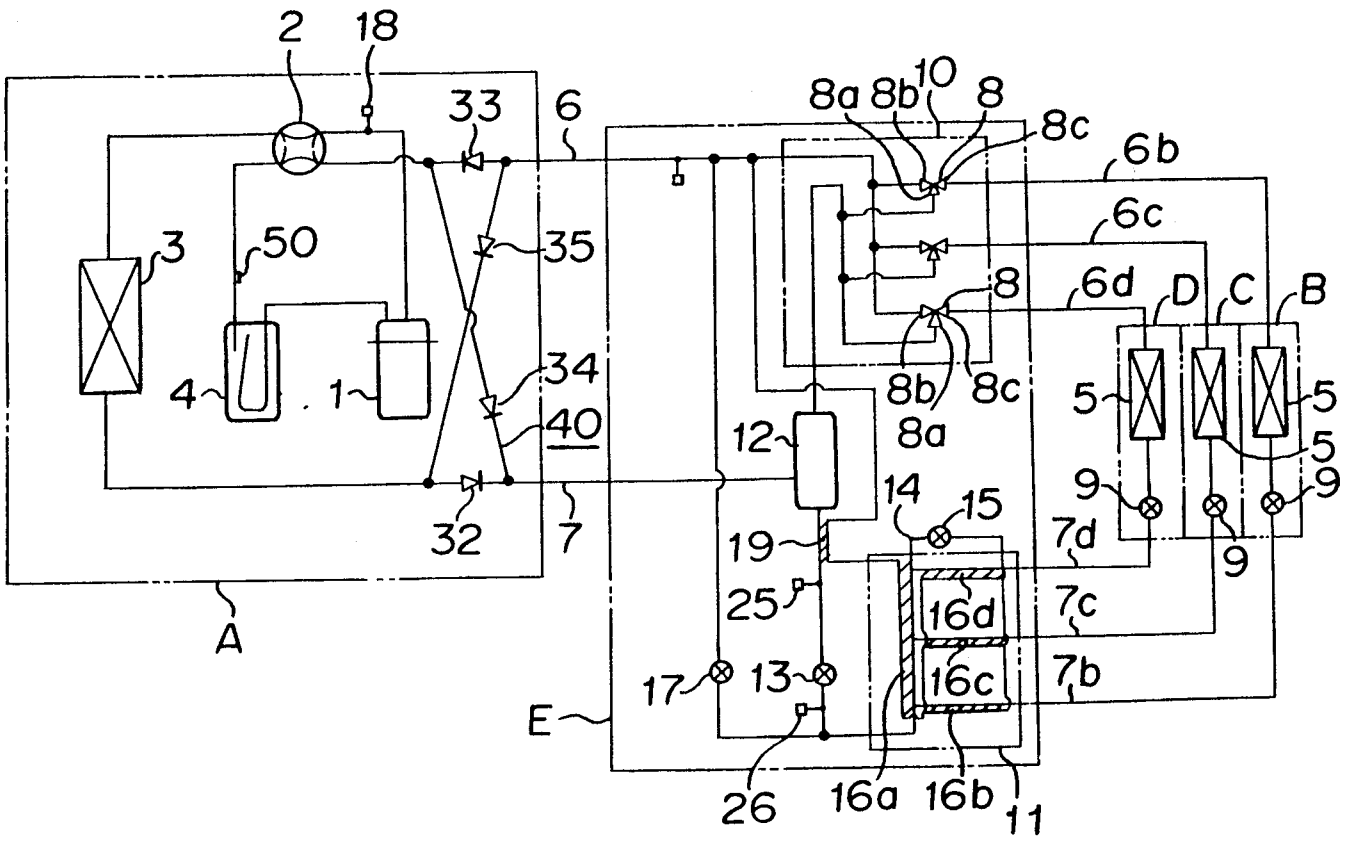
FIG. 21 is a schematic diagram showing the entire structure of a fifth embodiment which is depicted on the basis of the refrigerant system of the apparatus.
Figure 22:
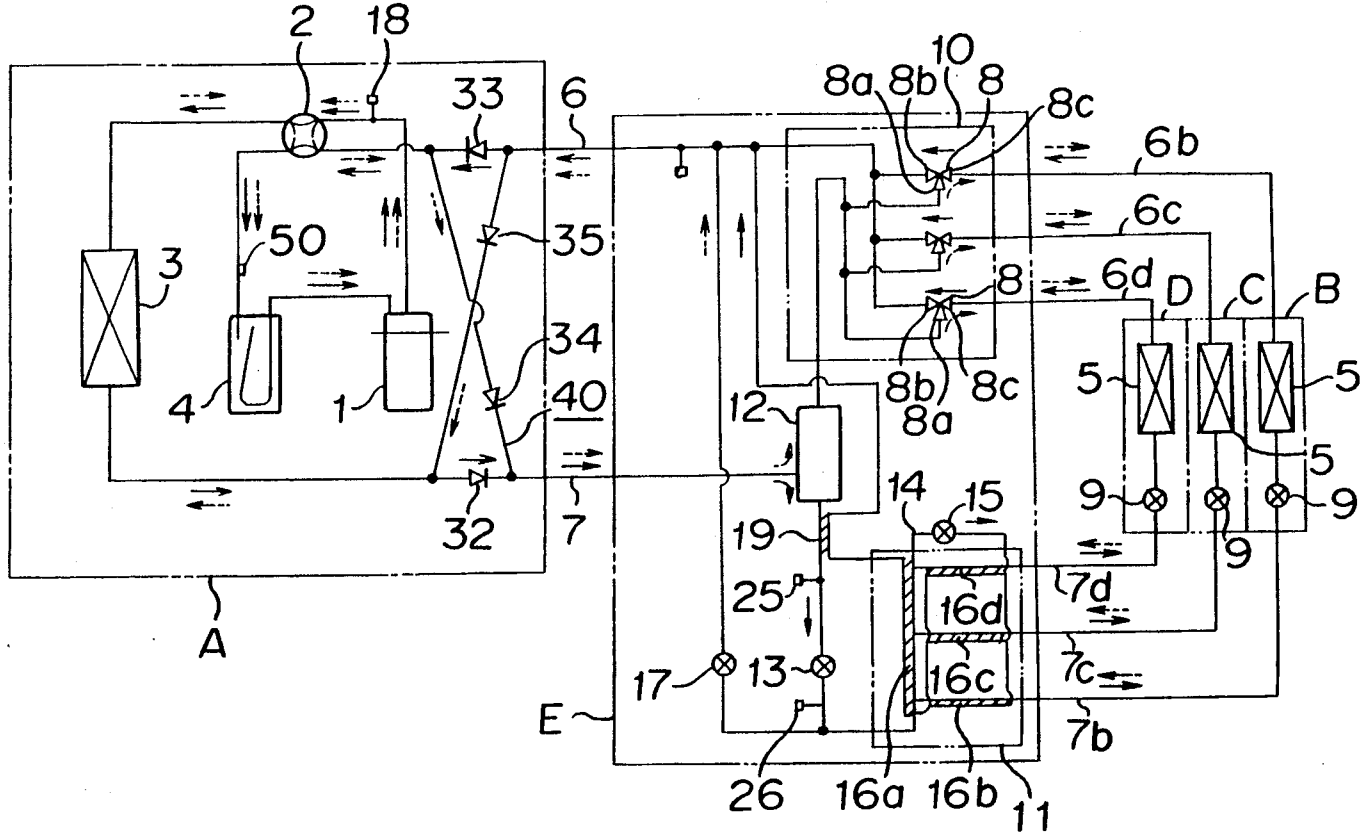
FIG. 22 is a schematic diagram showing a refrigerant circuit to help explain the operation states of the fifth embodiment wherein solo cooling or solo room heating is performed.
Figure 23:
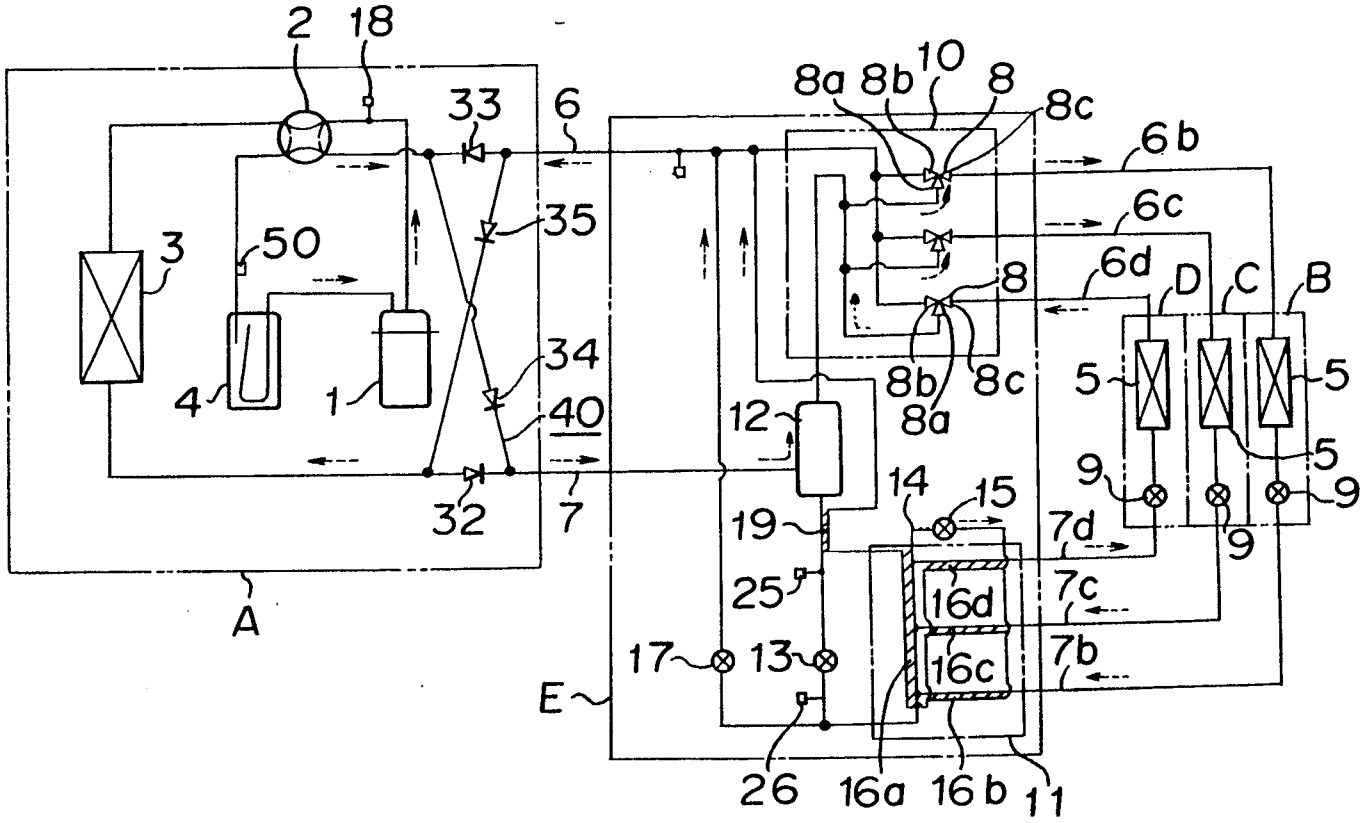
FIG. 23 is a schematic diagram showing a refrigerant circuit to help explain the operation state of the fifth embodiment wherein heating is principally performed under cooling and heating concurrent operation.
Figure 24:
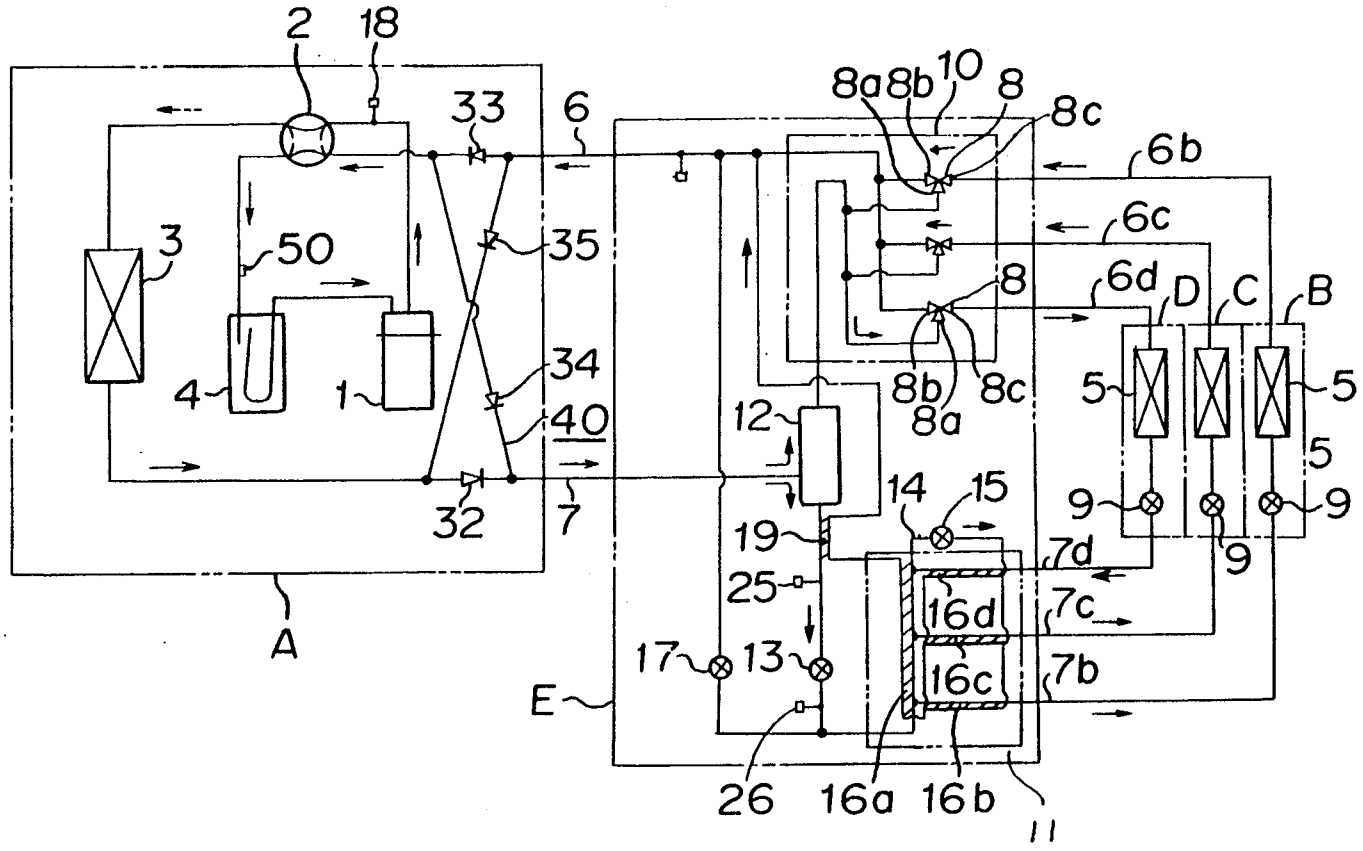
FIG. 24 is a schematic diagram showing a refrigerant circuit to help explain the operation state of the fifth embodiment wherein cooling is principally performed under cooling and heating concurrent operation.

FIG. 21 is a schematic diagram of the entire structure of the fifth embodiment of the air conditioning apparatus according to the present invention, which is depicted on the basis of the refrigerant system of the apparatus. FIGS. 22 to 24 are schematic diagram showing the operation states in cooling or heating in the fifth embodiment of FIG. 21; FIG. 22 being a schematic diagram showing the operation states wherein solo cooling or solo heating is performed; and FIGS. 23 and 24 being schematic diagrams showing the operation states in cooling and heating concurrent operation, FIG. 23 being a schematic diagram showing the operation state wherein heating is principally performed under cooling and heating concurrent operation (heating load is greater than cooling load), and FIG. 24 being a schematic diagram showing the operation state wherein cooling is principally performed under cooling and heating concurrent operation (cooling load is greater than heating load).

Although explanation on the embodiment will be made in reference to the case wherein a single outdoor unit as a heat source device is connected to three indoor units, the explanation is also applicable to the case wherein the outdoor unit is connected to two or more indoor units.

In FIG. 21, reference A designates an outdoor unit as a heat source device. Reference B, C and D designate indoor units which are connected in parallel as described later and have the same structure as each other. Reference E designates a junction device which includes a first branch joint 10, a second flow controller 13, a second branch joint 11, a gas liquid separator 12, heat exchanging portions 16*a*, 16*b*, 16*c*, 16*d* and 19, a third flow controller 15, and a fourth flow controller 17, as described later.

Reference numeral 1 designates a compressor. Reference numeral 2 designates a four port reversing valve which can switch the flow direction of a refrigerant in the heat source device. Reference numeral 3 designates an outdoor heat exchanger which is installed on the side of the heat source device. Reference numeral 4 designates an accumulator which is connected to the compressor 1 through the reversing valve 2. These members constitute the heat source device A. Reference numeral 5 designates three indoor heat exchangers in the indoor units B, C and D. Reference numeral 6 designates a first main pipe which has a large diameter and which connects the four way reversing valve 2 of the heat source device A and the junction device E through a fourth check valve 33 as stated later. Reference numerals 6*b*, 6*c* and 6*d* designate first branch pipes which connect the junction device E and the indoor heat exchangers 5 of the respective indoor units B, C and D, and which correspond to the first main pipe 6. Reference numeral 7 designates a second main pipe which has a smaller diameter than the first main pipe 6, and which connects the junction device E and the outdoor heat exchanger 3 of the heat source device A through a third check valve 32 as stated later. Reference numerals 7*b*, 7*c* and 7*d* designate second branch pipes which connect the junction device E and the indoor heat exchangers 5 of the respective indoor units B, C and D through first flow controllers 9, and which correspond to the second main pipe 7. Reference numeral 8 designates three way switching valves which can selectively connect the first branch pipes 6*b*, 6*c* and 6*d* to either the first main pipe 6 or the second main pipe 7. Reference numeral 9 designates the first flow controllers which are connected to the respective indoor heat exchangers 5 in close proximity to the same, which are controlled based on degree of superheat at refrigerant outlet sides of the respective indoor heat exchangers in cooling and degree of subcooling in heating, and which are connected to the second branch pipes 7*b*, 7*c* and 7*d*, respectively. Reference numeral 10 designates the first branch joint which includes the three way switching valves 8 which can selectively the first branch pipes 6*b*, 6*c* and 6*d* to either the first main pipe 6 or the second main pipe 7. Reference numeral 11 designates the second branch joint which includes the second branch pipes 7*b*, 7*c* and 7*d*, and the second main pipe 7. Reference numeral 12 designates the gas-liquid separator which is arranged in the second main pipe 7, and which has a gas phase zone connected to first ports 8*a* of the respective switching valves 8 and a liquid phase zone connected to the second branch joint 11. Reference numeral 13 designates the second flow controller which is connected between the gas-liquid separator 12 and the second branch joint 11, and which can be selectively opened and closed. Reference numeral 14 designates a bypass pipe which connects the second branch joint 11 to the first main pipe 6. Reference numeral 15 designates the third flow controller (shown as an electric expansion valve) which is arranged in the bypass pipe 14. Reference numeral 16*a* designates the second heat exchanging portion which is arranged in the bypass pipe 14 downstream of the third flow controller 15, and which carries out heat exchanging with a confluent portion where the second branch pipes 7*b*, 7*c* and 7*d* join in the second branch joint. Reference numerals 16*b*, 16*c* and 16*d* designate the third heat exchanging portions which are arranged in the bypass pipe 14 downstream of the third flow controller 15, and which carry out heat exchange with the respective second branch pipes 7b, 7c and 7d in the second branch joint 11. Reference numeral 19 designates the first heat exchanging portion which is arranged in the bypass pipe 14 downstream of the third flow controller 15 and the second heat exchanging portion 16a, and which carries out heat exchanging with the pipe which connects between the gas-liquid separator 12 and the second flow controller 13. Reference numeral 17 designates the fourth flow controller (shown as an electric expansion valve) which is arranged in a pipe between the second branch joint 11 and the first main pipe 6, and which can be selectively opened and closed. Reference numeral 32 designates the third check valve which is arranged between the outdoor heat exchanger 3 and the second main pipe 7, and which allows a refrigerant only to flow from the outdoor heat exchanger 3 to the second main pipe 7. Reference numeral 33 designates the fourth check valve which is arranged between the four way reversing valve 2 of the heat source device A and the first main pipe 6, and which allows the refrigerant only to flow from the first main pipe 6 to the reversing valve 2. Reference numeral 34 designates a fifth check valve which is arranged between the reversing valve 2 and the second main pipe 7, and which allows the refrigerant only to flow from the reversing valve 2 to the second main pipe 7. Reference numeral 35 designates a sixth check valve which is arranged between the outdoor heat exchanger 3 and the first main pipe 6, and which allows the refrigerant only to flow from the first main pipe 6 to the outdoor heat exchanger 3. These check valves 32–35 constitute a switching valve arrangement 40.

Reference numeral 25 designates a first pressure detector which is arranged between the first branch joint 10 and the second flow controller 13. Reference numeral 26 designates a second pressure detector which is arranged between the second flow controller 13 and the fourth flow controller 17.

Reference numeral 50 designates a low pressure saturation temperature detector which is arranged in a pipe connecting between the reversing valve 2 and the accumulator 4. Reference numeral 18 designates a fourth pressure detector which is arranged in a pipe connecting between the compressor 1 and the reversing valve 2.

The operation of the fifth embodiment as constructed above will be explained.

Firstly, the case wherein only room cooling is performed will be explained with reference to FIG. 22.

In this case, the flow of the refrigerant is indicated by arrows of solid line. The compressor 1 has capacity controlled so that a temperature detected by the low pressure saturation temperature detector 50 achieves a predetermined value. The refrigerant gas which has discharged from the compressor 1 and had high temperature under high pressure passes through the four way reversing valve 2, and is heat exchanged and condensed in the outdoor heat exchanger 3. Then, the refrigerant passes through the third check valve 32, the second main pipe 7, the separator 12 and the second flow controller 13 in that order. The refrigerant further passes through the second branch joint 11 and the second branch pipes 7b, 7c and 7d, and enters the indoor units B, C and D. The refrigerant which has entered the indoor units B, C and D is depressurized to low pressure by the first flow controllers 9 which are controlled based on degree of superheat at the outlets of the respective indoor heat exchanger 5. In the indoor-heat exchangers 5, the refrigerant thus depressurized carries out heat exchanging with indoor air to be evaporated and gasified, thereby cooling the rooms. The refrigerant so gasified passes through the first branch pipes 6b, 6c and 6d, the three way switching valves 8, and the first branch joint 10. Then the refrigerant is inspired into the compressor 1 through the first main pipe 6, the fourth check valve 33, the four way reversing valve 2 in the heat source device A, and the accumulator 4. In this way, a circulation cycle is formed to carry out cooling. At this mode, the three way switching valves 8 have the first ports 8a closed, and second ports 8b and third ports 8c opened. At the time, the first main pipe 6 is at low pressure in it, and the second main pipe 7 is at high pressure in it, which necessarily make the third check valve 32 and the fourth check valve 33 to conduct for the refrigerant. In addition, in this mode, the refrigerant, which has passed through the second flow controller 13, partly enters the bypass pipe 14 where the entered part of the refrigerant is depressurized to low pressure by the third flow controller 15. The refrigerant thus depressurized carries out heat exchanging with the second branch pipes 7b, 7c and 7d at the third heat exchanging portions 16b 16c and 16d, with the confluent portion of the second branch pipes 7b, 7c and 7d at the second heat exchanging portion 16a in the second branch joint 11, and at the first heat exchanging portion 19 with the refrigerant which flows into the second flow controller 13. The refrigerant is evaporated due to such heat exchanging, and enters the first main pipe 6 and the fourth check valve 33. Then the refrigerant is inspired into the compressor 1 through the first four way reversing valve 2 and the accumulator 4.

On the other hand, the refrigerant, which has heat exchanged at the first heat exchanging portion 19, the second heat exchanging portion 16a, and the third heat exchanging portions 16b, 16c and 16d, and has been cooled so as to get sufficient subcooling, enters the indoor units B, C and D which are expected to carry out cooling.

Secondly, the case wherein only heating is performed will be described with reference FIG. 22. In this case, the flow of the refrigerant is indicated by arrows of dotted line. The compressor 1 has capacity controlled so that a pressure detected by the fourth pressure detector 18 achieves a predetermined value.

The refrigerant which has been discharged from the compressor 1 and been a gas having high temperature under high pressure passes through the four way reversing valve 2, the fifth check valve 34, the second main pipe 7, and the gas-liquid separator 12. Then the refrigerant passes through the first branch joint 10, the three way switching valves 8, and the first branch pipes 6b, 6c and 6d in that order. After that, the refrigerant enters the respective indoor units B, C and D where the refrigerant carries out heat exchanging with indoor air. The refrigerant is condensed to be liquefied due to such heat exchanging, thereby heating the rooms. The refrigerant thus liquefied passes through the first flow controllers 9 which are almost fully opened, being controlled based on degree of subcooling at the refrigerant outlets of the respective indoor heat exchangers 5. Then the refrigerant enters the second branch joint 11 through the second branch pipes 7b, 7c and 7d, and joins there. Then the joined refrigerant passes through the fourth flow controller 17 and is depressurized by to take a gas-liquid two phase state having low pressure. The refrigerant thus depressurized enters the outdoor heat exchanger 3 through the first main pipe 6 and the sixth check valve 35 of the heat source device A, and carries out heat exchanging to be evaporated and gasified. The refrigerant thus gasified is inspired into the compressor 1 through the four way reversing valve 2 of the heat source device A, and the accumulator 4. In this way, a circulation cycle is formed to carry out heating. In this mode, the switching valves 8 have the second ports 8*b* closed, and the first and the third ports 8*a* and 8*c* opened.

In this mode, the first main pipe 6 is at low pressure in it, and the second main pipe 7 is at high pressure in it, which necessarily causes the fifth check valve 34 and the sixth check valve 35 to conduct for the refrigerant. At that time, the second flow controller 13 is normally of a predetermined minimum setting state.

Thirdly, the case wherein room heating is principally performed in room cooling and room heating concurrent operation will be explained with reference to FIG. 23. In FIG. 23, arrows of dotted line indicate the flow of the refrigerant. The compressor 1 has capacity controlled so that a pressure detected by the fourth pressure detector 18 achieves a predetermined value. The refrigerant which has been discharged from the compressor 1, and been a gas having high temperature under high pressure passes through the four way reversing valve 2, and then reaches the junction device E through the fifth check valve 34 and the second main pipe 7. The refrigerant flows through the gas-liquid separator 12. In addition, the refrigerant passes through the first branch joint 10, the three way switching valves 8, and the first branch pipes 6*b* and 6*c* in that order, and enters the indoor units B and C which are expected to carry out heating. In the indoor heat exchangers 5 of the respective indoor units B and C, the refrigerant carries out heat exchange with indoor air to be condensed and liquefied, thereby heating the rooms. The refrigerant thus condensed and liquefied passes through the first flow controllers 9 of the indoor units B and C, the first controllers 9 of the indoor units B and C being almost fully opened under control based on degree of subcooling at the refrigerant outlets of the corresponding indoor heat exchangers 5. The refrigerant is slightly depressurized by these first flow controllers 9, and flows into the second blanch joint 11. After that, a part of the refrigerant passes through the second branch pipe 7*d* of the indoor unit D which is expected to carry out cooling, and enters the indoor unit D. The refrigerant flows into the first flow controller 9 of the indoor unit D, the first flow controller 9 being controlled based on degree of superheat at the refrigerant outlet of the corresponding indoor heat exchanger 5. After the refrigerant is depressurized by this first flow controller 9, it enters the indoor heat exchanger 5, and carries out heat exchange to be evaporated and gasified, thereby cooling the room. Then the refrigerant enters the first main pipe 6 through the first branch pipe 6*d* and the three way switching valve 8 which is connected to the indoor unit D.

On the other hand, another part of refrigerant passes through the fourth flow controller 17 which is controlled so that a difference between the pressure detected by the first pressure detector 25 and the pressure detected by the second pressure detector 26 falls into a predetermined range. Then the refrigerant joins with the refrigerant which has passed the indoor unit D which is expected to carry out cooling. After that, the refrigerant thus joined passes through the first main pipe 6 having such a larger diameter, and the sixth check valve 35 of the heat source device A, and enters the outdoor exchanger 3 where the refrigerant carries out heat exchange to be evaporated and gasified. The refrigerant thus gasified is inspired into the compressor 1 through the heat source device reversing valve 2 and the accumulator 4. In this way, a circulation cycle is formed to carry out the cooling and heating concurrent operation wherein heating is principally performed. At this time, the difference between the evaporation pressure in the indoor heat exchanger 5 of the cooling indoor unit D and that of the outdoor heat exchanger 3 lessens because of switching to the first main pipe 6 having such a greater diameter. At that time, the three port switching valves 8 which are connected to the heating indoor units B and C have the second ports 8*b* closed, and the first and third ports 8*a* and 8*c* opened. The three port switching valve 8 which is connected to the cooling indoor unit D has the first port 8*a* closed, and the second port 8*b* and the third port 8*c* opened.

In this mode, the first main pipe 6 is at low pressure in it, and the second main pipe 7 is at high pressure in it, which necessarily causes the fifth check valve 34 and the sixth check valve 35 to conduct for the refrigerant. At this circulation cycle, the remaining part of the liquefied refrigerant goes into the bypass pipe 14 from the confluent portion of the second branch joint 11 where the second branch pipes 7*b*, 7*c* and 7*d* join together. The refrigerant which has gone into the bypass pipe 14 is depressurized to low pressure by the third flow controller 15. The refrigerant thus depressurized carries out heat exchange with the refrigerant in the second branch pipes 7*b*, 7*c* and 7*d* at the third heat exchanging portions 16*b*, 16*c* and 16*d*, with the refrigerant in the confluent portion of the second branch pipes 7*b*, 7*c* and 7*d* in the second branch joint 11 at the second heat exchanging portion 16*a*, and at the first heat exchanging portion 19 with the refrigerant which flows in the second flow controller 13. The refrigerant is evaporated by such heat exchange, and enters the first main pipe 6. After that, the refrigerant flows into the sixth check valve 35 and then into the outdoor heat exchanger 3 where it performs heat exchange to be evaporated and gasified. The refrigerant thus gasified is inspired into the compressor 1 through the first four way reversing valve 2 and the accumulator 4.

On the other hand, the refrigerant in the second branch joint 11 which has carried out heat exchange and cooled at the first heat exchanging portion 19, the second heat exchanging portion 16*a*, and the third heat exchanging portions 16*b*, 16*c* and 16*d* to obtain sufficient subcooling flows into the indoor unit D which is expected to cool the room. At that time, the second flow controller 13 is in a predetermined minimum valve setting in a normal state.

Fourthly, the case wherein cooling is principally performed in cooling and heating concurrent operation will be described with reference to FIG. 24.

In FIG. 24, arrows of solid lines indicate the flow of the refrigerant. The compressor 1 has capacity controlled so that a temperature detected by the low pressure saturation temperature detector 50 achieves a predetermined value. The refrigerant which has been discharged from the compressor 1 and been a gas having high temperature under high pressure flows into the outdoor heat exchanger 3 through the reversing valve 2, and carries out heat exchange in the outdoor heat exchanger 3 to take a gas-liquid two phase state having high temperature under high pressure. Then the refrigerant passes through the third check valve 32 and the second main pipe 7, and is forwarded to the gas-liquid separator 12 in the junction device E. The refrigerant is separated into a gaseous refrigerant and a liquid refrigerant there, and the gaseous refrigerant thus separated flows through the first branch joint 10, and the three way switching valve 8 and the first branch pipe 6*d* which are connected to the indoor unit D, in that order, the indoor unit D being expected to heat the room with the indoor unit D installed in it. The refrigerant flows into the indoor unit D, and carries out heat exchange with indoor air to-be condensed and liquefied, thereby heating the room. In addition, the refrigerant passes through the first flow controller 9 connected to the heating indoor unit D, this first flow controller 9 being almost fully opened under control based on degree of subcooling at the refrigerant outlet of the indoor heat exchanger 5 of the heating indoor unit D. The refrigerant is slightly depressurized by this first flow controller 9, and flows into the second branch joint 11. On the other hand, the remaining liquid refrigerant enters the second branch joint 11 through the second flow controller 13 which is controlled based on pressures detected by the first pressure detector 25 and the second pressure detector 26. Then the refrigerant joins there with the refrigerant which has passed through the heating indoor unit D. The refrigerant thus joined passes through the second branch joint 11, and then the second branch pipes 7*b* and 7*c*, respectively, and enters the respective indoor units B and C. The refrigerant which has flowed into the indoor units B and C is depressurized to low pressure by the first flow controllers 9 of the indoor units B and C, these first flow controllers 9 being controlled based on degree of superheat at the refrigerant outlets of the corresponding indoor heat exchangers 5. Then the refrigerant flows into the indoor heat exchangers 5, and carries out heat exchange with indoor air to be evaporated and gasified, thereby cooling the rooms. In addition, the refrigerant thus gasified passes through the first branch pipes 6*b* and 6*c*, the three way switching valves 8, and the first branch joint 10. Then the refrigerant is inspired into compressor 1 through the first main pipe 6, the fourth check valve 33, the four way reversing valve 2 in the heat source device A, and the accumulator 4. In this way, a circulation cycle is formed to carry out the cooling and heating concurrent operation wherein cooling is principally performed. In this mode, the three way switching valves 8 which are connected to the indoor units B and C have the first ports 8*a* closed, and the second and third ports 8*b* and 8*c* opened. The three way switching valve 8 which is connected to the indoor unit D has the second port 8*b* closed, and the first and third ports 8*a* and 8*c* opened.

At that time, the first main pipe 6 is at low pressure in it, and the second main pipe 7 is a high pressure in it, which necessarily causes the third check valve 32 and the fourth check valve 33 to conduct for the refrigerant.

In this circulation cycle, the liquid refrigerant partly enters the bypass pipe 14 from the confluent portion of the second branch joint 11 where the second branch pipes 7*b*, 7*c* and 7*d* join together. The liquid refrigerant which has entered into the bypass pipe 14 is depressurized to low pressure by the third flow controller 15. The refrigerant thus depressurized carried out heat exchange with the refrigerant in the second branch pipes 7*b*, 7*c* and 7*d* at the third heat exchanging portions 16*b*, 16*c* and 16*d*, and at the second heat exchanging portion 16*a* with the refrigerant in the confluent portion of the second branch pipes 7*b*, 7*c* and 7*d* in the second branch joint 11, and at the first heat exchanging portion 19 with the refrigerant which flows into the second flow controller 13. The refrigerant is evaporated by such heat exchange, and enters the first main pipe 6. The refrigerant which has entered the first main pipe 6 is inspired into the compressor 1 through the fourth check valve 33, the four way reversing valve 2 in the heat source device A, and the accumulator 4.

On the other hand, the refrigerant in the second branch joint 11 which has carried out heat exchange and cooled at the first heat exchanging portion 19, the second heat exchanging portion 16*a*, and the third heat exchanging portions 16*b*, 16*c* and 16*d* to obtain sufficient subcool flows into the indoor units B and C which are expected to carry out cooling.

Figure 25:
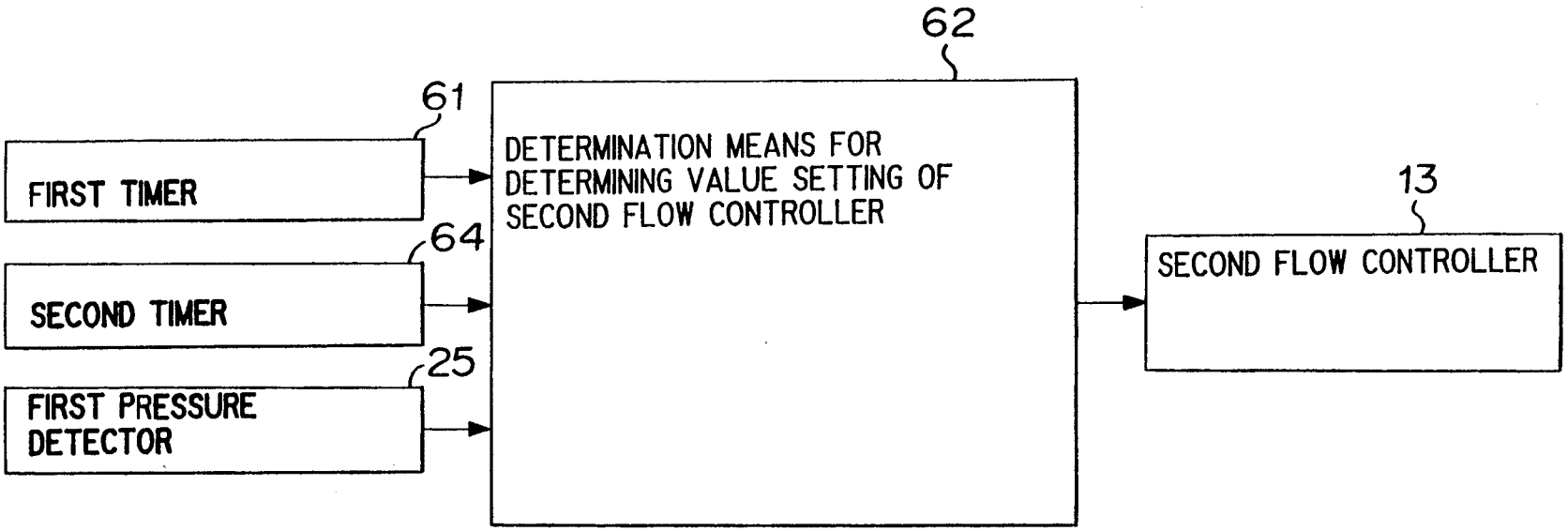
FIG. 25 is a block diagram showing a control for restraining an increase in high pressure according to the fifth embodiment.

A control for restraining a transitional raise in high pressure according to the fifth embodiment which is made in only heating, or cooling and heating concurrent operation with heating principally performed wherein the second flow controller 13 is normally of the predetermined minimum valve setting state will be explained, referring to FIGS. 25 and 26. FIG. 25 is a block diagram showing the-control according to the fifth embodiment. FIG. 26 is a flowchart showing the control according to the fifth embodiment.

In FIG. 25, reference numeral 61 designates a first timer which measures a duration that has lapsed since the previous control was made, thereby periodically carrying out the valve setting control of the second flow controller 13. The first timer is cleared whenever the compressor 1 starts working or the valve setting control of the second flow controller 13 is made.

Reference numeral 62 designates determination means for determining the valve setting of the second flow controller 13 based on a pressure detected by the first pressure detector 25 and a signal from the first timer.

Reference numeral 64 designates a second timer which measures how long it has taken since the previous control was made.

The second timer is cleared whenever the compressor 1 starts working or the control for restraining a raise in high pressure is made.

A control flow according to the fifth embodiment will be explained, referring to FIG. 26. At Step 71, it is determined whether a pressure detected by the first pressure detector 25 is a predetermined value or above. If affirmative, the program proceeds to Step 78. If negative, the program proceeds to Step 72.

At Step 78, it is determined whether the duration measured by the second timer 64 is a predetermined duration B or above. If negative, the program proceeds to Step 72. If affirmative, the program proceeds to Step 79.

At Step 79, the time data in the second timer 64 is cleared, and the program proceeds to Step 76.

At Step 76, the valve setting of the second flow controller 13 is opened by a predetermined value a, and the program proceeds to Step 77.

At Step 72, it is determined whether the duration measured by the first timer 61 is a predetermined duration A or above. If affirmative, the program proceeds to Step 73. If negative, the program returns to Step 71.

At Step 73, it is determined whether the valve setting of the second flow controller 13 is the predetermined minimum valve setting. If affirmative, the program proceeds to Step 77. If negative, the program proceeds to Step 74.

At Step 74, the valve setting of the second flow controller 13 is closed by a predetermined value b which is smaller than the predetermined value a at Step 76. The program proceeds to Step 77.

At Step 77, the timer data in the first timer 61 is cleared, and the program returns to Step 71.

In accordance with the fifth embodiment, when the high pressure is transitionally raised in only heating, or cooling and heating concurrent operation with heating principally performed, the bypass passage which extends from the second main pipe to the first main pipe through the second and third flow controllers in the junction device can be expanded by increasing the valve setting of the second flow controller. As a result, pressure loss in passage can be decreased to facilitate the flow of the refrigerant, thereby lowering the high pressure.

EMBODIMENT 6

A sixth embodiment of the present invention will be described.

Figure 27:
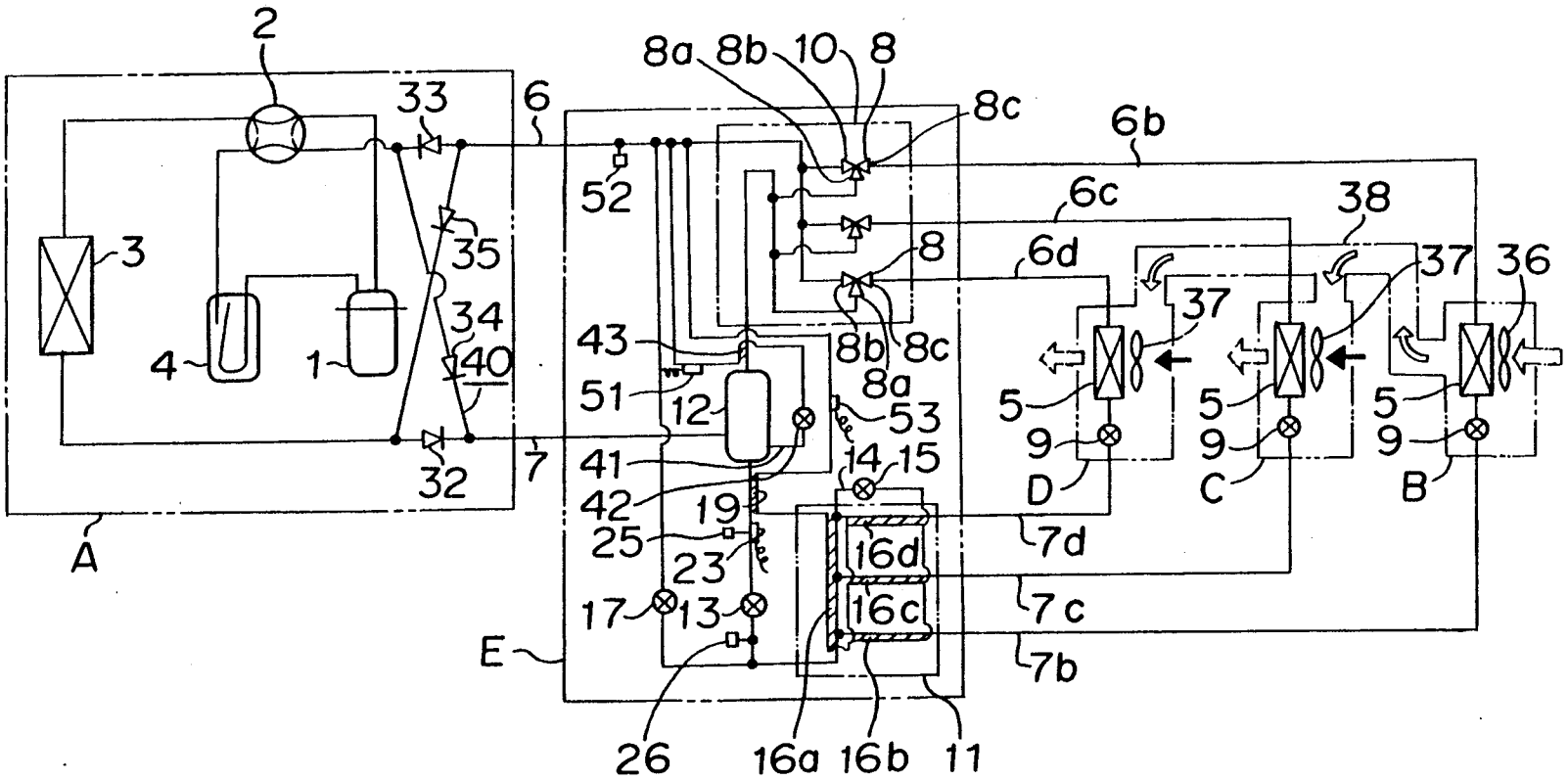
FIG. 27 is a schematic diagram showing the entire structure of a sixth embodiment which is depicted on the basis of the refrigerant system of the apparatus.
Figure 28:
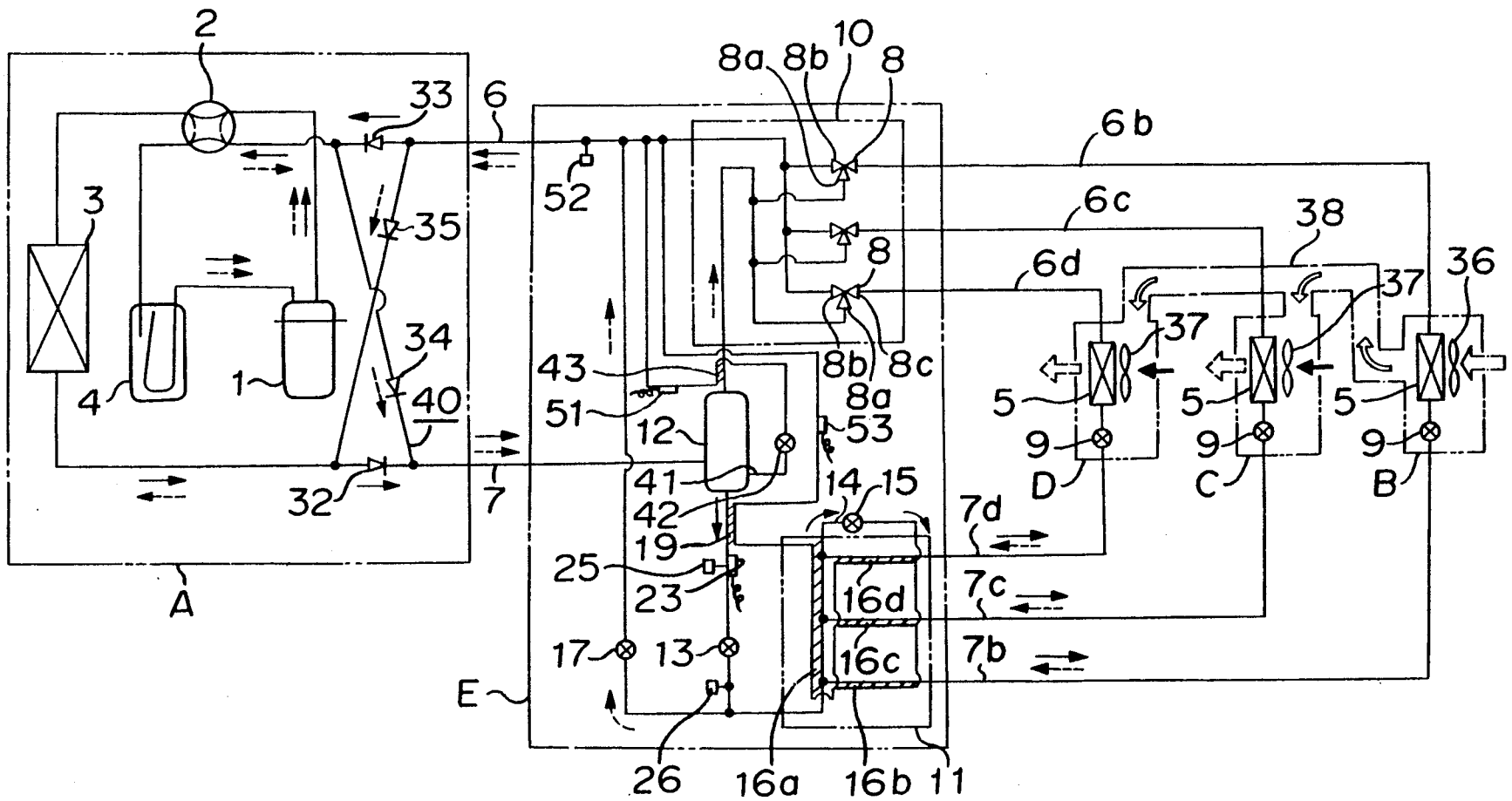
FIG. 28 is a schematic diagram showing the operation states of the sixth embodiment of FIG. 27 wherein solo cooling or solo heating is performed.
Figure 29:
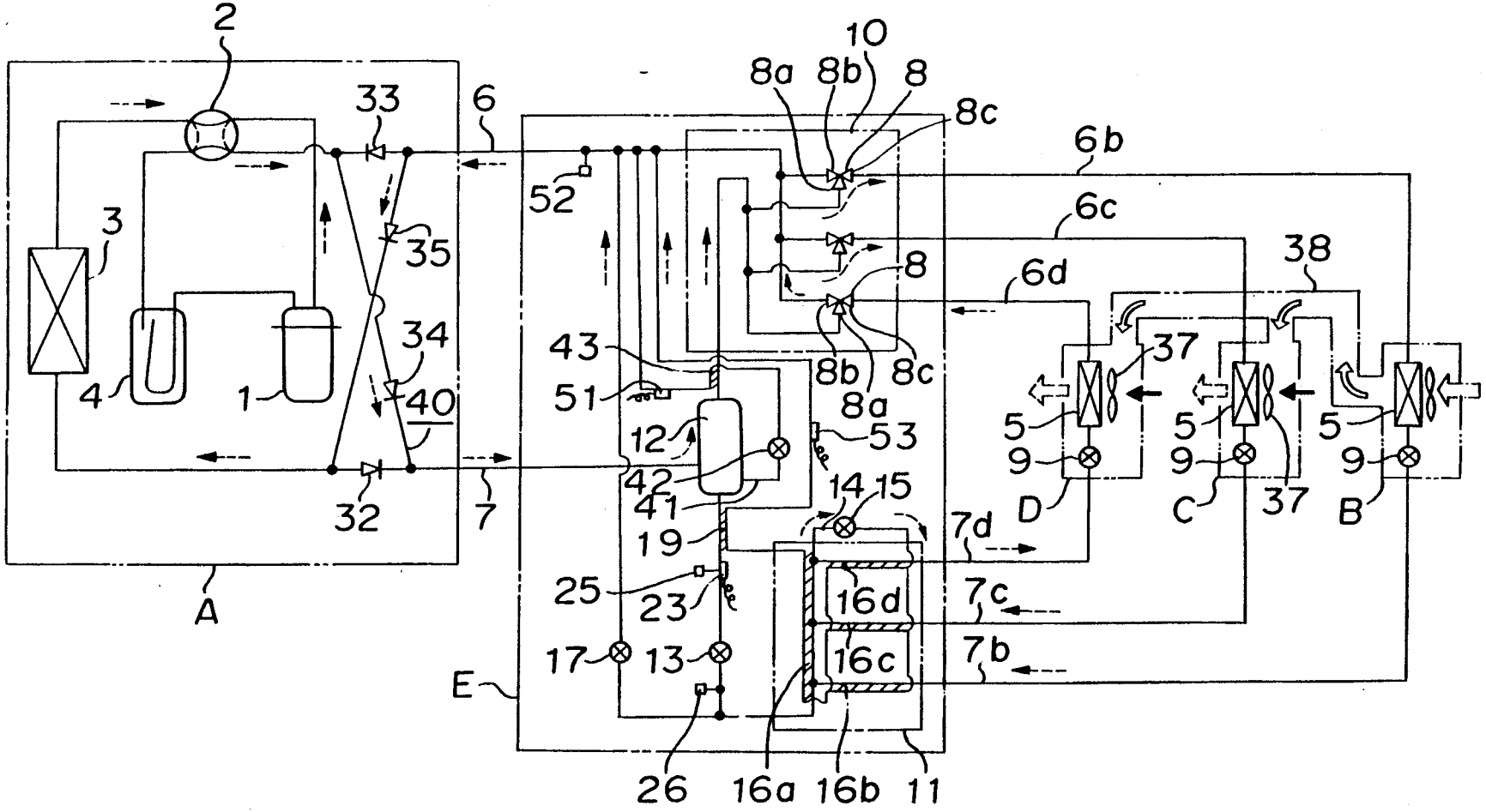
FIG. 29 is a schematic diagram showing the operation state of the sixth embodiment of FIG. 27 wherein heating is principally performed under cooling and heating concurrent operation.
Figure 30:
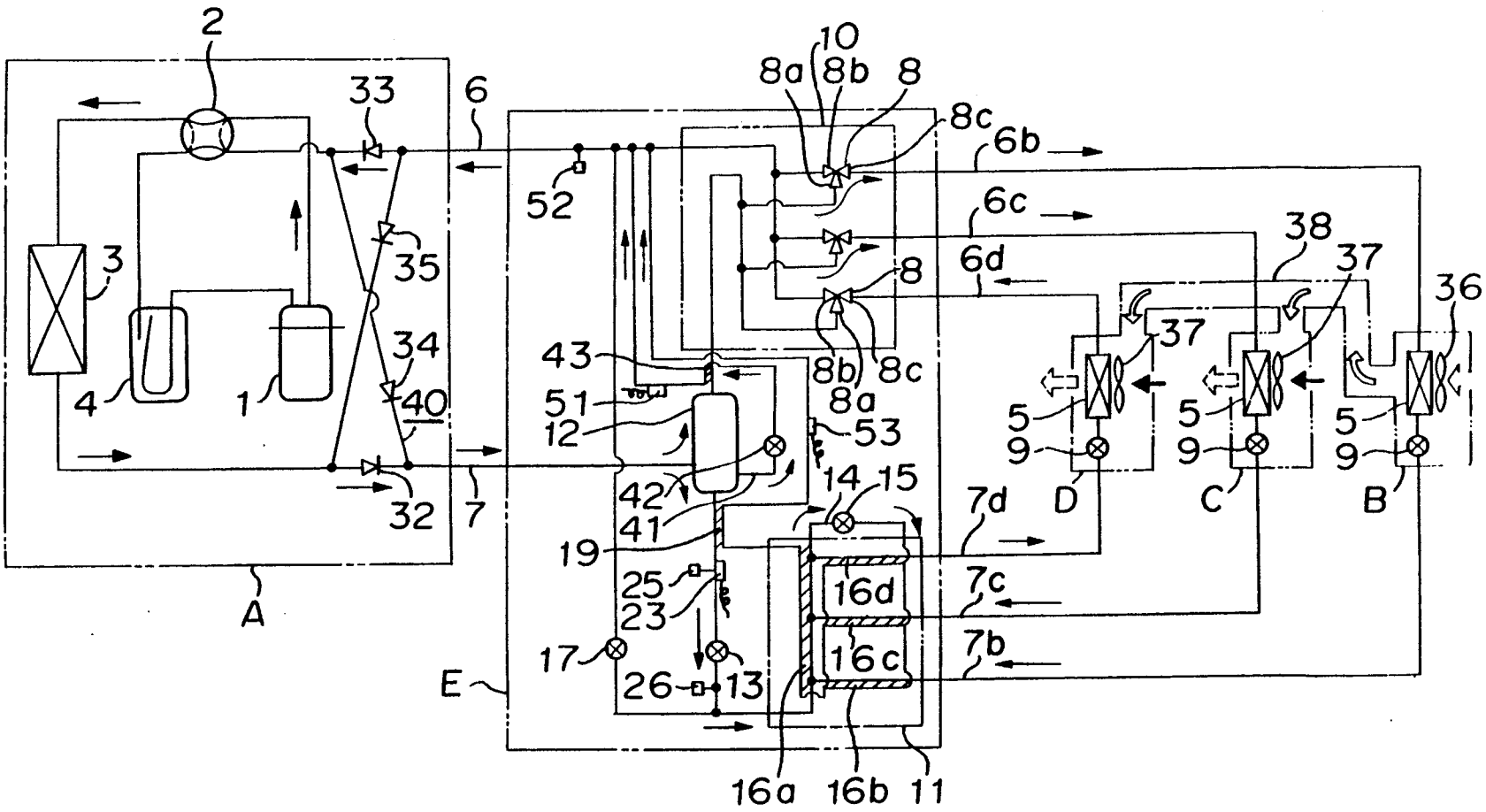
FIG. 30 is a schematic diagram showing the operation' state of the sixth embodiment of the FIG. 27 wherein cooling is principally performed under cooling and heating concurrent operation.

FIG. 27 is a schematic diagram of the entire structure of the sixth embodiment of the air conditioning apparatus according to the present invention, which is depicted on the basis of the refrigerant system of the apparatus. FIGS. 28 to 30 are schematic diagram showing the operation states in cooling or heating in the sixth embodiment of FIG. 27; FIG. 28 being a schematic diagram showing the operation states wherein solo operation on cooling or solo operation on heating is performed; and FIGS. 29 and 30 being schematic diagrams showing the operation states in cooling and heating concurrent operation, FIG. 29 being a schematic diagram showing the operation state wherein heating is principally performed under cooling and heating concurrent operation (total heating load is greater than total cooling load), and FIG. 30 being a schematic diagram showing the operation state wherein cooling is principally performed under cooling and heating concurrent operation (total cooling load is greater than total heating load).

Although explanation on the embodiment will be made in reference to the case wherein a single outdoor unit as a heat source device is connected to three indoor units, the explanation is also applicable to the case wherein the outdoor unit is connected to two or more indoor units.

In FIG. 27, reference A designates an outdoor unit as a heat source device. Reference B designates a first indoor unit, and references C and D designate second indoor units. The indoor units B, C and D which are connected in parallel as described later and have the same structure as each other in terms of a refrigeration cycle. Reference E designates a junction device which includes a first branch joint 10, a second flow controller 13, a second branch joint 11, a gas-liquid separator 12, and first and second exchanging portions 19 and 16*a*, as described later.

Reference numeral 1 designates a compressor. Reference numeral 2 designates a four port reversing valve which can switch the flow direction of a refrigerant in the heat source device. Reference numeral 3 designates an outdoor heat exchanger which is installed on the side of the heat source device. Reference numeral 4 designates an accumulator-which is connected to the devices 1-3 to constitute the heat source device A. Reference numeral 5 designates the indoor heat exchangers of the first and second indoor units B, C and D. Reference numeral 6 designates a first main pipe which has a large diameter and which connects the four way reversing valve 2 of the heat source device A and the junction device E. Reference numerals 6*b*, 6*c* and 6*d* designate first branch pipes which connect the junction device E and the indoor heat exchangers 5 of the respective indoor units B, C and D, and which correspond to the first main pipe 6. Reference numeral 7 designates a second main pipe which has a smaller diameter than the first main pipe 6, and which connects the junction device E and the outdoor heat exchanger 3 of the heat source device A. Reference numerals 7*b*, 7*c* and 7*d* designate second branch pipes which connect the junction device E and the indoor heat exchangers 5 of the respective indoor units B, C and D, and which correspond to the second main pipe 7. Reference numeral 8 designates three way switching valves which can selectively connect the first branch pipes 6*b*, 6*c* and 6*d* to either the first main pipe 6 or the second main pipe 7. Reference numeral 9 designates the first flow controllers which are connected to the respective indoor heat exchangers 5 in close proximity to the same, which are controlled based on degree of superheat in cooling and on degree of subcooling in heating at refrigerant outlet sides of the respective indoor heat exchangers, and which are connected to the second branch pipes 7*b*, 7*c* and 7*d*, respectively. Reference numeral 10 designates the first branch joint which includes the three way switching valves 8 which can selectively the first branch pipes 6*b*, 6*c* and 6*d* to either the first main pipe 6 or the second main pipe 7. Reference numeral 11 designates the second branch joint which includes the second branch pipes 7*b*, 7*c* and 7*d*, and the second main pipe 7. Reference numeral 12 designates the gas-liquid separator which is arranged in the second main pipe 7, and which has a gas phase zone connected to first ports 8*a* of the respective switching valves 8 and a liquid phase zone connected to the second branch joint 11. Reference numeral 13 designates the second flow controller which is connected between the gas-liquid separator 12 and the second branch joint 11, and which can be selectively opened and closed. Reference numeral 14 designates a bypass pipe which connects the second branch joint 11 to the first main pipe 6. Reference numeral 15 designates the third flow controller which is arranged in the bypass pipe 14. Reference numerals 16*b*, 16*c* and 16*d* designate third heat exchanging portions which are arranged in the bypass pipe 14 downstream of the third flow controller 15, and which carry out heat exchange with the respective second branch pipes 7*b*, 7*c* and 7*d* in the second branch joint 11. Reference numeral 16*a* designates the second heat exchanging portion which is arranged in the bypass pipe 14 downstream of the third flow controller 15 and the third heat exchanging portions 16*b*, 16*c* and 16*d*, and which carries out heat exchanging with the confluent portion where the second branch pipes 7*b*, 7*c* and 7*d* join in the second branch joint. Reference numeral 19 designates the first heat exchanging portion which is arranged in the bypass pipe 14 downstream of the third flow controller 15 and the second heat exchanging portion 16*a*, and which carries out heat exchanging with a pipe which connects between the gas-liquid separator 12 and the second flow controller 13. Reference numeral 17 designates the fourth flow controller which is arranged in a pipe between the second branch joint 11 and the first main pipe 6, and which can be selectively opened and closed. Reference numeral 32 designates a third check valve which is arranged between the outdoor heat exchanger 3 and the second main pipe 7, and which allows a refrigerant only to flow from the outdoor heat exchanger 3 to the second main pipe 7. Reference numeral 33 designates a fourth check valve which is arranged between the four way reversing valve 2 of the heat source device A and the first main pipe 6, and which allows the refrigerant only to flow from the first main pipe 6 to the reversing valve 2. Reference numeral 34 designates a fifth check valve which is arranged between the reversing valve 2 and the second main-pipe 7, and which allows the refrigerant only to flow from the reversing valve 2 to the second main pipe 7. Reference numeral 35 designates a sixth check valve which is arranged between the outdoor heat exchanger 3 and the first main pipe 6, and which allows the refrigerant only to flow from the first main pipe 6 to the outdoor heat exchanger 3. These check valves 32-35 constitute a switching valve arrangement 40.

Reference numeral 41 designates a liquid purging pipe which has one end connected to the gas-liquid separator 12 and the other end connected to the first main pipe 6. Reference numeral 42 designates a fifth flow controller which is arranged in the liquid purging pipe 41 between the gas liquid separator 12 and the first main pipe 6. Reference numeral 43 designates a fourth heat exchanging portion which is arranged in the liquid purging pipe 41 downstream of the fifth flow controller 42, and which carries out heat exchange with a pipe connecting between the gas-liquid separator 12 and the first branch joint 10.

Reference numeral 23 designates a first temperature detector which is attached to the pipe connecting between the second flow controller 13 and the first heat exchanging portion 19. Reference numeral 25 designates a first pressure detector which is attached to the same pipe as the first temperature detector 23. Reference numeral 26 designates a second pressure detector which is attached to the pipe connecting the second flow controller 13 and the second branch joint 11. Reference numeral 52 designates a third pressure detector which is attached to the pipe connecting between the first main pipe 6 and the first branch joint 10. Reference numeral 51 designates a second temperature detector which is attached to the liquid purging pipe 41 at a refrigerant outlet of the fourth heat exchanging portion 43. Reference numeral 53 designates a third temperature detector which is attached to the bypass pipe 14 at a refrigerant outlet of the first heat exchanging portion 19.

The first indoor unit B can be constructed so that, for e.g. aiming at ventilating, outdoor air is introduced, and be caused to pass through the indoor heat exchanger 5 of the first indoor unit B, and then the air as primary air is supplied to the indoor heat exchangers 5 of the second indoor units C and D.

Reference numeral 36 designates a fan for introducing the outdoor air, which introduces the outdoor air, causes the outdoor air to pass through the indoor heat exchanger 5 of the first indoor unit B, and supplies the air to the second indoor units C and D. Reference numeral 37 designates fans which are arranged in the second indoor units C and D, and which introduces the indoor air, and causes the indoor air to pass through the indoor heat exchangers 5 of the second indoor units C and D to circulate the indoor air. Reference numeral 38 designates an air path which is arranged to supply the second indoor units C and D with the air that has passed through the indoor heat exchanger 5 of the first indoor unit B.

The flow of the outdoor air which is introduced into the first indoor unit B is indicated by a white arrow of a chain line. The flow of the air which is supplied from the first indoor unit B to the second indoor units C and D is indicated by white arrows of solid lines. The flow of the indoor air which is introduced into the second indoor units C and D is indicated by black arrows. The flow of the air which is supplied indoors from the second indoor units C and D is indicated by white arrows of broken lines.

The operation of the sixth embodiment as constructed above will be explained.

Firstly, the case wherein only cooling is performed will be explained with reference to FIG. 28.

In this case, the flow of the refrigerant is indicated by arrows of solid line. The refrigerant gas which has discharged from the compressor 1 and had high temperature under high pressure passes through the four way reversing valve 2, and is heat exchanged and condensed in the outdoor heat exchanger 3. Then, the refrigerant passes through the third check valve 32, the second main pipe 7, the separator 12 and the second flow controller 13 in that order. The refrigerant further passes through the second branch joint 11 and the second branch pipes *7b*, *7c* and *7d*, and enters the indoor units B, C and D. The refrigerant which has entered the indoor units B, C and D is depressurized to low pressure by the first flow controllers 9 which are controlled based on degree of superheat at the outlets of the respective indoor heat exchanger 5. In the indoor heat exchangers 5, the refrigerant thus depressurized carries out heat exchanging with air to be evaporated and gasified, thereby cooling the rooms. The refrigerant so gasified passes through the first branch pipes *6b*, *6c* and *6d*, the three way switching valves 8, and the first branch joint 10. Then the refrigerant is inspired into the compressor 1 through the first main pipe 6, the fourth check valve 33, the four way reversing valve 2, and the accumulator 4. In this way, a circulation cycle is formed to carry out cooling. At this mode, the three way switching valves 8 have the first ports *8a* closed, and second ports *8b* and third ports *8c* opened. At the time, the first main pipe 6 is at low pressure in it, and the second main pipe 7 is at high pressure in it, which necessarily make the third check valve 32 and the fourth check valve 33 to conduct for the refrigerant. In addition, in this mode, the refrigerant, which has passed through the second flow controller 13, partly enters the bypass pipe 14 where the entered part of the refrigerant is depressurized to low pressure by the third flow controller 15. The refrigerant thus depressurized carries out heat exchanging with the second branch pipes *7b*, *7c* and *7d* at the third heat exchanging portions 16*b* 16*c* and 16*d*, with the confluent portion of the second branch pipes *7b*, *7c* and *7d* at the second heat exchanging portion 16*a* in the second branch joint 11, and at the first heat exchanging portion 19 with the refrigerant which enters the second flow controller 13. The refrigerant is evaporated due to such heat exchanging, and enters the first main pipe 6 and the fourth check valve 33. Then the refrigerant is inspired into the compressor 1 through the first four way reversing valve 2 and the accumulator 4.

On the other hand, the refrigerant, which has heat exchanged at the first heat exchanging portion 19, the second heat exchanging portion 16*a*, and the third heat exchanging portions 16*b*, 16*c* and 16*d*, and has been cooled so as to get sufficient subcooling, enters the indoor units B, C and D which are expected to carry out cooling.

In cooling, when the amount of the refrigerant which is sealed in the air conditioning apparatus is not enough to fill the second main pipe 7 with a liquid refrigerant having high pressure, the refrigerant which has been condensed in the outdoor heat exchanger 3 and has a two phase state under high pressure passes through the second main pipe 7 and the gas-liquid separator 12. Then the two phase refrigerant carries out heat exchange, at the first heat exchanging portion 19, at the second heat exchanging portion 16*a*, and at the third heat exchanging portions 16*b*, 16*c* and 16*d*, with the refrigerant which has been depressurized to low pressure by the third flow controller 15 and flows through the bypass pipe. The refrigerant which has left the gas-liquid separator 12 is liquefied and cooled due to such heat exchange to obtain sufficient supercooling, and flows into the first and second indoor units B, C and D which are expected to carry out cooling.

Secondly, the case wherein only heating is performed will be described with reference FIG. 28. In this case, the flow of the refrigerant is indicated by arrows of dotted line.

The refrigerant which has been discharged from the compressor 1 and been a gas having high temperature under high pressure passes through the four way reversing valve 2, the fifth check valve 34, the second main pipe 7, and the gas-liquid separator 12. Then the refrigerant passes through the first branch joint 10, the three way switching valves 8, and the first branch pipes 6*b*, 6*c* and 6*d* in that order. After that, the refrigerant enters the first and second indoor units B, C and D where the refrigerant carries out heat exchanging with indoor air. The refrigerant is condensed to be liquefied due to such heat exchanging, thereby heating the rooms. The refrigerant thus liquefied passes through the first flow controllers 9 which are controlled based on degree of subcooling at the refrigerant outlets of the respective indoor heat exchangers 5. Then the refrigerant enters the second branch joint 11 through the second branch pipes 7*b*, 7*c* and 7*d*, and joins there. Then the joined refrigerant passes through the fourth flow controller 17. The refrigerant is depressurized by either the first flow controllers 9 or the fourth flow controller 17 to take a two phase state having low pressure. The refrigerant thus depressurized enters the outdoor heat exchanger 3 through the first main pipe 6 and the sixth check valve 35, and carries out heat exchanging to be evaporated and gasified. The refrigerant thus gasified is inspired into the compressor 1 through the four way reversing valve 2, and the accumulator 4. In this way, a circulation cycle is formed to carry out room heating. In this mode, the switching valves 8 have the second ports 8*b* closed, and the first and the third ports 8*a* and 8*c* opened.

In this mode, the first main pipe 6 is at low pressure in it, and the second main pipe 7 is at high pressure in it, which necessarily causes the fifth check valve 34 and the sixth check valve 35 to conduct for the refrigerant.

Thirdly, the case wherein heating is principally performed in cooling and heating concurrent operation will be explained with reference to FIG. 29.

Explanation will be made for the case wherein the first indoor unit B and the second indoor unit C are expected to carry out heating, and the second indoor unit D is expecting to carry out cooling. In FIG. 29, arrows of dotted line indicate the flow of the refrigerant. The refrigerant which has been discharged from the compressor 1, and been a gas having high temperature under high pressure passes through the four way reversing valve 2, and then reaches the junction device E through the fifth check valve 34 and the second main pipe 7. The refrigerant flows through the gas-liquid separator 12. In addition, the refrigerant passes through the first branch joint 10, the three way switching valves 8 connected to the first and second indoor units B and C, and the first branch pipes 6*b* and 6*c* in that order, and enters the indoor units B and C which are expected to carry out heating. The refrigerant which has flowed into the heating indoor units B and C carries out heat exchange with air in the corresponding indoor heat exchangers to be condensed and liquefied, thereby heating the room(s). The refrigerant thus liquefied passes through the first flow controllers 9 of the indoor units B and C, the first controllers 9 of the indoor units B and C being almost fully opened under control based on degree of subcooling at the refrigerant outlets of the corresponding indoor heat exchangers 5. The refrigerant is slightly depressurized by these first flow controllers 9 to have a pressure (medium pressure) intermediate between high pressure and low pressure, and flows into the second branch joint 11 through the second branch pipes 7*b* and 7*c*. After that, a part of the refrigerant passes through the second branch pipe 7*d* of the second indoor unit D which is expected to carry out cooling, and enters the indoor unit D. The refrigerant flows into the first flow controller 9 of the indoor unit D, the first flow controller 9 being controlled based on degree of superheat at the refrigerant outlet of the corresponding indoor heat exchanger 5. After the refrigerant is depressurized by this first flow controller 9, it enters the indoor heat exchanger 5, and carries out heat exchange to be evaporated and gasified, thereby cooling the room. Then the refrigerant enters the first main pipe 6 through the three way switching valve 8 which is connected to the indoor unit D.

On the other hand, another part of the refrigerant passes through the second branch joint 11, and through the fourth flow controller 17 which is controlled so that a difference between the high pressure in the second main pipe 7 and the medium pressure in the second branch joint 11 falls into a predetermined range. Then the refrigerant joins with the refrigerant which has passed the indoor unit D which is expected to carry out cooling. After that, the refrigerant thus joined passes through the first main pipe 6 having such a larger diameter, and the sixth check valve 35, and enters the outdoor exchanger 3 where the refrigerant carries out heat exchange to be evaporated and gasified. The refrigerant thus gasified is inspired into the compressor 1 through the reversing valve 2 and the accumulator 4. In this way, a circulation cycle is formed to carry out the cooling and heating concurrent operation wherein heating is principally performed. At this time, the difference between the evaporation pressure in the indoor heat exchanger 5 of the cooling second indoor unit D and that of the outdoor heat exchanger 3 lessens because of switching to the first main pipe 6 having such a greater diameter. At that time, the three port switching valves which are connected to the heating indoor units B and C have the second ports 8b closed, and the first and third ports 8a and 8c opened. The three port switching valve 8 which is connected to the cooling indoor unit D has the first port 8a closed, and the second port 8b and the third port 8c opened.

In this mode, the first main pipe 6 is at low pressure in it, and the second main pipe 7 is at high pressure in it, which necessarily causes the fifth check valve 34 and the sixth check valve 35 to conduct for the refrigerant. At this circulation cycle, the remaining part of the liquefied refrigerant goes into the bypass pipe 14 from the confluent portion where the second branch pipes 7b and 7c join together. The refrigerant which has gone into the bypass pipe 14 is depressurized to low pressure by the third-flow controller 15. The refrigerant thus depressurized carries out heat exchange with the refrigerant in the confluent portion of the second branch pipes 7b and 7c in the second branch joint 11 at the second heat exchanging portion 16a, and at the first heat exchanging portion 19 with the refrigerant which flows into the second flow controller 13. The refrigerant is evaporated by such heat exchange, and enters the first main pipe 6. After that, the refrigerant flows into the sixth check valve 35 and then into the outdoor heat exchanger 3 where it performs heat exchange to be evaporated and gasified. The refrigerant thus gasified is inspired into the compressor 1 through the four way reversing valve 2 and the accumulator 4.

On the other hand, the refrigerant in the second branch joint 11 which has carried out heat exchange and cooled at the first heat exchanging portion 19, the second heat exchanging portion 16a, and the third heat exchanging portions 16b, 16c and 16d to obtain sufficient subcooling flows into the cooling indoor unit D.

Fourthly, the case wherein cooling is principally performed in cooling and heating concurrent operation will be described with reference to FIG. 30. Explanation will be made for the case wherein the first indoor unit B and the second indoor unit C are expected to carry out heating, and the second indoor unit D is expecting to carry out cooling, and wherein the second indoor unit D has greater cooling load than the total heating load of the first and second indoor units B and C.

In FIG. 30, arrows of solid lines indicate the flow of the refrigerant. The refrigerant which has been discharged from the compressor 1 and been a gas having high temperature under high pressure flows into the outdoor heat exchanger 3 through the reversing valve 2, and carries out heat exchange at an arbitrary amount in the outdoor heat exchanger 3 to take a gas-liquid two phase state having high temperature under high pressure. Then the refrigerant passes through the third check valve 32 and the second main pipe 7, and is forwarded to the gas-liquid separator 12 in the junction device E. The refrigerant is separated into a gaseous refrigerant and a liquid refrigerant there, and the gaseous refrigerant thus separated flows through the first branch joint 10, and the three way switching valve 8 and the first branch pipes 6b and 6c which are connected to the indoor units B and C, in that order, the indoor units B and C being expected to carry out heating. The refrigerant flows into the indoor units B and C, and carries out heat exchange with air to be condensed and liquefied, thereby heating the rooms. In addition, the refrigerant passes through the first flow controllers 9 connected to the heating indoor units, this first flow controller 9 being almost fully opened under control based on degree of subcooling at the refrigerant outlets of the indoor heat exchanger 5 of the heating indoor units B and C. The refrigerant is slightly depressurized by this first flow controllers 9 to have a pressure (medium pressure) intermediate between high pressure and low pressure, and flows into the second branch joint 11. On the other hand, the remaining liquid refrigerant enters the second branch joint 11 through the second flow controller 13 which is controlled so that a difference between the high pressure and the medium pressure is kept constant. Then the refrigerant joins there with the refrigerant which has passed through the heating indoor units B and C. The refrigerant thus joined passes through the second branch joint 11, and then the second branch pipe 7d, and enters the indoor unit D. The refrigerant which has flowed into the indoor unit D is depressurized to low pressure by the first flow controller 9 of the indoor unit D, the first flow controller 9 being controlled based on degree of superheat at the refrigerant outlet of the corresponding indoor heat exchanger 5. Then the refrigerant flows into the indoor heat exchanger 5, and carries out heat exchange with indoor air to be evaporated and gasified, thereby cooling the room. In addition, the refrigerant thus gasified passes through the first branch pipe 6d, the three way switching valve 8 connected to the indoor unit D, and the first branch joint 10. Then the refrigerant is inspired into compressor 1 through the first main pipe 6, the fourth check valve 33, the four way reversing valve 2, and the accumulator 4. In this way, a circulation cycle is formed to carry out the cooling and heating concurrent operation wherein cooling is principally performed. In this mode, the three way switching valve 8 which is connected to the indoor unit D has the first port 8a closed, and the second and third ports 8b and 8c opened. The three way switching valves 8 which are connected to the indoor units B and C have the second ports 8b closed, and the first and third ports 8a and 8c opened.

At that time, the first main pipe 6 is at low pressure in it, and the second main pipe 7 is a high pressure in it, which necessarily causes the third check valve 32 and the fourth check valve 33 to conduct for the refrigerant.

In this circulation cycle, the liquid refrigerant partly enters the bypass pipe 14 from the confluent portion where the second branch pipes 7b and 7c join together. The liquid refrigerant which has entered into the bypass pipe 14 is depressurized to low pressure by the third flow controller 15. The refrigerant thus depressurized carries out heat exchange at the second heat exchanging portion 16a with the refrigerant in the confluent portion of the second branch pipes 7b and 7c in the second branch joint 11, and at the first heat exchanging portion 19 with the refrigerant which flows into the second flow controller 13. The refrigerant is evaporated by such heat exchange, and enters the first main pipe 6. The refrigerant which has entered the first main pipe 6 is inspired into the compressor 1 through the fourth check valve 33, the four way reversing valve 2, and the accumulator 4.

On the other hand, the refrigerant in the second branch joint 11 which has carried out heat exchange and cooled at the first heat exchanging portion 19, the second heat exchanging portion 16a, and the third heat exchanging portions 16b, 16c and 16d to obtain sufficient subcool flows into the indoor unit D which is expected to carry out cooling.

When the liquid level at which the gaseous refrigerant and the liquid refrigerant separated in the gas-liquid separator 12 are divided is located below the liquid purging pipe 41 in the gas-liquid separator 12, the gaseous refrigerant flows into the liquid purging pipe 41, and is depressurized to low pressure by the fifth flow controller 42. At that time, the amount of the refrigerant which flows through the fifth flow controller 42 is small because the refrigerant is in the form of gas at the inlet of the fifth flow controller 42. The refrigerant which flows through the liquid purging pipe 41 carries out heat exchange, at the fourth heat exchanging portion 43, with the gaseous refrigerant which is under high pressure and which is going to flow from the gas-liquid separator 12 into the first branch joint 10. The refrigerant in the liquid purging pipe 41 becomes a superheated gas having low pressure due to such heat exchange, and flows into the first main pipe 6.

Conversely, when the liquid level at which the gaseous refrigerant and the liquid refrigerant separated by the gas-liquid separator 12 are divided is located above the liquid purging pipe 41 in the gas-liquid separator 12, the liquid refrigerant flows into the liquid purging pipe 41, and is depressurized to low pressure by the fifth flow controller 42. Because the refrigerant is in the form of liquid at the inlet of the fifth flow controller 42, the amount of the refrigerant which flows through the fifth flow controller 42 is greater in comparison with the case wherein the refrigerant is in the form of gas at the inlet of the fifth flow controller. As a result, even if the refrigerant which flows through the liquid purging pipe 41 carries out heat exchange, at the fourth heat exchanging portion 43, with the gaseous refrigerant which is under high pressure and which is going to flow from the gas-liquid separator 12 into the first branch joint 10, the refrigerant in the liquid purging pipe 41 does not become a superheated gas having low pressure. The refrigerant flows into the first main pipe 6, maintaining a two phase state.

Figure 31:
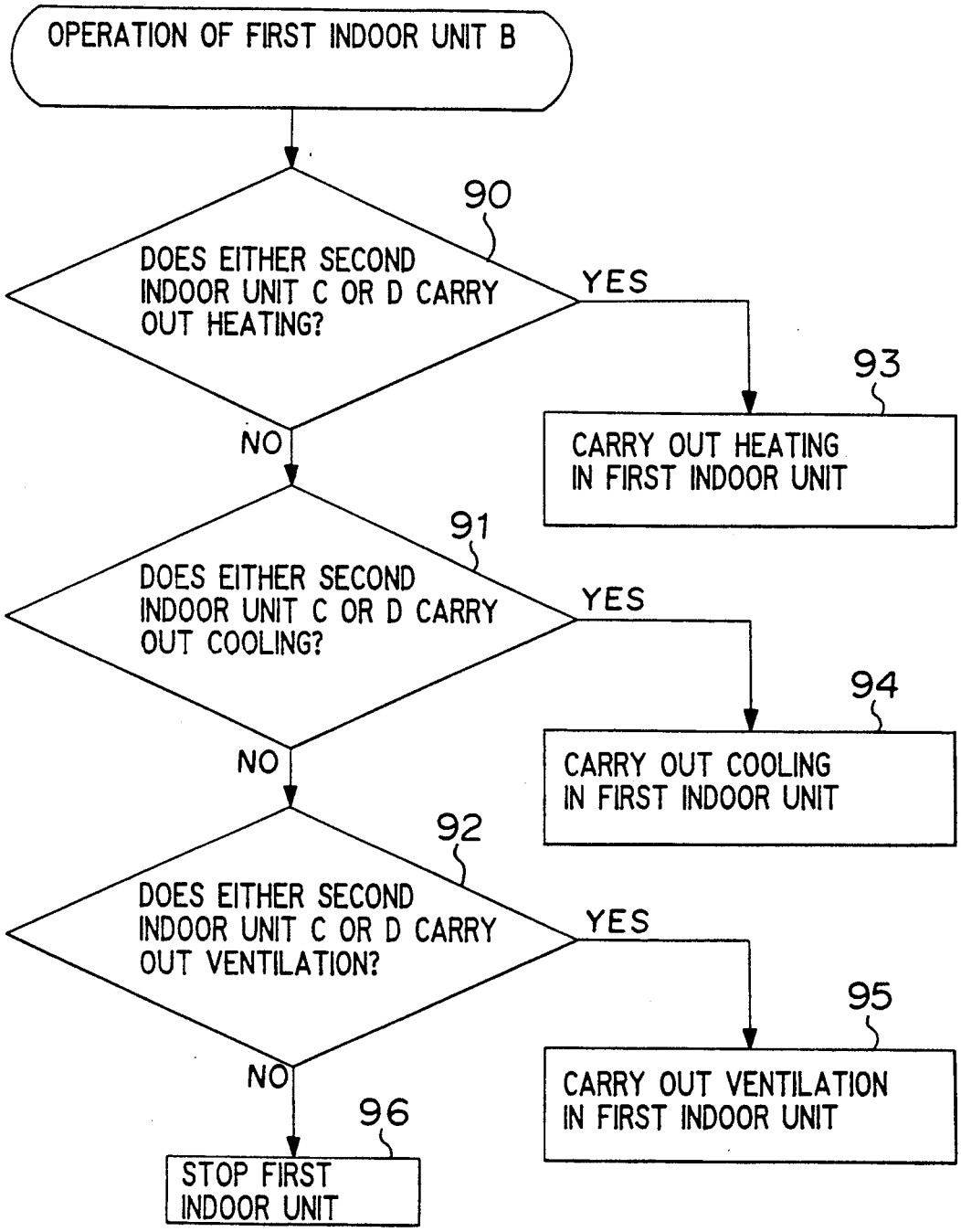
FIG. 31 is a flowchart showing the operation of a first indoor unit in accordance with the sixth embodiment.

An operation of the first indoor unit B will be explained, referring to FIG. 31. At Step 90, it is determined whether either the second indoor unit C or the second indoor unit D is carrying out heating. If affirmative, the program proceeds to Step 93 where the first indoor unit B carries out heating. If none of the second indoor units C and D carry out heating, the program proceeds to Step 91.

At Step 91, it is determined whether either the second indoor unit C or the second indoor unit D carries out cooling. If affirmative, the program proceeds to Step 94 where the first indoor unit B carries out cooling. If none of the second indoor units C and D carry out cooling, the program proceeds to Step 92.

At Step 92, it is determined whether either the second indoor unit C or the second indoor unit D carries out ventilating. If affirmative, the program proceeds to Step 95 where the first indoor unit B carries out ventilation. If none of the second indoor units C or D carry out ventilation, the program proceeds to Step 96 where the first indoor unit B is stopped.

As explained, the first indoor unit B can work or stop in association with the operation or the stoppage of the second indoor units C and D. If at least one of the second indoor units C and D carries out heating, the first indoor unit B carries out heating, outdoor air which has been introduced into the first indoor unit B is heated to e.g. about a room temperature by the indoor heat exchanger 5 of the first indoor unit B, and the heated air is supplied to the second indoor units C and D. In that manner, introduction of the air which has been heated by the first indoor unit B can suppress an increase in the total heating load of the second indoor units C and D. Even if the second indoor unit C carries out heating and the second indoor unit D carries out cooling, outdoor air for which heating load is required can be heated to about a room temperature by the first indoor unit B to suppress an increase in the cooling load of the cooling indoor unit D.

If neither the second indoor unit C nor the second indoor unit D carries out heating and one of them carries out cooling, the first indoor unit B carries out cooling. Outdoor air which has been introduced into the first indoor unit B is cooled at the indoor heat exchanger 5 of the first indoor unit B, and is supplied to the second indoor units C and D. In that case, introduction of the air which has been cooled by the first indoor unit B can suppress an increase in the total cooling load of the second indoor units C and D.

If neither the second indoor unit C nor the second indoor unit D carries out heating or cooling, and one of them carries out ventilation, the first indoor unit B carries out ventilation to introduce outdoor air.

In accordance with the sixth embodiment, when at least one of the second indoor units carries out heating, the first indoor unit carries out heating to heat outdoor air at the indoor heat exchanger of the first indoor unit, and the heated air is supplied to the second indoor units. When none of the second indoor units carries out heating, and at least one of them carries out cooling, the first indoor unit carries out cooling, and the air which has been cooled by the indoor heat exchanger at the first indoor unit is supplied to the indoor heat exchanger of the second indoor units.

If none of the indoor units carry out heating or cooling, and at least of them carries out ventilation, the first indoor unit carries out ventilation.

As explained, the first indoor unit is operated or stopped in association with the operation or stoppage of the second indoor units, outdoor air is introduced in association with the operation or the stoppage of the second indoor units to carry out ventilation, and a sufficient amount of ventilated air can be obtained.

If at least one of the second indoor units carries out heating, the first indoor unit carries out heating. If none of the second indoor units carry out heating, and at least one of them carries out cooling, the first indoor unit carries out cooling. If none of the second indoor units carry out heating or cooling, and at least one of them carries out ventilation, the first indoor unit carries out ventilation. As a result, outdoor air can be previously heated or cooled by the first indoor unit to suppress an increase in heating load or cooling load by introduction of the outdoor air, thereby realizing a stable operation with outdoor air introduced.

EMBODIMENT 7

A seventh embodiment of the present invention will be described.

Figure 32:
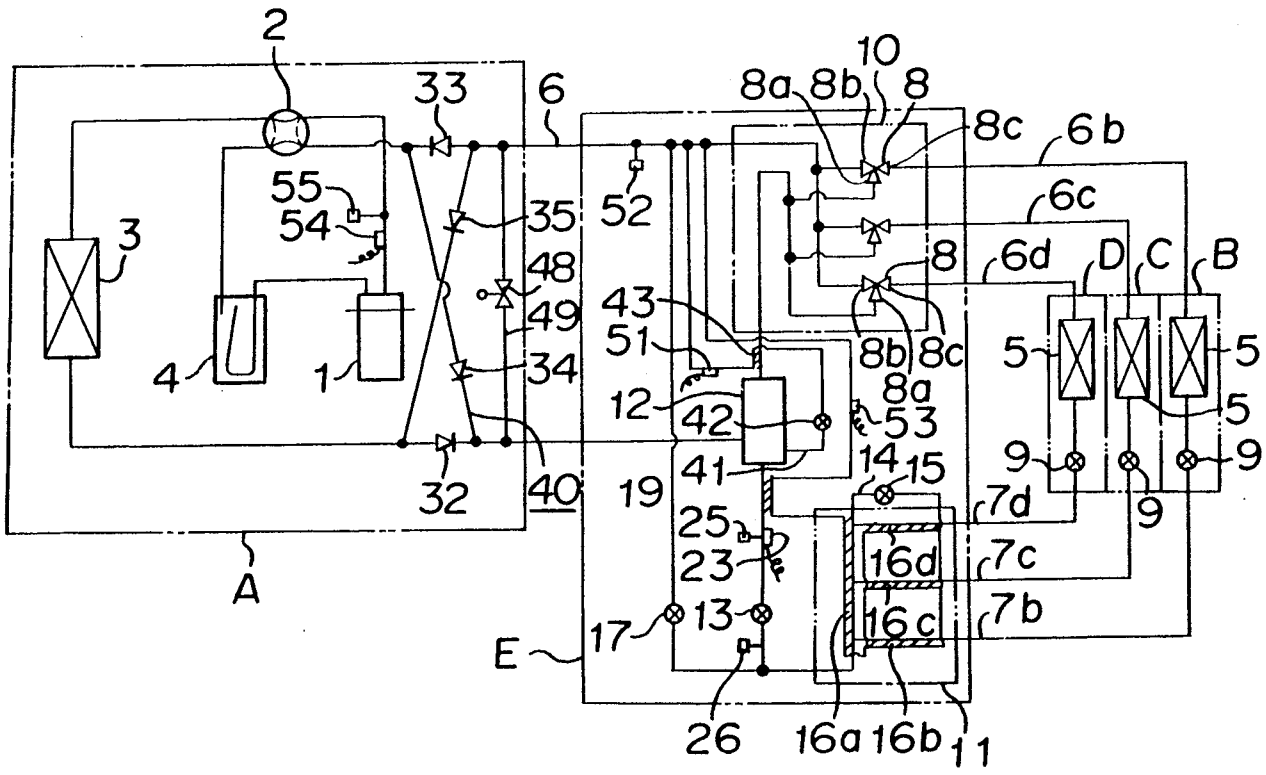
FIG. 32 is a schematic diagram of the entire structure of a seventh embodiment of the air conditioning apparatus according to the present invention, which is depicted on the basis of the refrigerant system of the apparatus.
Figure 33:
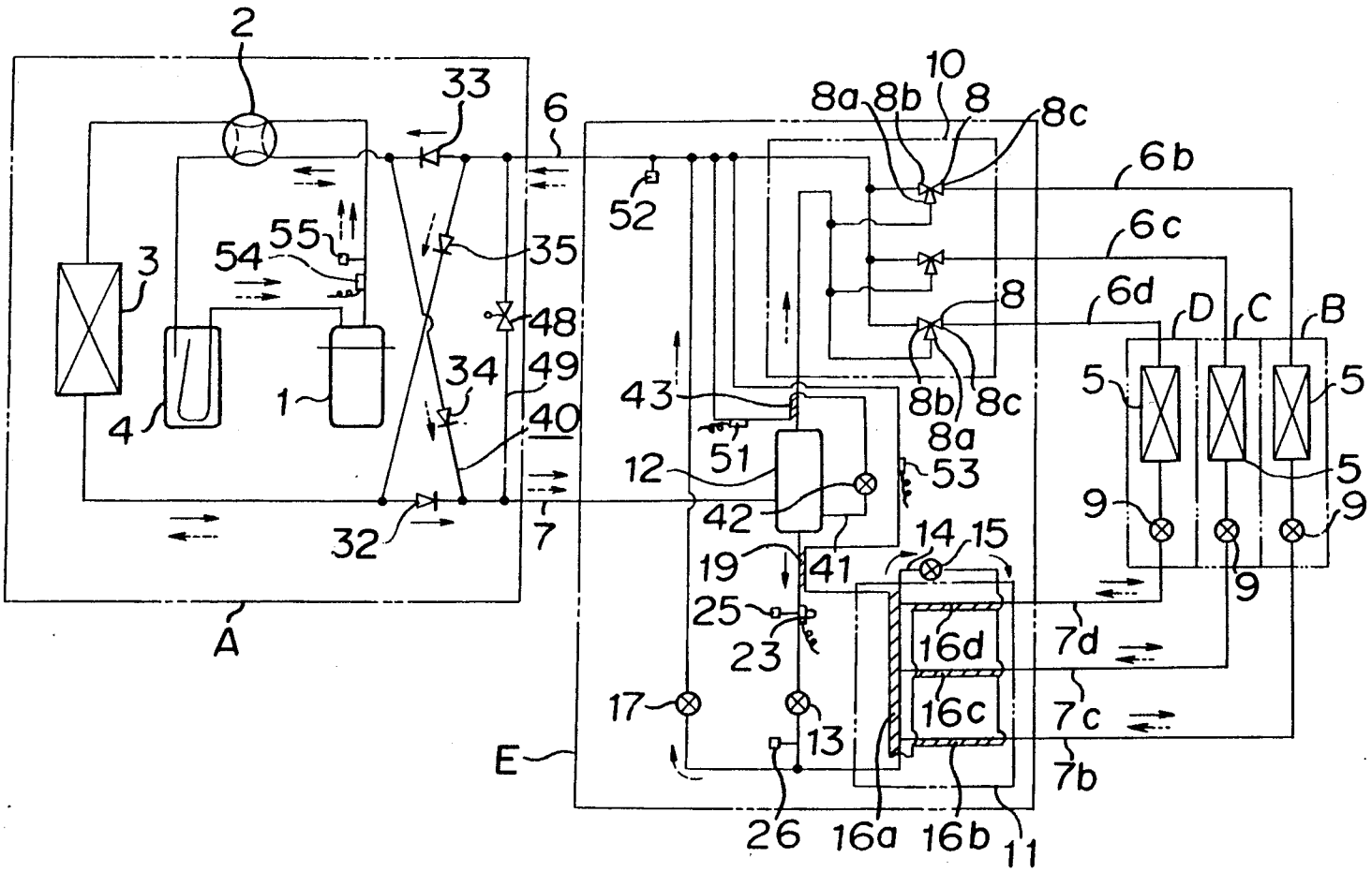
FIG. 33 is a schematic diagram showing the operation states of the seventh embodiment of FIG. 32 wherein solo cooling or solo heating is performed.
Figure 34:
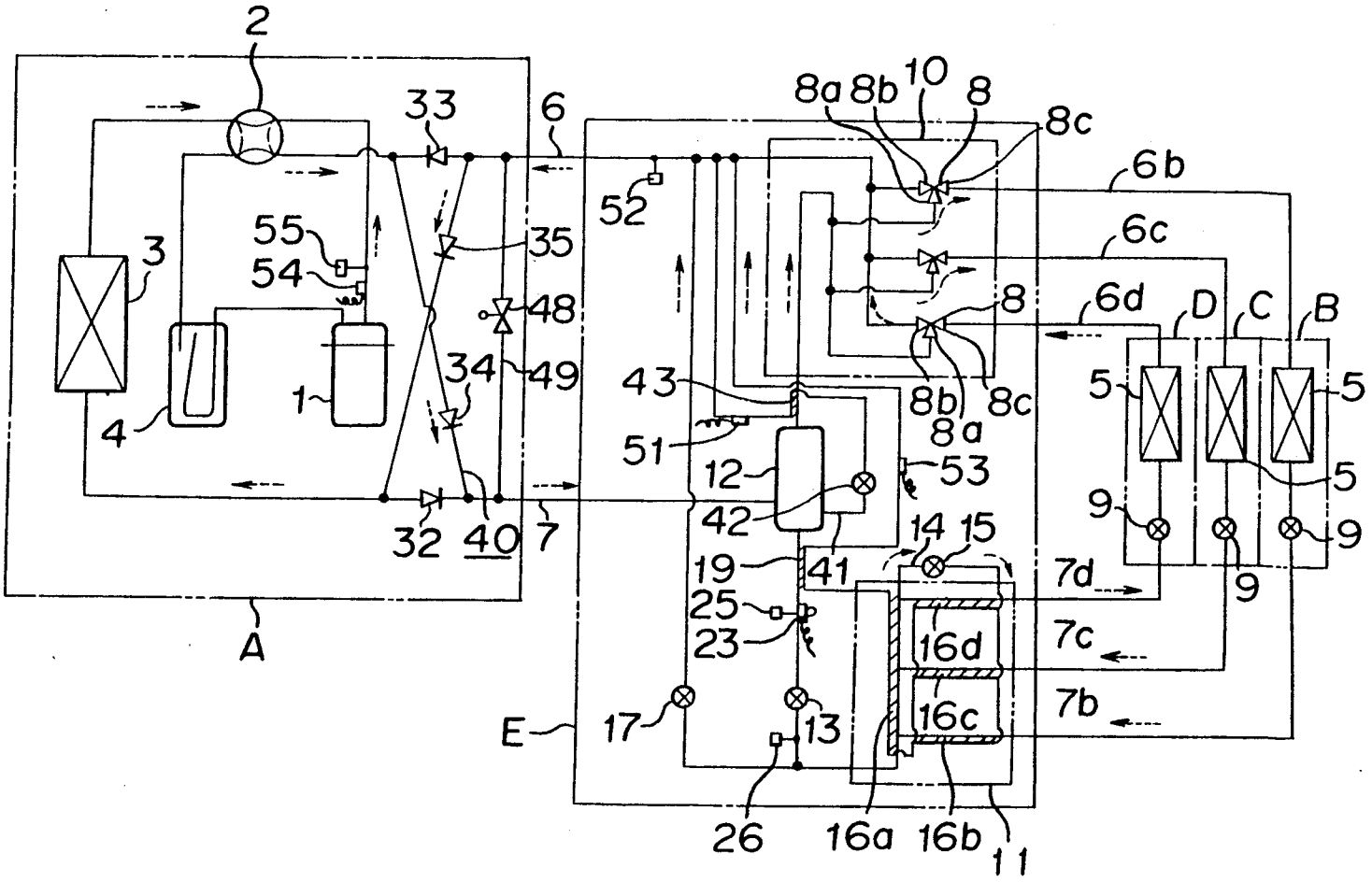
FIG. 34 is a schematic diagram showing the operation state of the seventh embodiment of FIG. 32 wherein heating is principally performed under cooling and heating concurrent operation.
Figure 35:
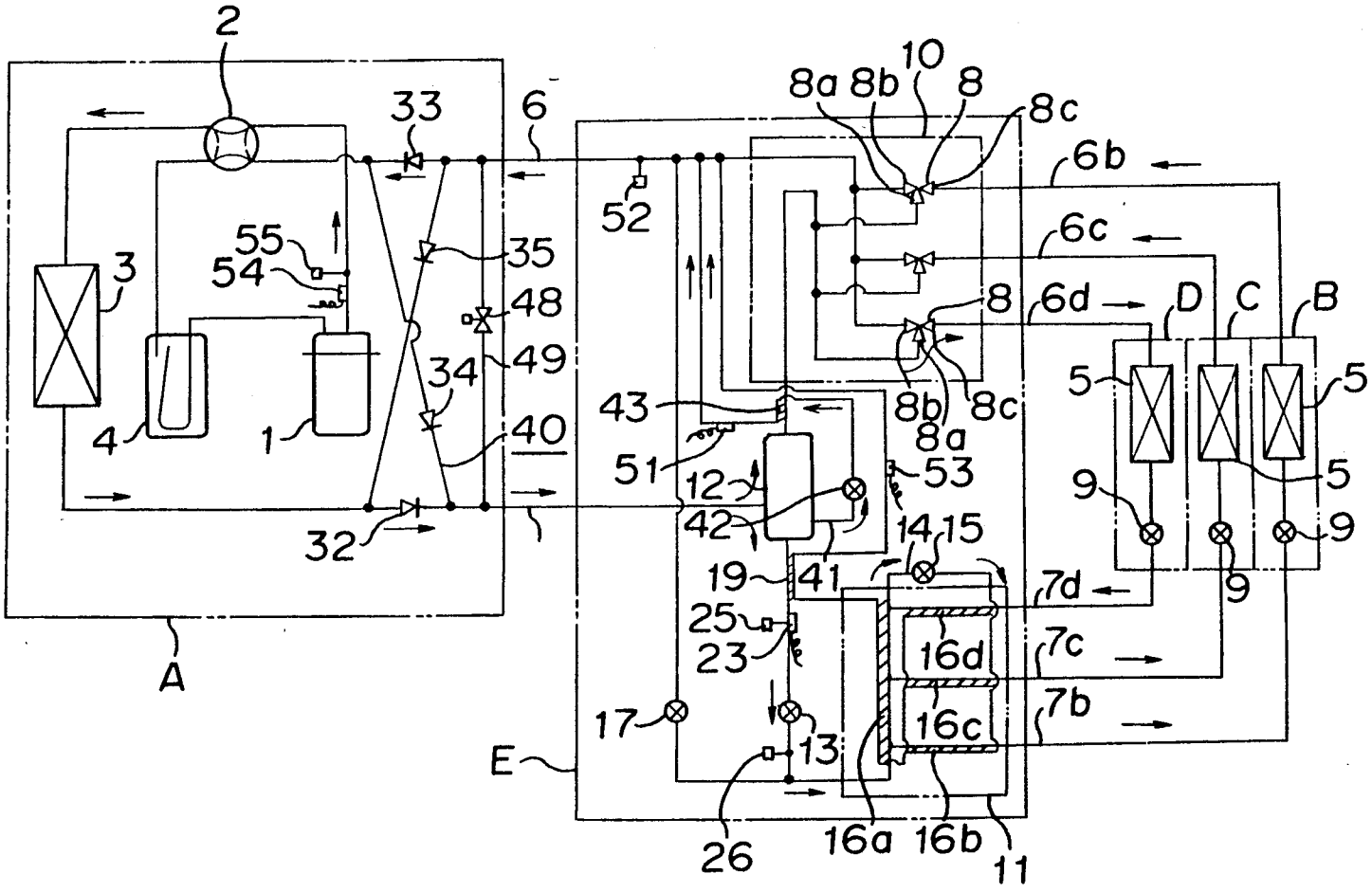
FIG. 35 is a schematic diagram showing the operation state of the seventh embodiment of the FIG. 32 wherein cooling is principally performed under cooling and heating concurrent operation.

FIG. 32 is a schematic diagram of the entire structure of the seventh embodiment of the air conditioning apparatus according to the present invention, which is depicted on the basis of the refrigerant system of the apparatus. FIGS. 33 to 35 are schematic diagrams showing the operation states in cooling or heating in the seventh embodiment of FIG. 32, FIG. 33 being a schematic diagram showing the operation states wherein solo cooling or solo heating is performed; and FIGS. 34 and 35 being schematic diagrams showing the operation states in cooling and heating concurrent operation, FIG. 34 being a schematic diagram showing the operation state wherein heating is principally performed under cooling and heating concurrent operation (total heating load is greater than total cooling load), and FIG. 35 being a schematic diagram showing the operation state wherein cooling is principally performed under cooling and heating concurrent operation (total cooling load is greater than total heating load).

Although explanation on the embodiment will be made in reference to the case wherein a single outdoor unit as a heat source device is connected to three indoor units, the explanation is also applicable to the case wherein the outdoor unit is connected to two or more indoor units.

In FIGS. 32–35, references A–D, and reference numerals 1–43, and 51–53 indicate the same parts as the parts of the conventional apparatus, which offer similar effects.

Reference numeral 49 designates a heat source device bypass pipe which extends from the junction of the heat source device switching valve arrangement 40 and the second main pipe 7 to the junction of the heat source device switching valve arrangement 40 and the first main pipe 6. Reference numeral 48 designates a sixth electromagnetic on off valve which is arranged in the heat source device bypass pipe 49 to make an on off control of the heat source device bypass pipe 49. Reference numeral 54 designates a fourth temperature detector which is attached to a pipe connecting between the compressor 1 and the four port reversing valve 2. Reference numeral 55 designates a fourth pressure detector which is attached to the pipe as the fourth temperature detector 54 is attached to.

A control of the sixth electromagnetic on off valve 48 in cooling according to the seventh embodiment will be explained. In FIG. 33, when a discharge pressure of the compressor 1 is transitionally raised to be beyond a preset first value, the sixth electromagnetic on off valve 48 is opened. A high pressure liquid refrigerant which is flowing through the second main pipe 7 flows into the first main pipe 6 on a low pressure side through the bypass pipe 49 and the sixth electromagnetic on off valve 48 in it. Then the liquid refrigerant is inspired into the compressor 1 through the fourth check valve 33, the four port reversing valve 2 and the accumulator 4. Such an arrangement can bypass the refrigerant from a high pressure side to the low pressure side to lower the high pressure, thereby decreasing the discharge pressure of the compressor 1. Although the explanation of the control for the sixth electromagnetic on off valve 48 has been made for the case of cooling, the cooling and heating concurrent operation wherein cooling is principally performed as shown in FIG. 35 can also have similar operation and advantages.

A control for the sixth electromagnetic on off valve 48 in heating according to the seventh embodiment will be explained. In FIG. 33, when the discharge pressure of the compressor 1 is transitionally raised to be beyond the preset first value, the sixth electromagnetic on off valve 48 is opened. A high pressure refrigerant which is flowing through the second main pipe 7 flows into the first main pipe 6 on the low pressure side through the bypass pipe 49 and the sixth electromagnetic on off valve 48 in it. The refrigerant is inspired into the compressor 1 through the sixth check valve 35, the outdoor heat exchanger 3, the four port reversing valve 2 and the accumulator 4. Such an arrangement can bypass the refrigerant from the high pressure side to the low pressure side to lower the high pressure, thereby decreasing the discharge pressure of the compressor 1.

Although the explanation of the control for the sixth electromagnetic on off valve 48 has been made for the case of heating, the cooling and heating concurrent operation wherein heating is principally performed as shown in FIG. 34 can also have similar operation and advantages.

Now, the seventh embodiment will be described in more detail, referring to FIGS. 36, 37 and 38.

Figure 36:
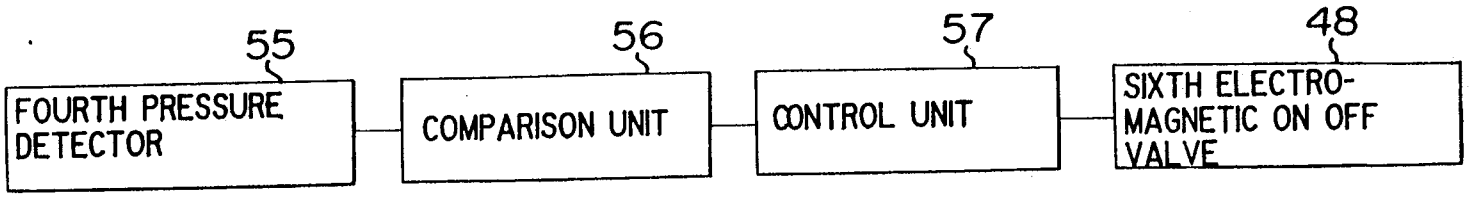
FIG. 36 is a block diagram to help explain a control for a sixth electromagnetic on off valve in accordance with the seventh embodiment.

FIG. 36 is a schematic diagram showing the control for the sixth electromagnetic on off valve 48 according to the seventh embodiment. The fourth pressure detector 55 detects a discharge pressure of the compressor 1. A comparison unit 56 compares the pressure detected by the fourth pressure detector 55 with the preset first value. A control unit 57 determines whether the sixth electromagnetic on off valve 48 should be opened or closed.

Figure 37:
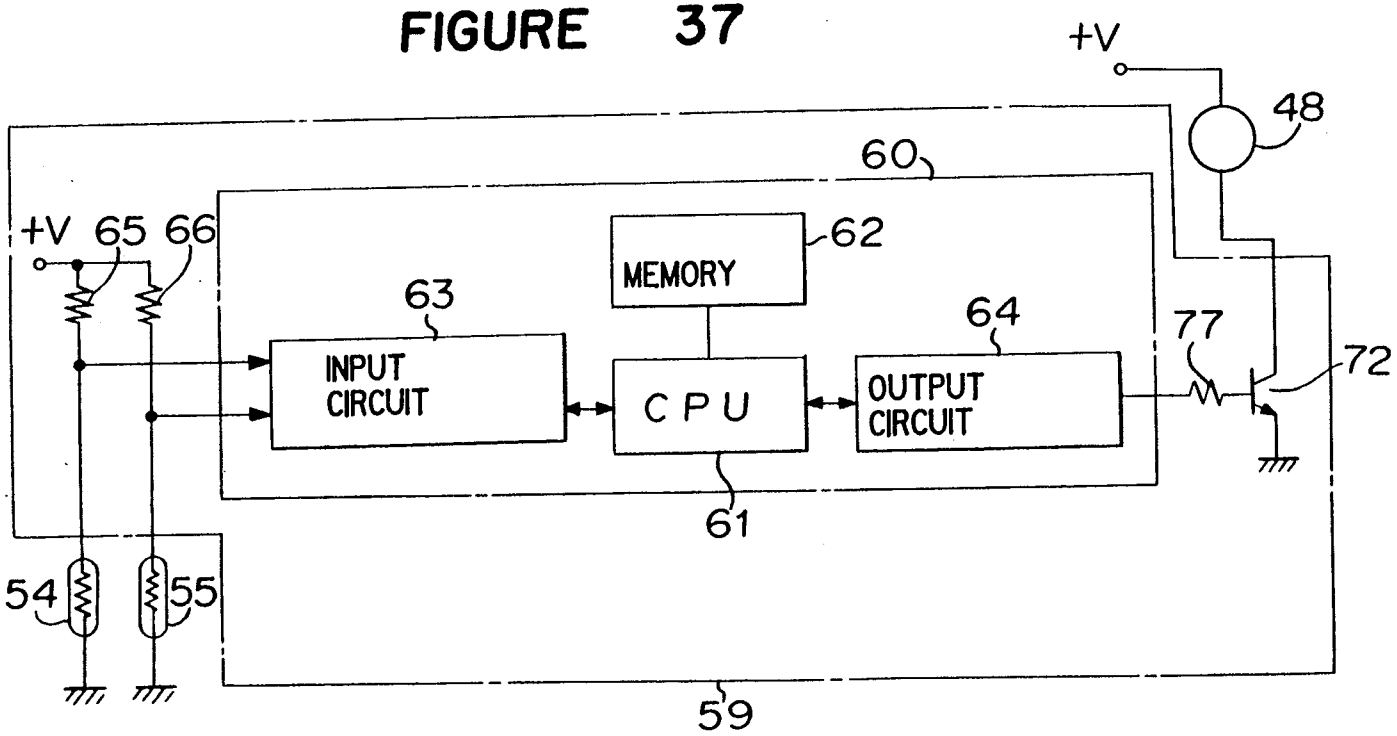
FIG. 37 is a schematic diagram showing a control circuit of the air conditioning apparatus of FIG. 32.

FIG. 37 is a circuit diagram showing the electrical connection according to the seventh embodiment. Reference numeral 60 designates a microcomputer which is arranged in a control device-.59, and which includes a CPU 61, a memory 62, an input circuit 63 and an output circuit 64. Reference numerals 65 and 66 designate resistors which are connected in series with the fourth temperature detector 54 and the fourth pressure detector 55, respectively. The resistors have outputs given to the input circuit 63. A transistor 72 which controls the on off operation of the sixth electromagnetic on off valve 48 is connected to the output circuit 64 through a resistor 77.

Figure 38:
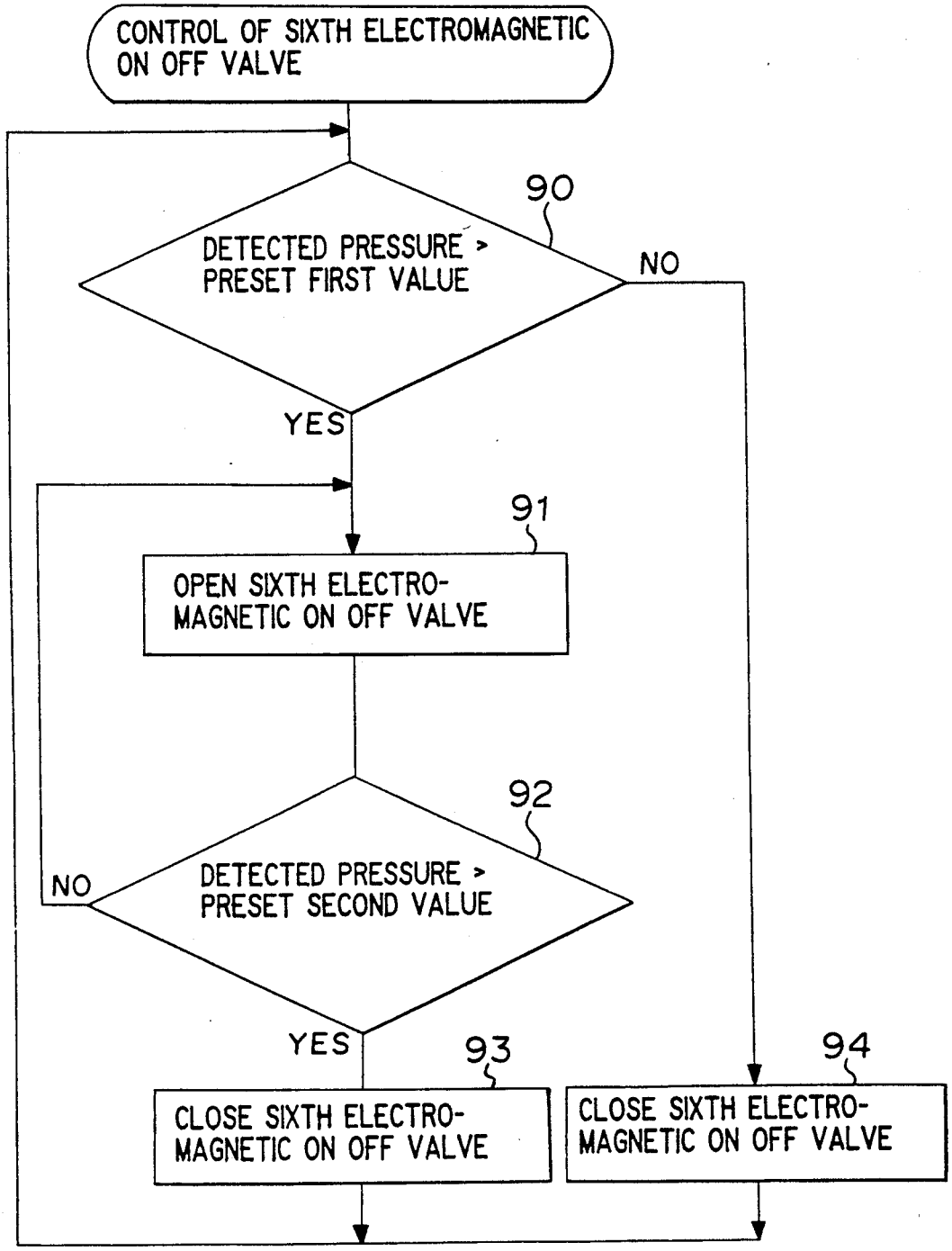
FIG. 38 is a flowchart showing the operations of the apparatus of FIG. 32.

FIG. 38 is a flowchart showing the on off control program for the sixth electromagnetic on off valve which is stored in the memory 62 of the microcomputer 60. At Step 90, it is determined whether a pressure detected by the fourth pressure detector is higher than the preset first value or not. If affirmative, the program proceeds to Step 91. If negative, the program proceeds to Step 94. At Step 91, the sixth electromagnetic on off valve 48 is opened. At Step 92 which is the next one of Step 91, it is determined whether the pressure detected by the fourth pressure detector is lower than a preset second value or not. If affirmative, the program proceeds to Step 93. If negative, the program returns to Step 91. At Step 93, the sixth electromagnetic on off valve 48 is closed. At Step 94, the sixth electromagnetic on off valve is closed.

In accordance with the seventh embodiment, when the discharge pressure of the compressor is beyond the present first value during operation of the compressor in cooling, heating, or cooling and heating concurrent operation, the sixth electromagnetic on off valve is opened.

As a result, the refrigerant can be bypassed from the high pressure side to the low pressure side to lower the high pressure, thereby decreasing the discharge pressure of the compressor. In that manner, the discharge pressure of the compressor can be prevented from raising to keep reliability of the compressor even if the discharge pressure of the compressor is raised.

EMBODIMENT 8

An eighth embodiment of the present invention will be described.

Figure 39:
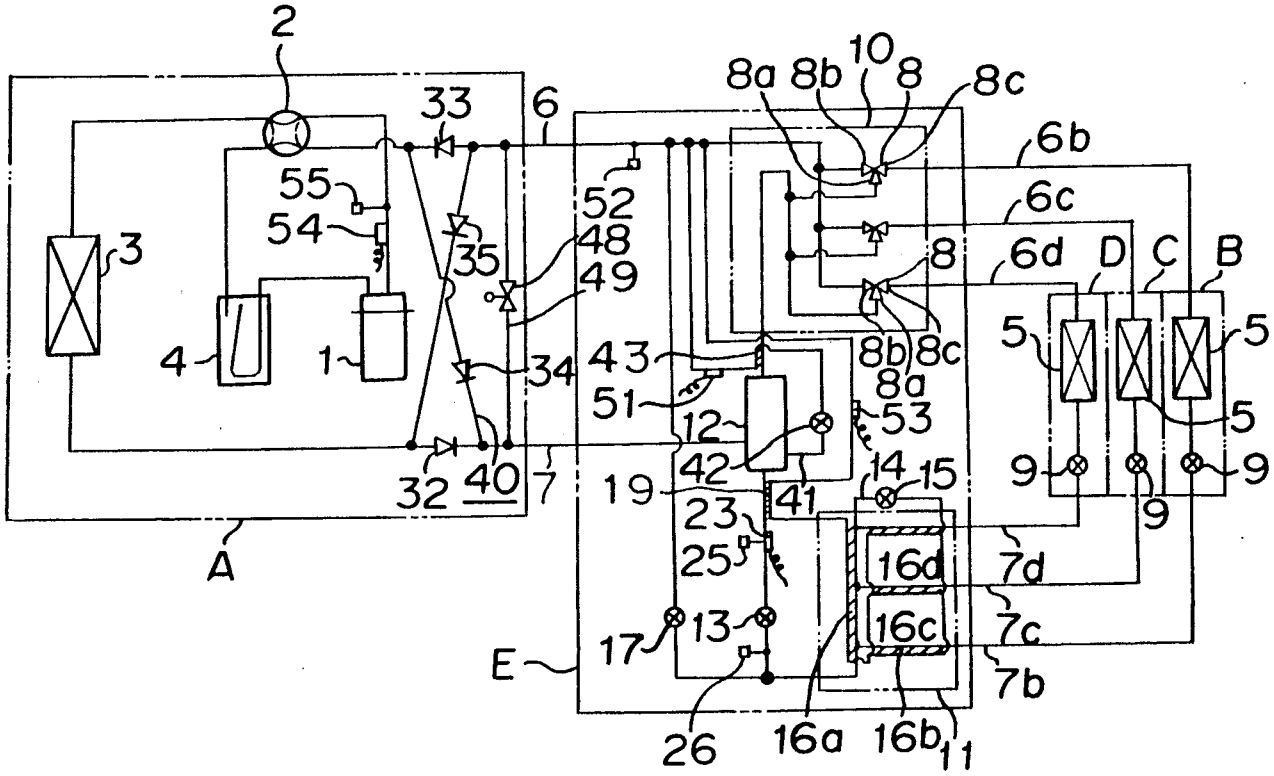
FIG. 39 is a schematic diagram of the entire structure of an eighth embodiment of the air conditioning apparatus according to the present invention, which is depicted on the basis of the refrigerant system of the apparatus.
Figure 40:
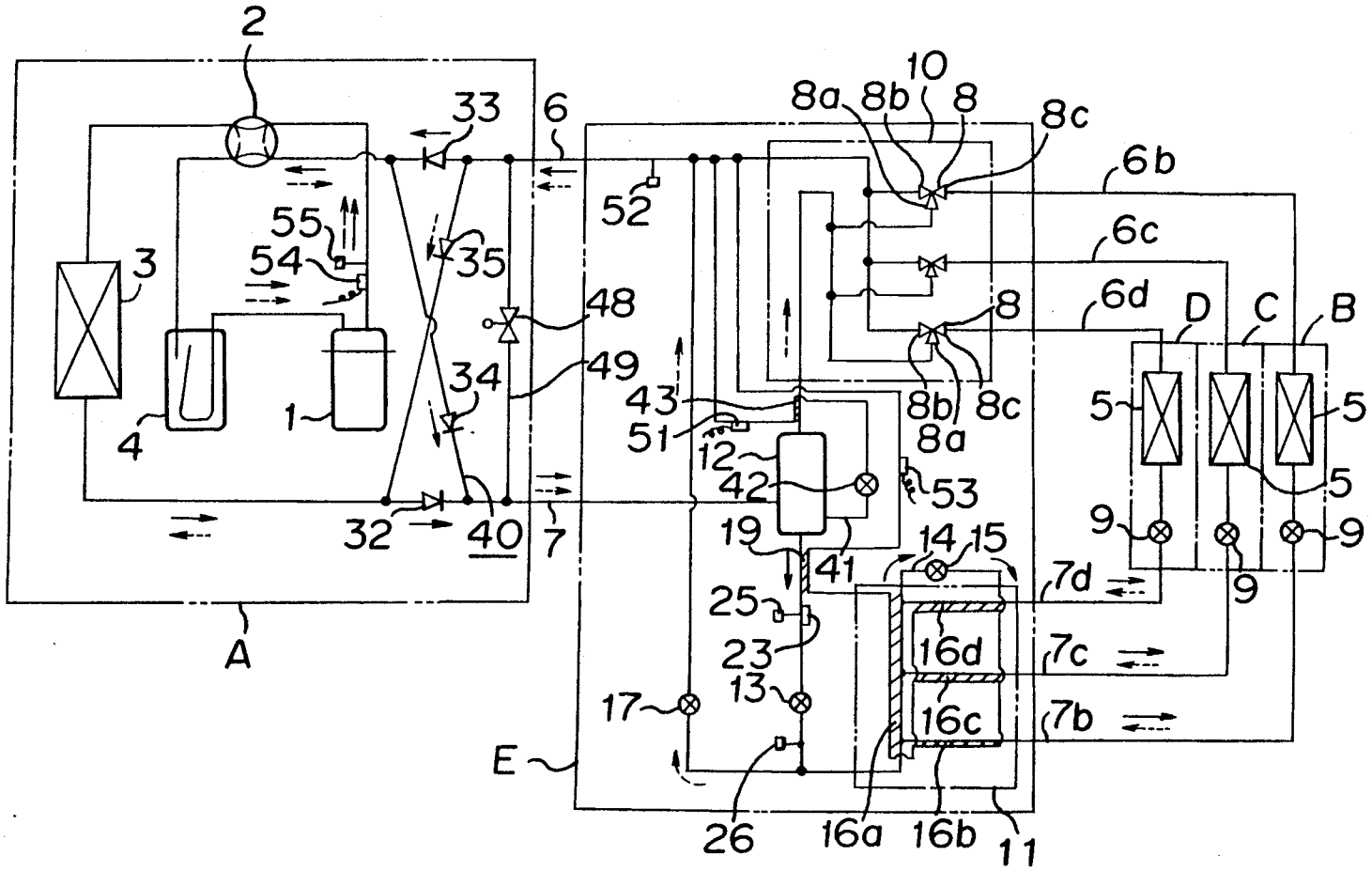
FIG. 40 is a schematic diagram showing the operation states of the eighth embodiment of FIG. 39 wherein solo cooling or solo heating is performed.
Figure 41:
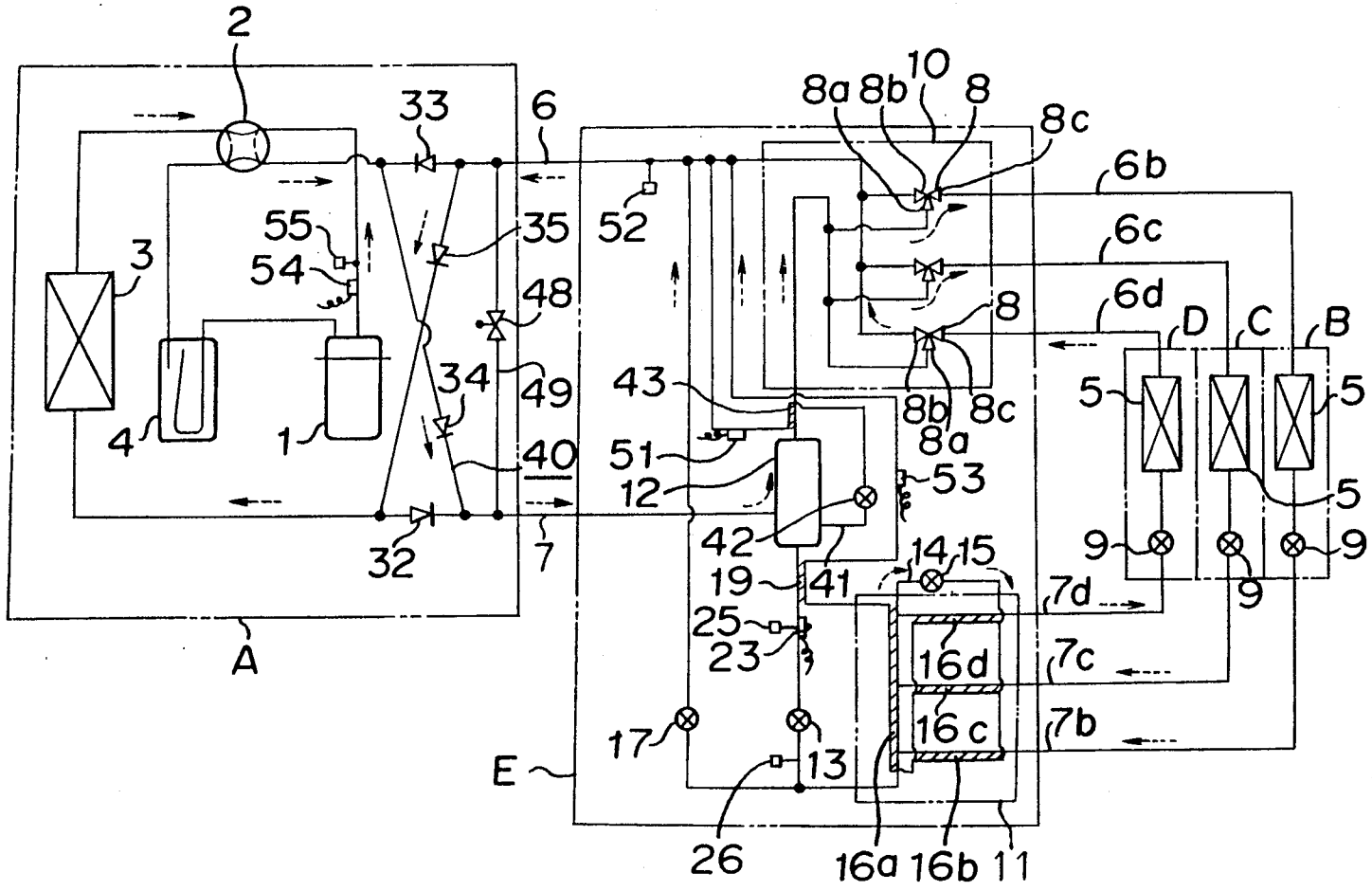
FIG. 41 is a schematic diagram showing the operation state of the eighth embodiment of FIG. 39 wherein heating is principally performed under cooling and heating concurrent operation.
Figure 42:
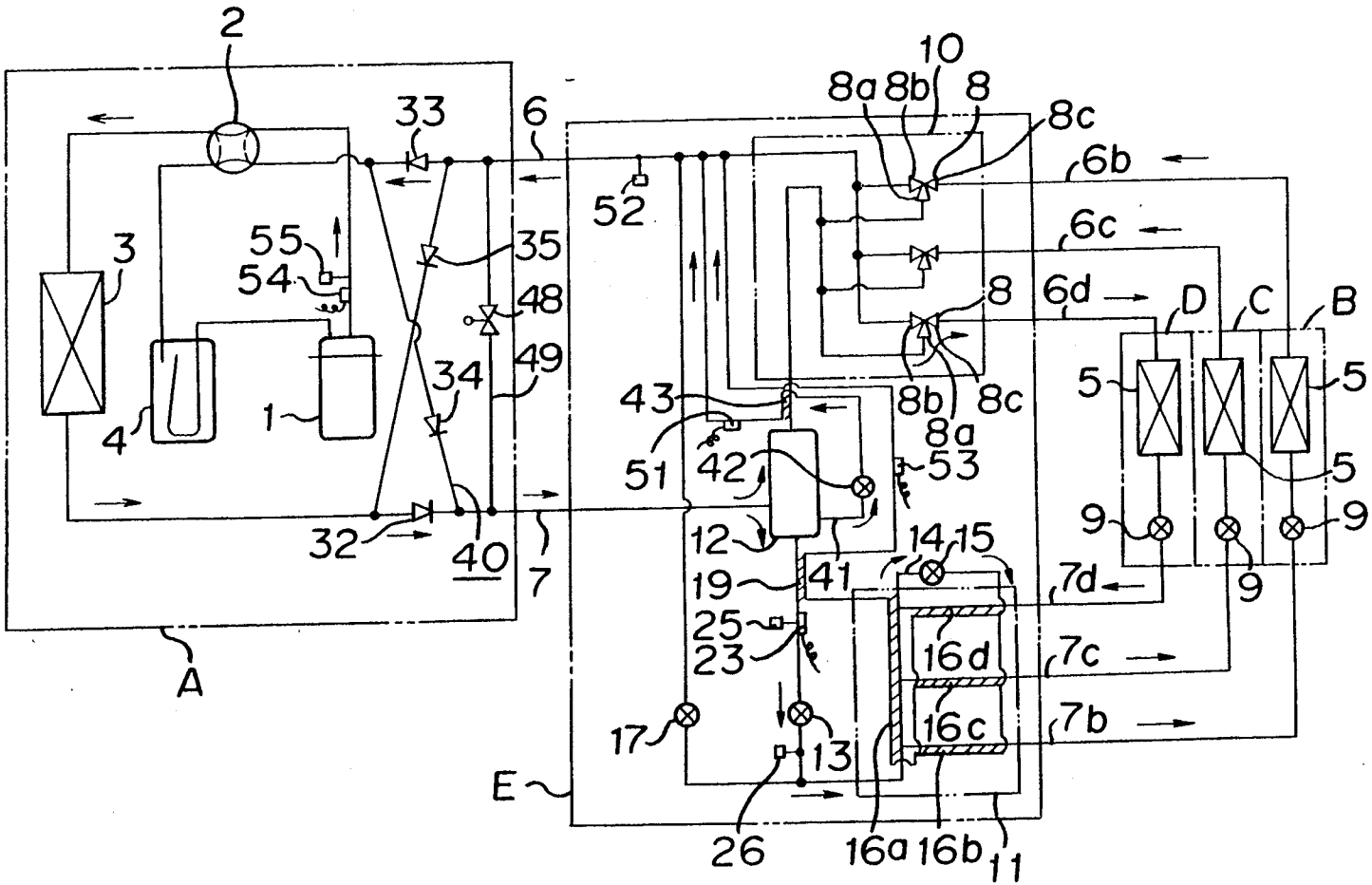
FIG. 42 is a schematic diagram showing the operation state of the eighth embodiment of the FIG. 39 wherein cooling is principally performed under cooling and heating concurrent operation.

FIG. 39 is a schematic diagram of the entire structure of the eighth embodiment of the air conditioning apparatus according to the present invention, which is depicted on the basis of the refrigerant system of the apparatus. FIGS. 40 to 42 are schematic diagrams showing the operation states in cooling or heating in the eighth embodiment of FIG. 39; FIG. 40 being a schematic diagram showing the operation states wherein solo cooling or solo heating is performed; and FIGS. 41 and 42 being schematic diagrams showing the operation states in cooling and heating concurrent operation, FIG. 41 being a schematic diagram showing the operation state wherein room heating is principally performed under cooling and heating concurrent operation (total heating load is greater than total cooling load), and FIG. 42 being a schematic diagram showing the operation state wherein cooling is principally performed under cooling and heating concurrent operation (total cooling load is greater than total heating load).

Although explanation on the embodiment will be made in reference to the case wherein a single outdoor unit as a heat source device is connected to three indoor units, the explanation is also applicable to the case wherein the outdoor unit is connected to two or more indoor units.

In FIGS. 39–42, References A–D, and reference numerals 1–43, and 51–53 designate parts which are similar to those of the conventional apparatus. Reference numeral 49 designates a heat source device bypass pipe which extends from the junction of the heat source device switching valve arrangement 40 and the second main pipe 7 to the junction of the heat source device switching valve arrangement 40 and the first main pipe 6. Reference numeral 48 designates a sixth electromagnetic on off valve which is arranged in the heat source device bypass pipe 49 to make an on off control of the heat source device bypass pipe 49. Reference numeral 54 designates a fourth temperature detector which is attached to a pipe connecting between the compressor 1 and the four port reversing valve 2. Reference numeral 55 designates a fourth pressure detector which is attached to the same pipe as the fourth temperature detector 54 is attached to.

A control of the sixth electromagnetic on off valve 48 in cooling according to the eighth embodiment will be explained. In FIG. 40, when a discharge temperature of the compressor 1 is transitionally raised to be beyond a preset first value, the sixth electromagnetic on off valve 48 is opened. A high pressure liquid refrigerant which is flowing through the second main pipe 7 flows into the first main pipe 6 on the low pressure side through the heat source device bypass pipe 49 and the sixth electromagnetic on off valve 48 in it. Then the refrigerant is inspired into the compressor 1 through the fourth check valve 33, the four port reversing valve 2 and the accumulator 4. Such an arrangement can bypass the refrigerant from the high pressure to the low pressure to lower the high pressure, accompanied by a decrease in the discharge temperature of the compressor 1.

Because the high pressure liquid refrigerant flows into the low pressure side, suction superheat of the compressor 1 lowers, and the discharge temperature of the compressor 1 also lowers.

Although the explanation of the control for the sixth electromagnetic on off valve 48 has been made for the case of cooling, cooling and heating concurrent operation wherein cooling is principally performed as shown in FIG. 42 can also have similar operation and advantages.

A control of the sixth electromagnetic on off valve 48 in heating according to the eighth embodiment will be explained. In FIG. 40, when the discharge temperature of the compressor 1 is transitionally raised to be beyond the preset first value, the sixth electromagnetic on off valve 48 is opened. A high pressure refrigerant which is flowing through the second main pipe 7 flows into the first main pipe 6 on the low pressure side through the bypass pipe 49 and the sixth electromagnetic on off valve 48 in it. The refrigerant is inspired into the compressor 1 through the sixth check valve 35, the outdoor heat exchanger 3, the four port reversing valve 2 and the accumulator 4. Such an arrangement can bypass the refrigerant from the high pressure side to the low pressure side to lower the high pressure, accompanied by a decrease in the discharge temperature of the compressor 1.

Although the explanation of the control for the sixth electromagnetic on off valve 48 has been made for the case in heating, cooling and heating concurrent operation wherein heating is principally performed as shown in FIG. 41 can also have similar operation and advantages.

Now, the eighth embodiment will be described in more detail, referring to FIGS. 43, 44 and 45.

Figure 43:
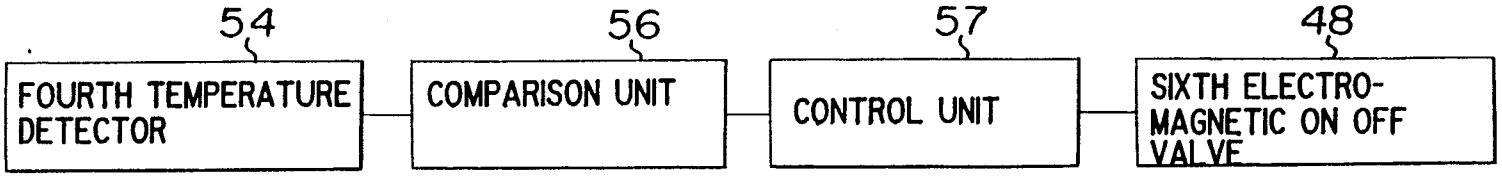
FIG. 43 is a block diagram to help explain a control for a sixth electromagnetic on off valve in the eighth embodiments.

FIG. 43 is a schematic diagram showing the control of the sixth electromagnetic on off valve 48 according to the eighth embodiment. The fourth temperature detector 54 detects a discharge temperature of the compressor 1. A comparison unit 56 compares the temperature detected by the fourth temperature detector 54 with the present first value. A control unit 57 determines whether the sixth electromagnetic on off valve 48 should be opened or closed.

Figure 44:
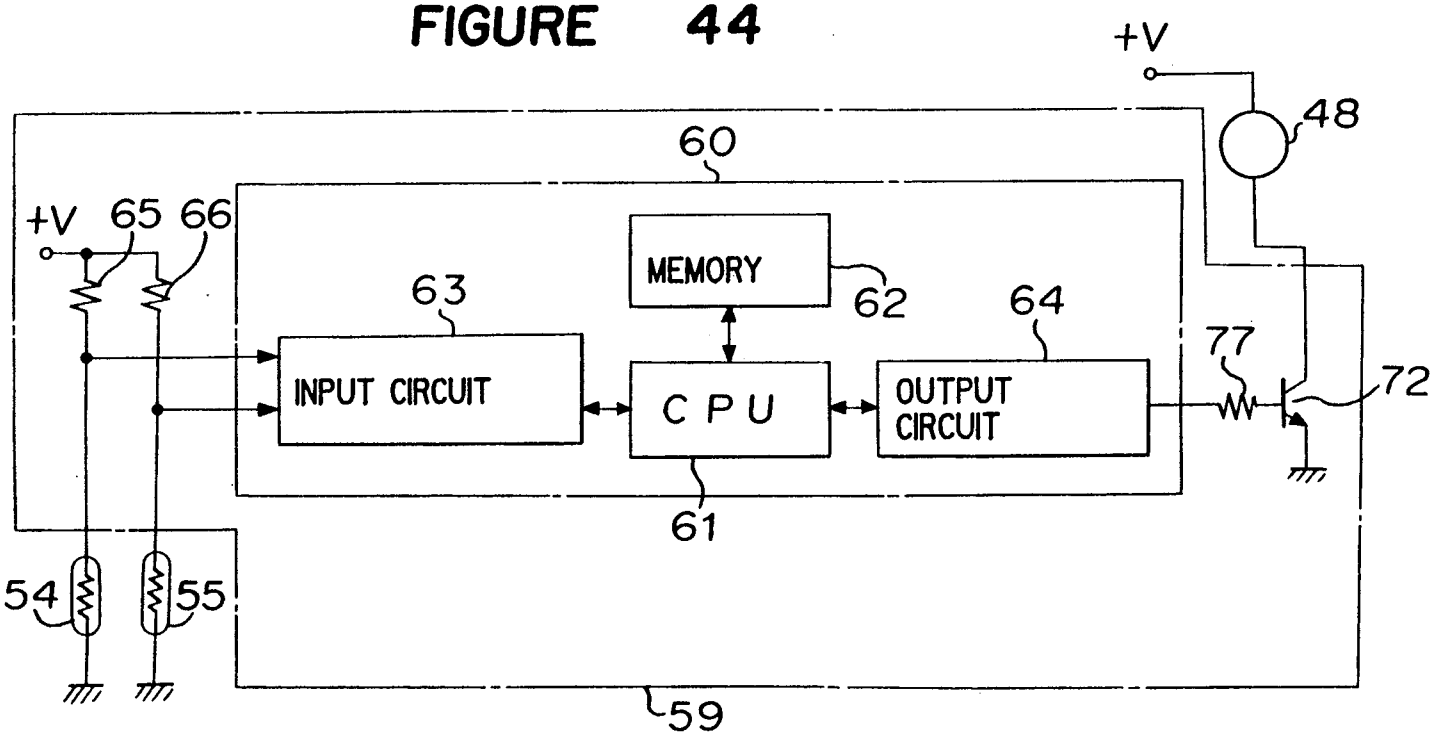
FIG. 44 is a schematic diagram showing a control circuit of the apparatus of FIG. 39.

FIG. 44 is a circuit diagram showing the electrical connection according to the eighth embodiment. Reference numeral 60 designates a microcomputer which is arranged in a control device 59, and which includes a CPU 61, a memory 62, an input circuit 63 and an output circuit 64. Reference numerals 65 and 66 designate resistors which are connected in series with the fourth temperature detector 54 and the fourth pressure detector 55, respectively. The resistors have outputs given to the input circuit 63. A control transistor 72 for control the on off operation of the sixth electromagnetic on off valve 48 is connected to the output circuit 64 through a resistor 77.

Figure 45:
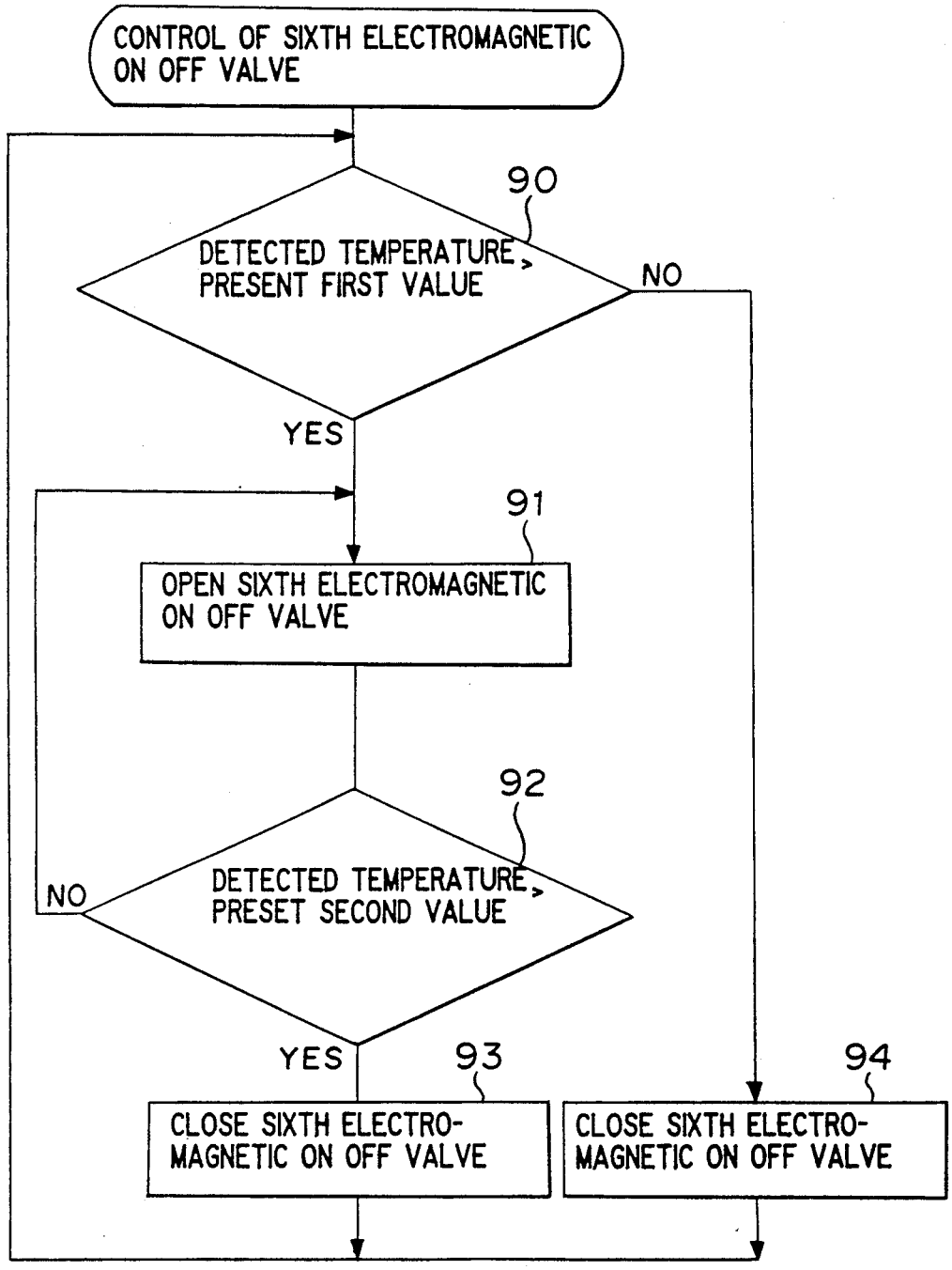
FIG. 45 is a flowchart showing the control operation of the apparatus of FIG. 39.

FIG. 45 is a flowchart showing the on off control program for the sixth electromagnetic on off valve which is stored in the memory 62 of the microcomputer 60. At Step 90, it is determined whether a temperature detected by the fourth temperature detector 54 is beyond the present first value or not. -If affirmative, the program proceeds Step 91. If negative, the program proceeds to Step 94. At Step 91, the sixth electromagnetic on off valve 48 is opened. At Step 92 which is the next one of Step 91, it is determined whether the temperature detected by the fourth temperature detector 54 is lower than a preset second value, or not. If affirmative, the program proceeds to Step 93. If negative, the program returns to Step 91. At Step 93, the sixth electromagnetic on off valve 48 is closed. At Step 94, the sixth electromagnetic on off valve 48 is closed.

In accordance with the eighth embodiment, when the discharge temperature of the compressor is beyond the present first value during operation of the compressor in cooling, in heating, and cooling and heating concurrent operation, the sixth electromagnetic on off valve is opened.

As explained, the eighth embodiment can prevent the discharge temperature of the compressor from raising in an excessive state, thereby avoiding a decrease in reliability of the compressor due to a raised in the discharge temperature of the compressor.

MODIFICATION OF EMBODIMENTS 1-8

Figure 46:
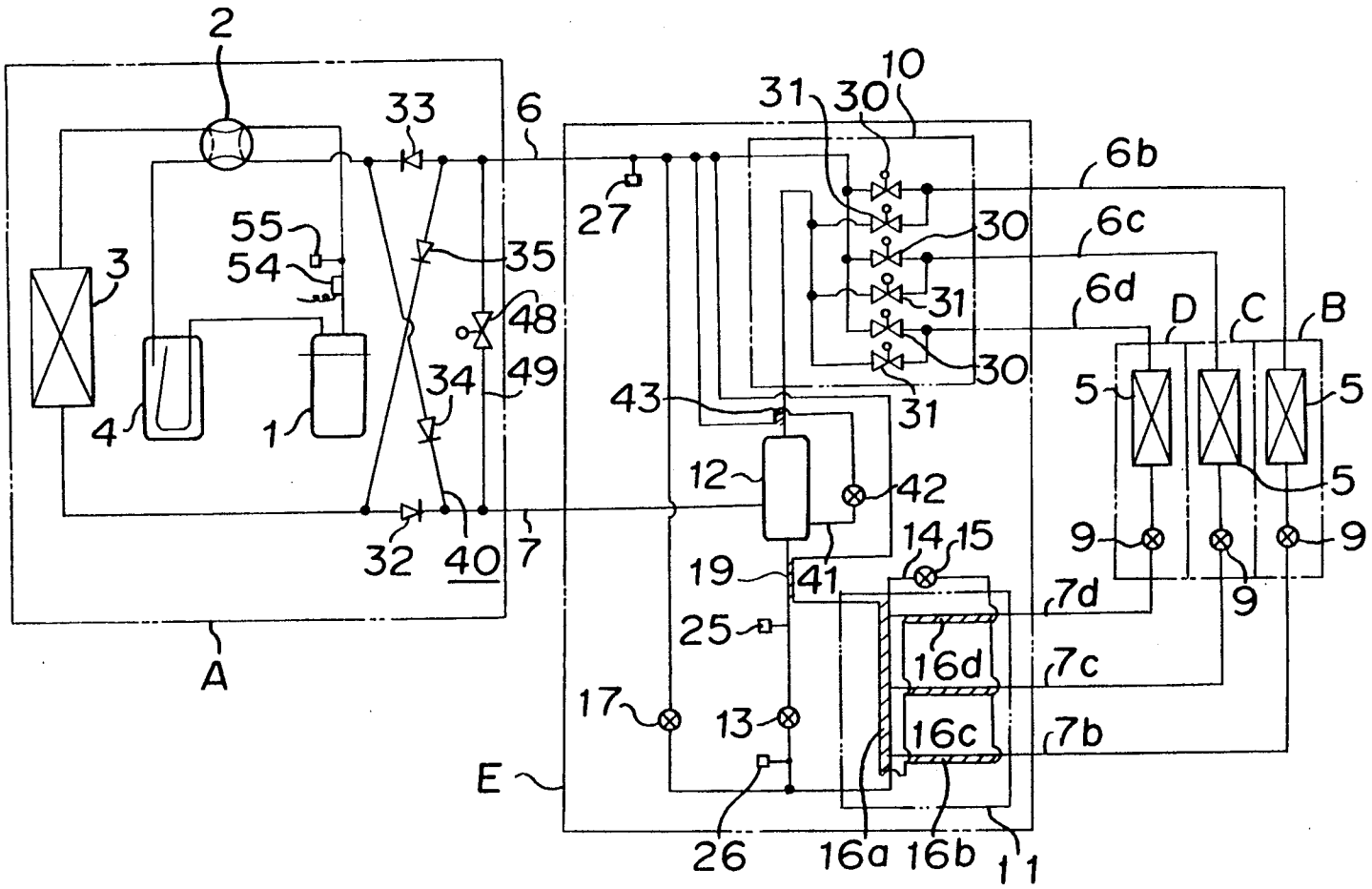
FIG. 46 is a schematic diagram of the entire structure of a modification of the first to eighth embodiments according to the present invention, which is depicted on the basis of the refrigerant system of the apparatus.
Figure 47:
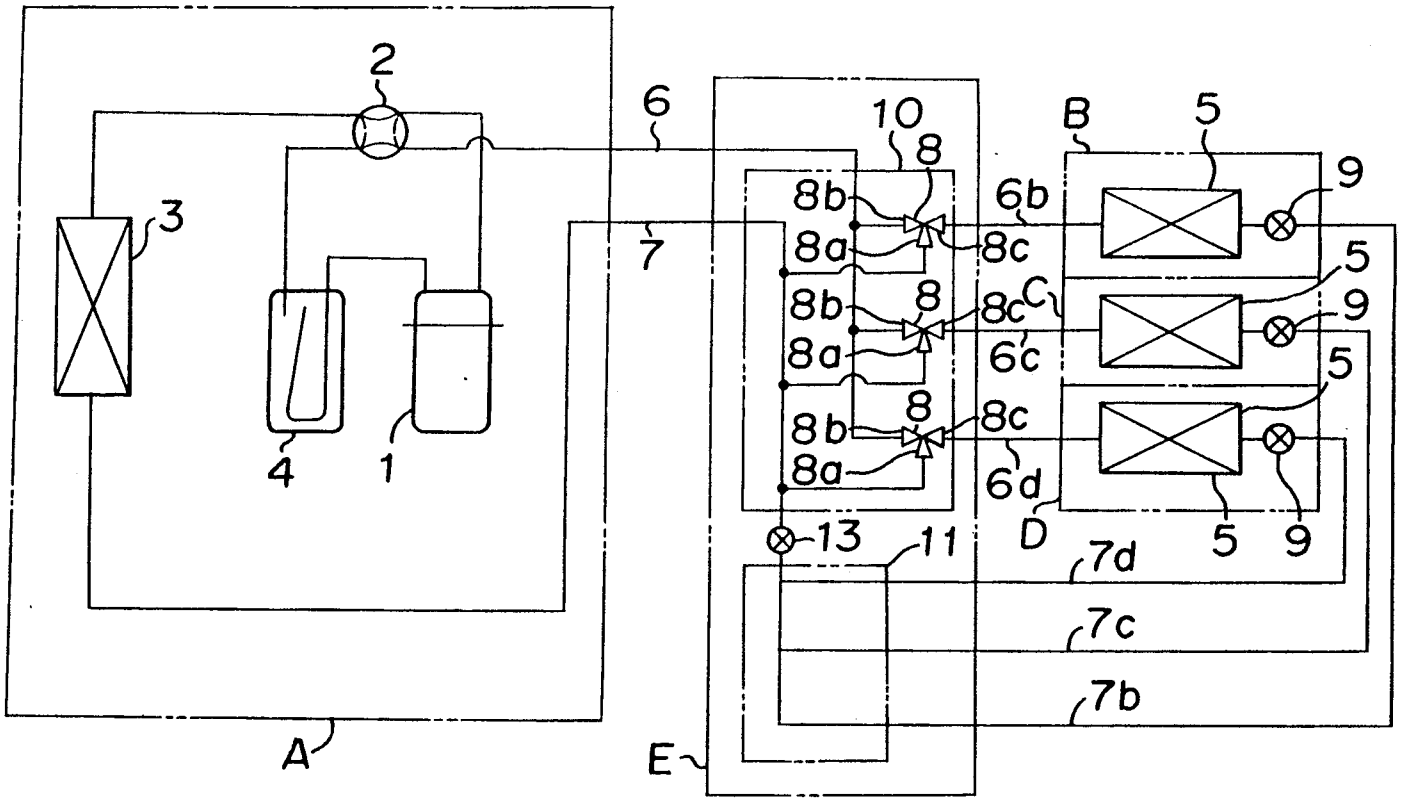
FIGURE 47 (PRIOR ART)
FIG. 47 is a schematic diagram of the entire structure of a conventional air conditioning apparatus, which is depicted on the basis of the refrigerant system of the apparatus.
Figure 48:
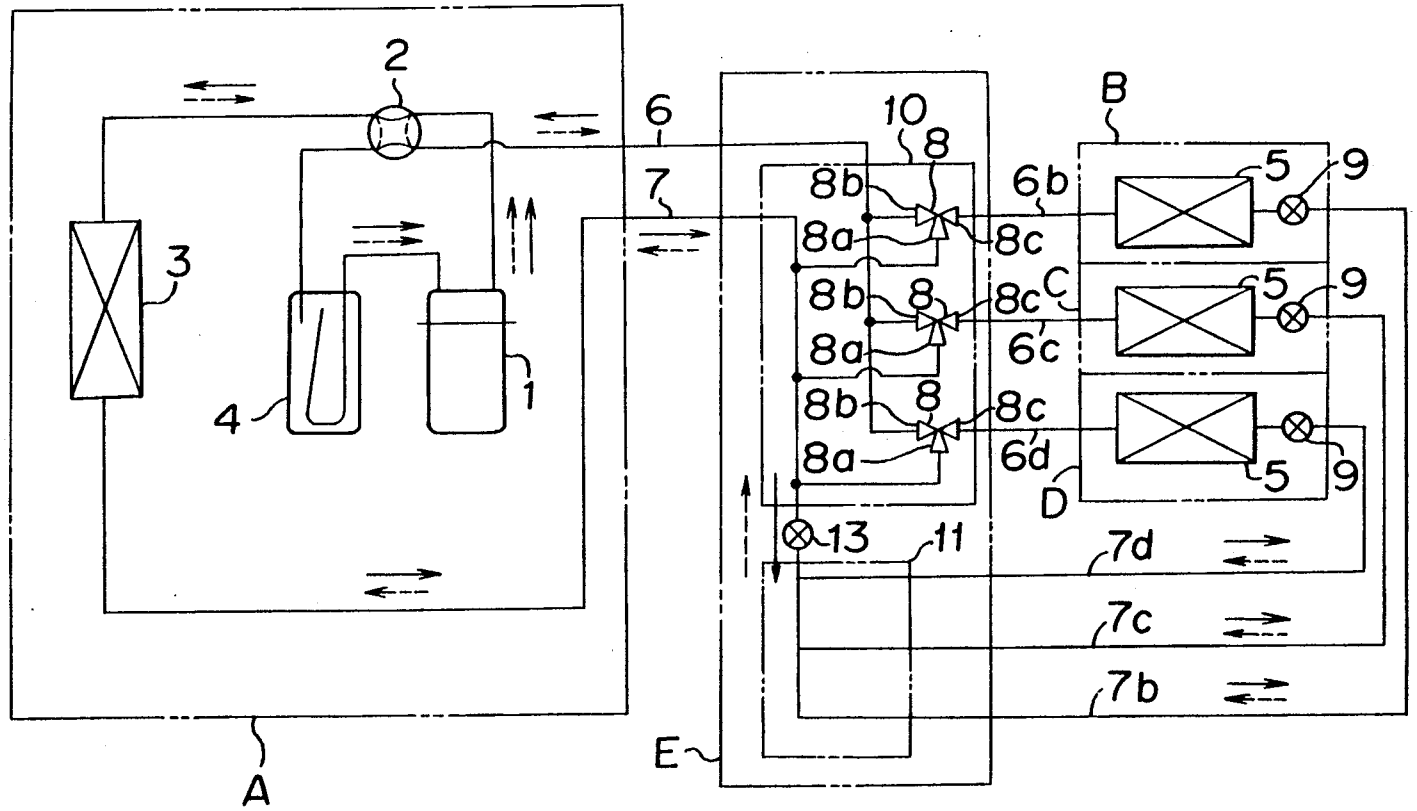
FIGURE 48 (PRIOR ART)
FIG. 48 is a schematic diagram showing the operation states of the conventional apparatus of FIG. 47 wherein solo cooling or solo heating is performed.
Figure 49:
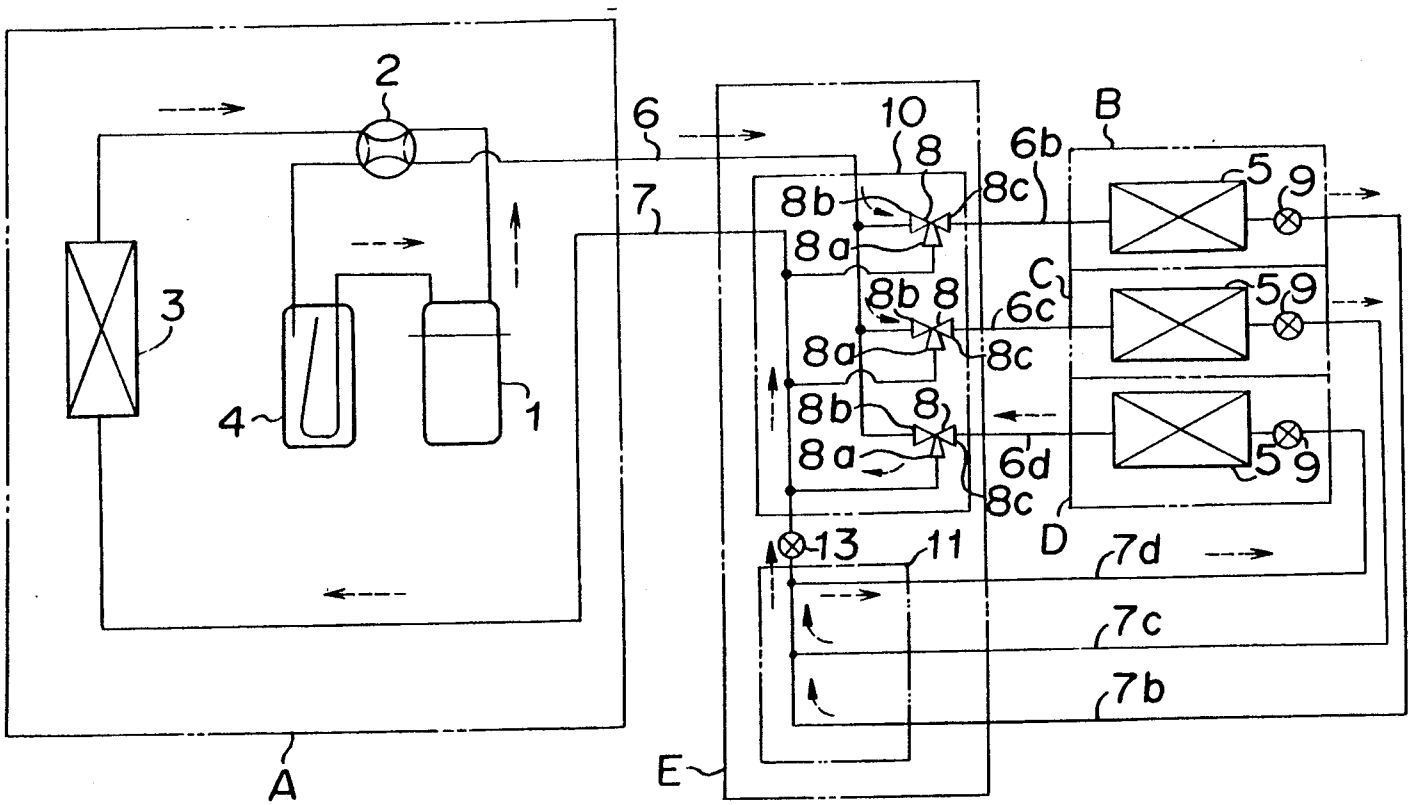
FIGURE 49 (PRIOR ART)
FIG. 49 is a schematic diagram showing the operation state of the conventional apparatus of FIG. 47 wherein heating is principally performed under cooling and heating concurrent operation.
Figure 50:
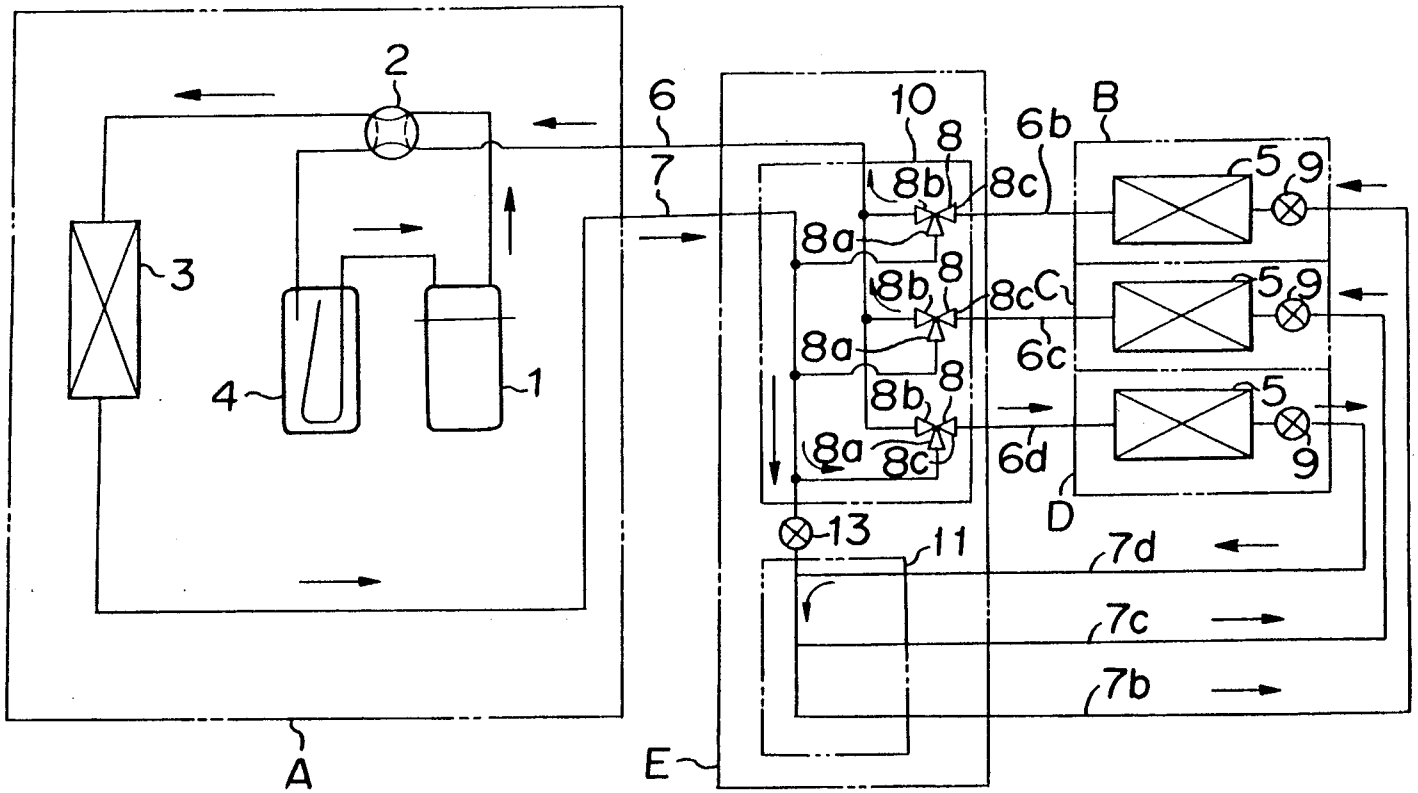
FIGURE 50 (PRIOR ART)
FIG. 50 is a schematic diagram showing the operation state of the conventional apparatus of the FIG. 47 wherein cooling is principally performed under cooling and heating concurrent operation.
Figure 51:
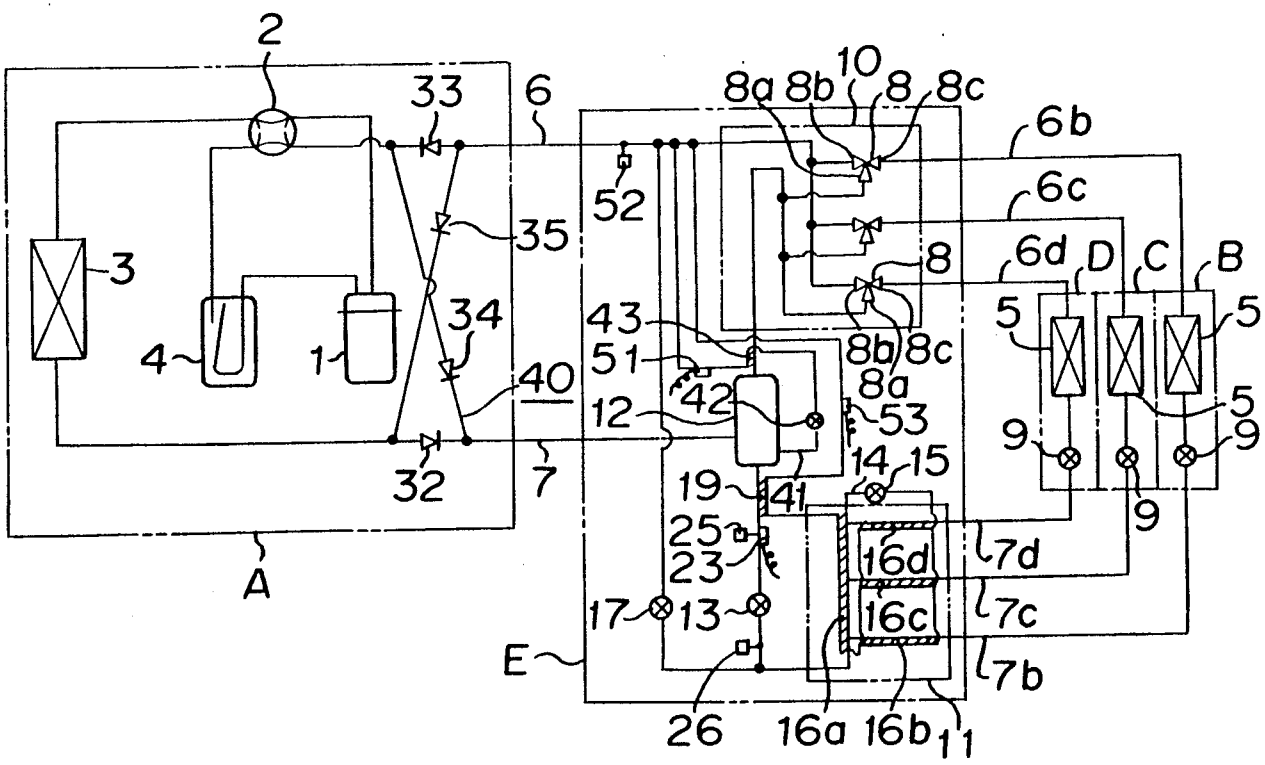
FIGURE 51 (PRIOR ART)
FIG. 51 is a schematic diagram of the entire structure of another conventional air conditioning apparatus, which is depicted on the basis of the refrigerant system of the apparatus.
Figure 52:
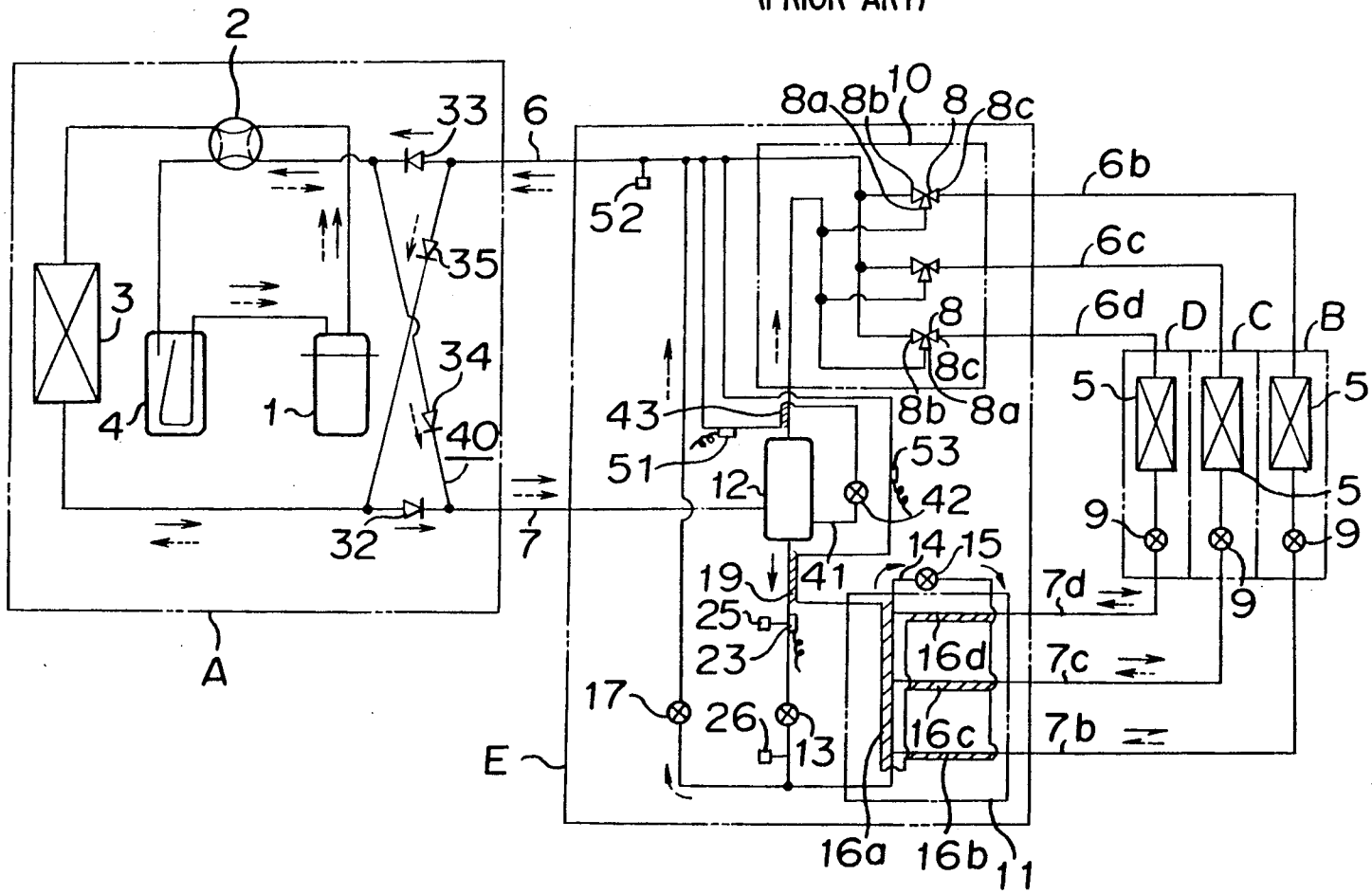
FIGURE 52 (PRIOR ART)
FIG. 52 is a schematic diagram showing the operation states of the conventional apparatus of FIG. 51 wherein solo cooling or solo heating is performed.
Figure 53:
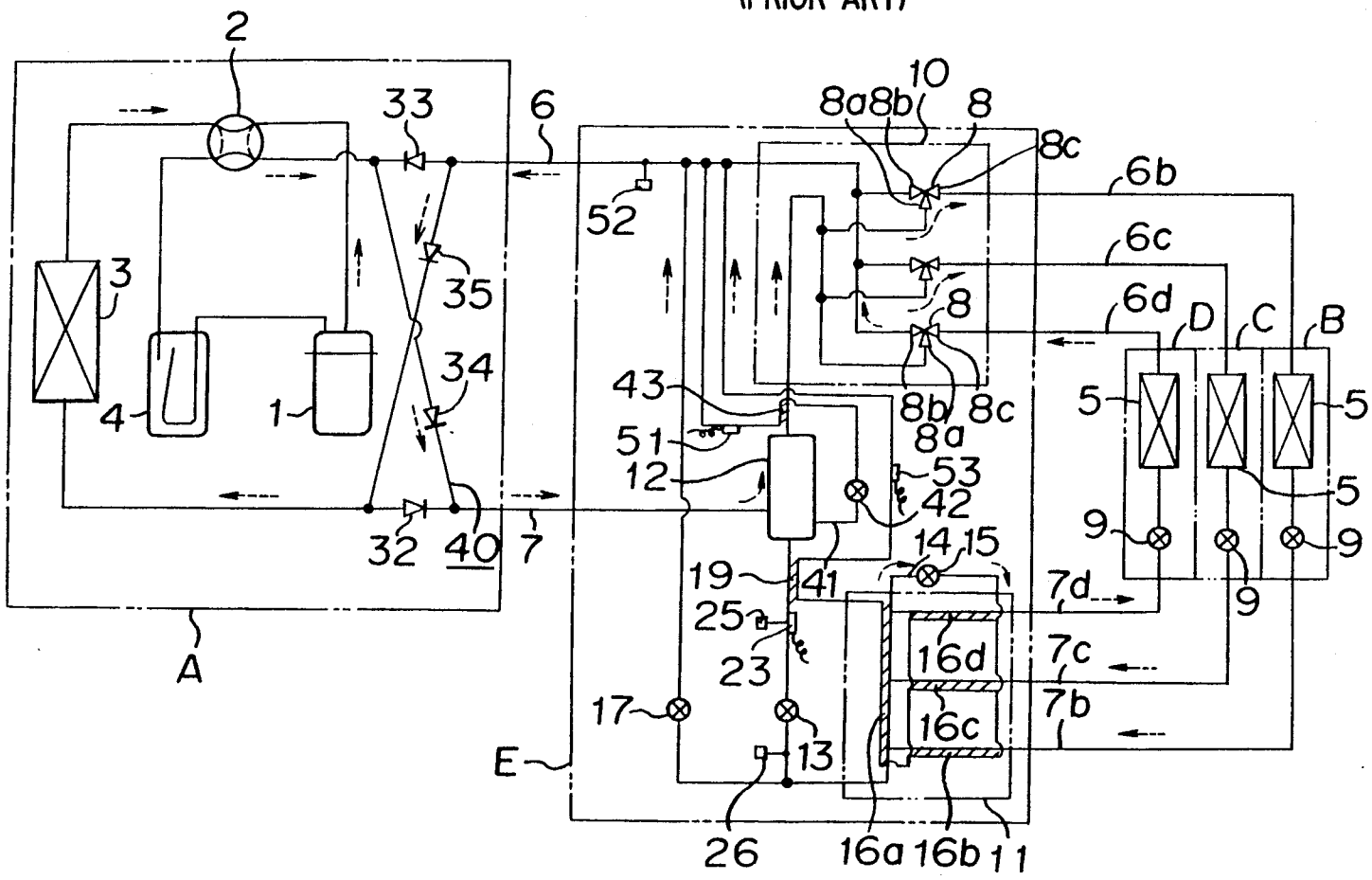
FIGURE 53 (PRIOR ART)
FIG. 53 is a schematic diagram showing the operation state of the conventional apparatus of FIG. 51 wherein heating is principally performed under cooling and heating concurrent operation.
Figure 54:
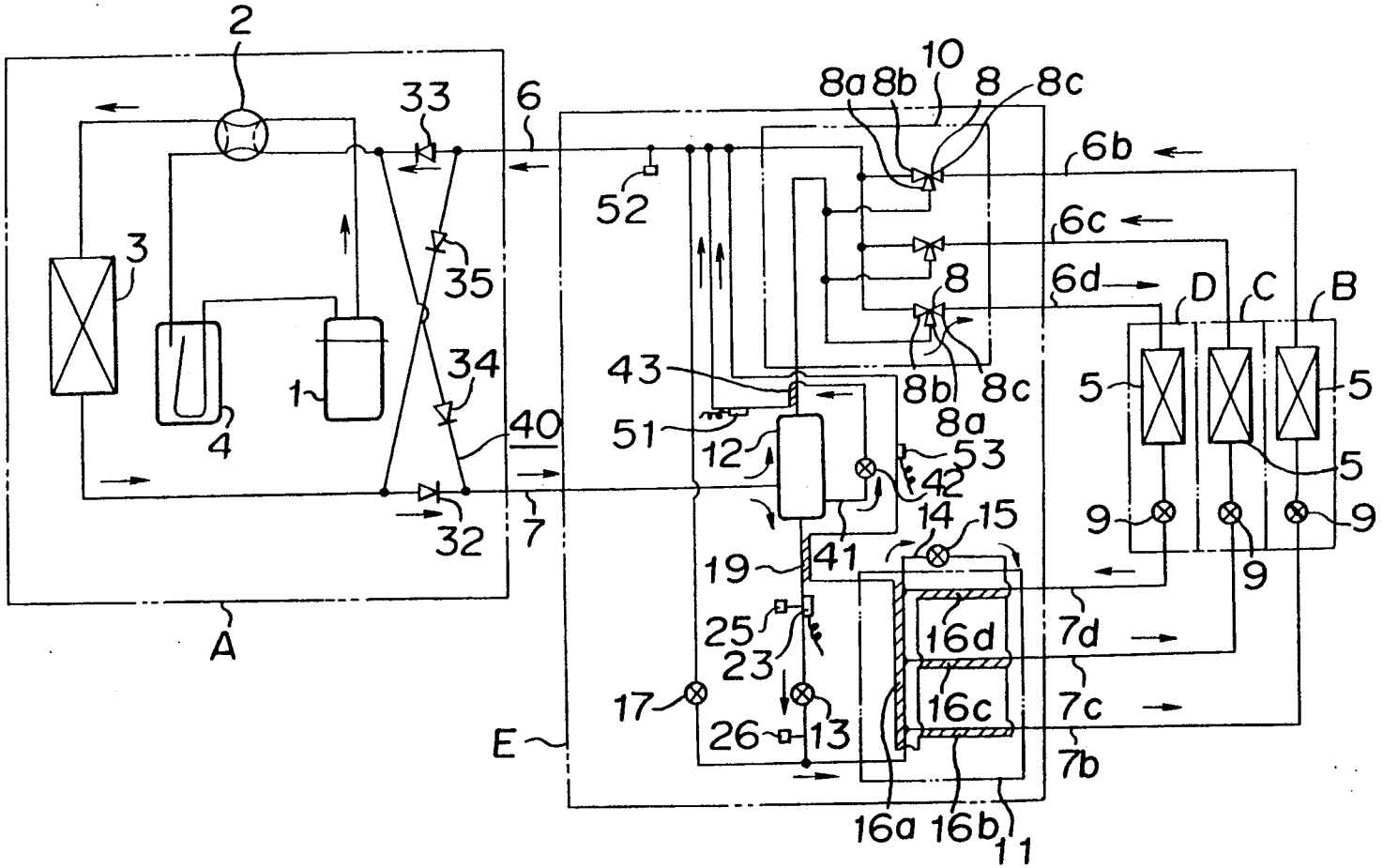
FIGURE 54 (PRIOR ART)
FIG. 54 is a schematic diagram showing the operation state of the conventional apparatus of the FIG. 51 wherein cooling is principally performed under cooling and heating concurrent operation.

Although in the first through eighth embodiments the three way switching valves 8 can be arranged to selectively connect the first branch pipes 6*b*, 6*c* and 6*d* to either the first main pipe 6 or the second main pipe 7, spared on off valves such as electromagnetic on off valves 30 and 31 as shown in FIG. 46 can be provided instead of the three way switching valves to make selective switching, offering similar advantages.

What is claimed is:

1. An air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which is connected to the other end of the indoor heat exchanger of each indoor unit through the first flow controllers, and which connects the other end to the second main pipe through a second flow controller;

the first branch joint and the second branch joint connected together through the second flow controller;

the second branch joint connected to the first main pipe through a third flow controller;

a junction device which includes the first branch joint, the second flow controller, the third flow controller and the second branch joint, and which is interposed between the heat source device and the indoor units;

the first main pipe having a greater diameter than the second main pipe;

a switching arrangement between the first main pipe and the second main pipe in the heat source device to switch the first main pipe and the second main pipe to a low pressure side and to a high pressure side, respectively, when the outdoor heat exchanger works as a condenser or as an evaporator;

a first timer for changing the setting of the second flow controller at a first cycle during operation of the compressor;

a second timer for returning the setting of the second flow controller to its initial setting at a second cycle longer than the first cycle; and determination means for changing the setting of the second flow controller by a predetermined value at a time based on outputs from the first timer, and for returning the setting of the second flow controller to the initial setting based on an output from the second timer.

2. An air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which is connected to the other end of the indoor heat exchanger of each indoor unit through the first flow controllers, and which connects the other end to the second main pipe through a second flow controller;

the first branch joint and the second branch joint connected together through the second flow controller;

the second branch joint connected to the first main pipe through a third flow controller;

a junction device which includes the first branch joint, the second flow controller, the third flow controller and the second branch joint, and which is interposed between the heat source device and the indoor units;

the first main pipe having a greater diameter than the second main pipe; and a switching arrangement between the first main pipe and the second main pipe in the heat source device to switch the first main pipe and the second main pipe to a low pressure side and to a high pressure side, respectively, when the outdoor heat exchanger works as a condenser or as an evaporator;

means to set a predetermined minimum value of the setting of the second flow controller during operation of the compressor.

3. An air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which is connected to the other end of the indoor heat exchanger of each indoor unit through the first flow controllers, and which connects the other end to the second main pipe through a second flow controller;

the first branch joint and the second branch joint connected together through the second flow controller;

the second branch joint connected to the first main pipe through a third flow controller;

a junction device which includes the first branch joint, the second flow controller, the third flow controller and the second branch joint, and which is interposed between the heat source device and the indoor units;

the first main pipe having a greater diameter than the second main pipe; and a switching arrangement between the first main pipe and the second main pipe in the heat source device to switch the first main pipe and the second main pipe to a low pressure side and to a high pressure side, respectively, when the outdoor heat exchanger works as a condenser or as an evaporator;

wherein a capillary is arranged in parallel with the second flow controller.

4. An air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which is connected to the other end of the indoor heat exchanger of each indoor unit through the first flow controllers, and which connects the other end to the second main pipe through a second flow controller;

the first branch joint and the second branch joint connected together through the second flow controller;

the second branch joint connected to the first main pipe through a third flow controller;

a junction device which includes the first branch joint, the second flow controller, the third flow controller and the second branch joint, and which is interposed between the heat source device and the indoor units;

the first main pipe having a greater diameter than the second main pipe;

a switching arrangement between the first main pipe and the second main pipe in the heat source device to switch the first main pipe and the second main pipe to a low pressure side and to a high pressure side, respectively;

a first pressure detector and a second pressure detector arranged at a refrigerant inlet side and a refrigerant outlet side of the second flow controller respectively; and determination means for selectively increasing the setting of one of the second flow controller and the third flow controller, depending on a differential pressure applied to the second flow controller, in such a manner that the value detected by the first and second pressure detectors are used as inputs when a high pressure is transitionally raised during operation of the compressor.

5. An air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which is connected to the other end of the indoor heat exchanger of each indoor unit through the first flow controllers, and which connects the other end to the second main pipe through a second flow controller;

the first branch joint and the second branch joint connected together through the second flow controller;

the second branch joint connected to the first main pipe through a third flow controller;

a junction device which includes the first branch joint, the second flow controller, the third flow controller and the second branch joint, and which is interposed between the heat source device and the indoor units;

the first main pipe having a greater diameter than the second main pipe;

a switching arrangement between the first main pipe and the second main pipe in the heat source device to switch the first main pipe and the second main pipe to a low pressure side and to a high pressure side, respectively; and determination means for increasing the setting of the third flow controller when high pressure is transitionally raised in only cooling.

6. An air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which is connected to the other end of the indoor heat exchanger of each indoor unit through the first flow controllers, and which connects the other end to the second main pipe through a second flow controller;

the first branch joint and the second branch joint connected together through the second flow controller;

the second branch joint connected to the first main pipe through a third flow controller;

a junction device which includes the first branch joint, the second flow controller, the third flow controller and the second branch joint, and which is interposed between the heat source device and the indoor units;

the first main pipe having a greater diameter than the second main pipe;

a switching arrangement between the first main pipe and the second main pipe in the heat source device to switch the first main pipe and the second main pipe to a low pressure side and to a high pressure side, respectively; and determination means for increasing the setting of the second flow controller when high pressure is transitionally raised in only heating or cooling and heating concurrent operation with heating principally performed.

7. An air conditioning apparatus comprising:

a single heat source device including a compressor, a reversing valve, an outdoor heat exchanger and an accumulator;

a plurality of indoor units including indoor heat exchangers the first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which connects the other end of the indoor heat exchanger of each indoor unit to the second main pipe through the first flow controllers; and the first branch joint and the second branch joint connected together through a second flow controller;

the indoor units including a first indoor unit and second indoor units, the first indoor unit having a fan for introducing outdoor air, and carrying out heat exchange with outdoor air introduced by the fan, the second indoor units having fans for circulating indoor air, and carrying out heat exchange with the air circulated by the fans; and control means for operating the first indoor unit to carry out heating in response to a determination that at least one of said second indoor units is carrying out heating.

8. An air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which connects the other end of the indoor heat exchanger of each indoor unit to the second main pipe through the first flow controllers; and the first joint and the second branch joint connected together through a second flow controller;

the indoor units including a first indoor units and second indoor units, the first indoor units having a fan for introducing outdoor air, and carrying out heat exchange with outdoor air introduced by the fan, the second indoor units having fans for circulating indoor air, and carrying out heat exchange with the air circulated by the fans; and control means for operating the first indoor unit to carry out cooling in response to a determination that none of said second indoor units is carrying out heating and at least one of said second indoor units is carrying out cooling.

9. An air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which connects the other end of the indoor heat exchangers of each indoor unit to the second main pipe through the first flow controllers;

the first branch joint and the second branch joint connected together through a second flow controller;

the indoor units including a first indoor unit and second indoor units, the first indoor unit having a fan for introducing outdoor air, and carrying out heat exchange with outdoor air introduced by the fan, the second indoor units having fans for circulating indoor air, and carrying out heat exchange with the air circulating by the fans; and control means for operating said first indoor unit to carry out ventilation in response to a determination that none of said second indoor cooling units is carrying out heating or cooling and at least one of the second indoor units is carrying out ventilation.

10. An air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which connects the other end of the indoor heat exchanger of each indoor unit to the second main pipe through the first flow controllers;

the first branch joint and the second branch joint connected together through a second flow controller;

the second branch joint connected to the first main pipe through a fourth flow controller;

a bypass pipe which has one end connected to the second branch joint and the other end connected to the first main pipe through a third flow controller;

a first heat exchanging portion which carries out heat exchange between the bypass pipe connecting the third flow controller to the first main pipe, and the pipe connecting the second main pipe to the second flow controller;

a junction device which includes the first branch joint, the second branch joint, the second flow controller, the third flow controller the fourth flow controller, the first heat exchanging portion and the bypass pipe, and which is interposed between the heat source device (A) and the indoor units;

the first main pipe having a greater diameter than the second main pipe;

a switching valve arrangement between the first main pipe and the second main pipe in the heat source device to switch the first main pipe and the second main pipe to a low pressure side and to a high pressure side, respectively;

a heat source device bypass pipe which extends from the second main pipe on a high pressure refrigerant outlet side of the switching arrangement to the first main pipe on a low pressure refrigerant inlet side of the switching arrangement;

a sixth on off valve which is arranged in the heat source device bypass pipe to make an on off control of the heat source device bypass pipe; and control means for opening the sixth on off valve when a discharge pressure of the compressor is beyond a preset first value.

11. An air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which connects the other end of the indoor heat exchanger of each indoor unit to the second main pipe through the first flow controllers;

the first branch joint and the second branch joint connected together through a second flow controller;

the second branch joint connected to the first main pipe through a fourth flow controller;

a bypass pipe which has one end connected to the second branch joint and the other end connected to the first main pipe through a third flow controller;

a first heat exchanging portion which carries out heat exchange between the bypass pipe connecting the third flow controller to the first main pipe, and the pipe connecting the second main pipe to the second flow controller;

a junction device which includes the first branch joint, the second branch joint, the second flow controller, the third flow controller, the fourth flow controller, the first heat exchanging portion and the bypass pipe, and which is interposed between the heat source device and the indoor units;

the first main pipe having a greater diameter than the second main pipe;

a switching valve arrangement between the first main pipe and the second main pipe in the heat source device to switch the first main pipe and the second main pipe to a low pressure side and to a high pressure side, respectively;

a heat source device bypass pipe which extends from the second main pipe on a high pressure refrigerant outlet side of the switching arrangement to the first main pipe on a low pressure refrigerant inlet side of the switching arrangement;

a sixth on off valve which is arranged in the heat source device bypass pipe to make an on off control of the heat source device bypass pipe;

a fourth temperature detector for detecting a discharge gaseous refrigerant temperature of the compressor; and control means for opening the sixth on off valve when the discharge temperature of the compressor is beyond a present first value.

12. An air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which connects the other end of the indoor heat exchanger of each indoor unit to the second main pipe through the first flow controllers; and the first branch joint and the second branch joint connected together through a second flow controller; and the indoor units including a first indoor unit and second indoor units, the first indoor unit having a fan for introducing outdoor air, and carrying out heat exchange with outdoor air introduced by the fan, the second indoor units having fans for circulating indoor air, and carrying out heat exchange with the air circulated by the fans; and wherein an air path is provided such that said outdoor air which has passed through said first indoor unit is supplied to at least one of said second indoor units.

13. The air conditioning apparatus of claim 12, wherein said air path supplies air which has passed through said first indoor unit to each of the second indoor units.

* * * * *